US005119080A

United States Patent [19]

Kajimoto et al.

[11] Patent Number: 5,119,080

[45] Date of Patent: Jun. 2, 1992

[54] VIDEO-DATA PROCESSOR

[75] Inventors: Kazuo Kajimoto, Neyagawa; Tomoyuki Nonomura, Osaka, both of Japan

[73] Assignee: Matsushita Electric Industrial Co., Ltd., Osaka, Japan

[21] Appl. No.: 476,169

[22] Filed: Feb. 7, 1990

[30] Foreign Application Priority Data

Feb. 13, 1989 [JP] Japan ..... 1-033044

[51] Int. Cl.[5] ..... G09G 1/06

[52] U.S. Cl. ..... 340/723; 340/799; 340/731; 358/22

[58] Field of Search ..... 340/723, 721, 731, 734, 340/798, 799; 358/182, 183, 22; 364/518, 521

[56] References Cited

U.S. PATENT DOCUMENTS 4,498,081 2/1985 Fukushima et al. ..... 340/749
4,663,619 5/1987 Staggs et al. ..... 340/799
4,888,643 12/1989 Kusakabe ..... 340/723

*Primary Examiner*—Jeffery A. Brier
*Assistant Examiner*—Regina Liang
*Attorney, Agent, or Firm*—Stevens, Davis, Miller & Mosher

[57] ABSTRACT

A video-data processor is disclosed in which a video data produced from the laser disk or the like is processed in four stages of video memory. The video data is first A/D converted and written into a first video memory. Then, the video data in the first video memory is subjected to the special effect such as mosaicking and written into a second video memory. A part of the video data in the second video memory is cut out, projected and written into a third video memory, in which the video data, graphics and letters visually projected are combined. A part of the resulting data is cut out, projected and written into a fourth video memory as a window. The data thus projected as a window is displayed on a display unit from the fourth video memory. The visual projection, window projection and the special effect between the video memories are defined to realize the special effect, scroll or partial cut-out of the video data in a multi-window environment. Also, a method is disclosed in which even if there is only one video memory, the definition of the special effect, visual projection and window projection permits computation of the result of the assumed presence of four video memories and realizes the special effect, scroll or partial cut-out of the video data in a multi-window environment.

22 Claims, 31 Drawing Sheets

VIDEO OFFSET INFORMATION { HORIZONTAL ← 200−100=100
VERTICAL ← 50−100=−50

RELATIVE/ABSOLUTE COORDINATE CONVERSION INFORMATION
- HORIZONTAL ← 100−300=−200
- VERTICAL ← 70− 50=20

RELATIVE VIDEO DISPLAY RECTANGLE (300, 50) ~ (400, 250)

VIDEO OFFSET INFORMATION { HORIZONTAL 100 READ EXPANSION RATE/EQUINULTIPLE
VERTICAL−50

→ VIDEO DATA READ START COORDINATE { HORIZONTAL ← (300−100) / 1=200
VERTICAL ← (50− (−50) / 1=100

RELATIVE VIDEO DISPLAY RECTANGLE (300, 510) ~ (40, 250)

RELATIVE/ABSOLUTE COORDINATE CONVERSION INFORMATION

{ HORIZONTAL −200
{ VERTICAL 20

⟶ ABSOLUTE VIDEO DISPLAY RECTANGLE (100, 70) ~ (200, 270)

ASSUMED FIRST VIDEO MEMORY SIZE INFORMATION
{HORIZONTAL 640
VERTICAL 480

ASSUMED SECOND VIDEO MEMORY SIZE INFORMATION
{HORIZONTAL 320
VERTICAL 240

TILE SIZE INFORMATION {HORIZONTAL 4
VERTICAL 4

→ READ EXPANSION RATE ← 4

→ WRITE EXPANSION/CONTRACTION RATE
← 640/320/4=1/8

VIDEO-DATA PROCESSOR

BACKGROUND OF THE INVENTION

The present invention relates to a video-data processor for displaying a video data in multiple windows on a screen of the personal computer or the like.

In view of the fact that a video signal is full of reality and has a motion easily understandable, there is a gradually rising demand for displaying it on the screen of a personal computer in a manner similar to characters and graphics. FIG. 36 is a block diagram showing a conventional video data processor for digitizing an analog video signal and displaying it in combination with graphics. In FIG. 36, reference numeral 3601 designates video-data A/D means for digitizing an analog video signal according to the NTSC or the like standard, numeral 3602 a graphic memory on which a graphic data is drawn, numeral 3603 a color-designating register having stored therein a given color of the graphic data on the graphic memory 3602, numeral 3604 video/-graphic combination means for selecting a video-data output from the video-data A/D means 3601 when a pixel having the color stored in the color-designating register 3603 is produced among the graphics produced from the graphic memory 3602, and selecting a graphic output in the other cases thereby to combine the video-data graphics, and numeral 3605 display means for displaying a combined output from the video/graphic combination means.

If the data stored in the color-designating register of the video-data processor is changed, it is possible to produce such a special effect as to change the manner of combining a video data and a graphic.

In recent years, a multi-window screen has been closely watched as a screen for dialogue with the computer providing a better human-machine interface. The multi-window screen has a plurality of rectangular areas called the windows on a single display means in such a way as if each window is an independent display means.

If a video data is to be adapted to this multi-window screen, means are required for moving, handforming and redrawing the windows. Also, it is necessary to combine the video data with graphics and special effect compatibly on the multi-window screen.

In the conventional video-data processor shown in FIG. 36, however, the whole area of the video data cannot be moved independently of the display means 3605, and therefore it is impossible to adapt a video data to a multi-window screen, as seen from an example shown in FIG. 37. In FIG. 37*a*, numeral 3701 designates the whole video-data screen applied as an input. Numeral 3702 in FIG. 37*b* designates a display screen having one window displayed on the display means 3605. Numeral 3703 designates a window displaying a video data, which is realized by applying the color stored in the color-designating register 3603 to the whole area of the graphic memory 3602 corresponding to the window 3703. In FIG. 37*c*, numeral 3704 designates a screen of the display means which is required to be realized when the window 3703 is relocated down to the right. The window 3703 before relocation and the window 3705 after relocation must have the same content. Actually, however, as shown by the screen designated by 3706 in FIG. 37*d*, the content of the window 3707 after relocation is considerably different from that of the window 3703 before relocation.

SUMMARY OF THE INVENTION

The object of the present invention is to provide a video-data processor and a method of processing a video data which realizes the relocation, transformation and redrawing of a window containing a video data compatibly on a multi-window screen and which permits a video data to be combined with a special effect and graphics within the particular window at the same time.

In order to achieve the above-mentioned object, there is provided according to one aspect of the present invention a first video data-processor comprising a first video memory, a second video memory, a third video memory, a fourth video memory, a special effect description memory for describing special effect information, a video cut-out area register for holding the coordinate of a rectangular area on the second video memory, a video write area register for holding the coordinate of a rectangular area on the third video memory, a window cut-out area register for holding the coordinate of a rectangular area on the third video memory, a window write area the memory for holding the coordinate of a rectangular area on the fourth video memory, video-data retrieval means for converting an analog video signal into a digital signal and writing the countered digital video data in the first video memory, special effect means for subjecting the video data written in the first video memory to a special effect processing corresponding to the special effect information described in the special effect description memory and writing the resulting video data into the second video memory, video projecting means for cutting out a video data in the rectangular area held in the video cut-out area register from the second video memory and writing the video data into the rectangular area held in the video write area register of the third video memory, graphic generation and write means for producing a graphic data and writing it into the third video memory, window projecting means for cutting out the video data and the graphic data in the rectangular area held in the window cut-out area register from the third video memory and writing the video data into the rectangular area held in the window write area register of the fourth video memory, and display means for D/A converting and displaying the content of the fourth video memory.

A method of processing the video data in this first video data-processor comprises the step of subjecting the video data written in the first video memory to a special effect processing corresponding to the special effect information described in the special effect description memory and writing the resulting video data into the second video memory, the video projecting step of cutting out the video data in the video cut-out area held in the video cut-out area register from the second video memory and writing it into the video write area held in the video write area register of the third video memory, the step of producing a graphic data and writing it into the third video memory, the window projecting step of cutting out the video data and the graphic data in the window cut-out area held in the window cut-out area register from the third video memory and writing them into the window write area held in the window write area register of the fourth video memory.

According to a second aspect of the present invention, there is provided a second video data-processor comprising a video memory assuming the existence therein of the first to fourth video memories of the first video data-processor, a video data write start coordinate register for holding a coordinate on the video memory, a video data read start coordinate register for holding a coordinate on the video memory, video data A/D means for A/D converting an analog video signal and producing a digital video data, video data expansion/contraction write means for maintaining equimultiple, expanding or contracting the video data produced from the video data A/D means and writing it into the video memory from the coordinate held in the video data write start coordinate register, video data expansion read means for reading the video data written in the video memory from the coordinate held in the video data read start coordinate register and maintaining equimultiple or expanding the same, a display area register for holding a rectangular area on the display screen for displaying the video data produced from the expansion read means, a graphic memory for writing the graphic data, a color-designating register for designating a given color in the graphic data, video/graphic combination means for selecting the video data from the video data expansion read means in respect of a coordinate contained in the rectangular area on the display screen held in the display area register and having the same color as the color-designating register in a corresponding area on the graphic memory and selecting the graphic data in the graphic memory in respect of other coordinates thereby to combine the video data obtained from the video data expansion read means with the graphic data in the graphic memory, display means for D/A converting and displaying the video data graphic data obtained from the video/graphic combination means, a special effect description memory for describing the special effect information assuming the existence of the first and second video memories, a video cut-out area register for holding the coordinate of the rectangular area on the second video memory assuming the existence of the second video memory, a video write area register for holding the coordinate of the rectangular area on the third video memory assuming the existence of the third video memory, a window cut-out area register for holding the coordinate of the rectangular area on the third video memory assuming the existence of the third video memory, a window write area register for holding the coordinate of the rectangular area on the fourth video memory assuming the existence of the fourth video memory, and hardware mapping means for computing the expansion/contraction rate of the video data expansion/contraction write means, the value of the video data write start coordinate register, the expansion rate of the video data expansion read means, the value of the video data read start coordinate register and the value of the display area register on the basis of the special effect information in the special effect description memory, the video cut-out area held in the video cut-out area register, the video write area held in the video write area register, the window cut-out area held in the window cut-out area register and the window write area held in the window write area register thereby, applying the color set in the color-designating register to a rectangular area corresponding to the value of the display area register on the graphic memory.

In a first method of processing the video data by the second video-data processor according to the present invention, the hardware mapping means carries out the step of computing the video offset information by substracting the coordinate at the upper left corner of the video cut-out area in the video cut-out area register in each of horizontal and vertical directions from the coordinate at the upper left corner of the video write area in the video write area register on the basis of the designation of expansion or contraction and the particular expansion/contraction rate described as the special effect information in the special effect description memory, the step of computing the information on relative/absolute coordinate conversion by subtracting the coordinate at the upper left corner of the window cut-out area in the window cut-out area register in each of the horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of the horizontal and vertical directions from the coordinate at the upper left corner of the relative video display rectangle and setting the difference in the video data read start coordinate register, the step of setting a display area by adding the relative/absolute coordinate conversion information to the coordinate at the upper left and lower right corners of the relative video display rectangle in each of the horizontal and vertical directions and setting the resulting absolute video display rectangle in the display area register, the step of setting the expansion/contraction rate in the special effect description memory for the video data expansion/contraction write means, the step of setting the read expansion rate of the video data expansion read means to an equimultiple, the step of setting a video data write start coordinate to the reference point of the video memory, and the step of drawing the color designated by the color-designating register by applying the particular color to the whole pixels in the graphic memory corresponding to the absolute video display rectangle.

In a second method of processing the video data by the second video data-processor according to the present invention, the hardware mapping means carries out the step of computing the video offset information by subtracting the coordinate at the upper left corner of the video cut-out area in the video cut-out area register in each of the horizontal and vertical directions from the coordinate at the upper left corner of the video write area in the video write area register on the basis of the mosaicking designation described as special effect information in the special effect memory, the assumed second video memory video size information providing the size of the video data on the assumed second video memory obtained after the mosaicking processing, and the tile size information providing the size of the tile under mosaicking, the step of computing the relative-/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a write expansion/contraction rate by dividing the assumed second video memory video size information by the assumed first video memory video size information representing the size of the original video data not mosaicked on the assumed first video memory, dividing the quotient by the tile size information, and setting the result as an expansion/contraction rate of the video data expansion/contraction write means, the step of setting a read expansion rate by setting the tile size information to the expansion rate of the video data expansion read means, the step of setting a video data read start coordinate by dividing the coordinate at the upper left corner of the relative video display rectangle less the video offset information in each of the horizontal and vertical directions by the expansion read rate and setting the result thereof in the video data read start coordinate register, the step of setting a display area by adding the relative/absolute coordinate conversion information to the coordinates at the upper left and lower right corners of the relative video display rectangle in each of the horizontal and vertical directions and setting the resulting absolute video display rectangle into the display area register, and the step of applying the color designated by the color-designating register to the whole pixels in the graphic memory corresponding to the absolute video display rectangle.

In a third method of processing the video data in the second video data-processor according to the present invention, the hardware mapping means carries out the step of computing the video offset information by subtracting the coordinate at the upper left corner of the video cut-out area in the video cut-out area register in each of the horizontal and vertical directions from the coordinate at the upper left corner of the video write area in the video write area register on the basis of the multi-freeze designation described as special effect information in the special effect description memory, the assumed second video memory video size information representing the size of the video data on the assumed second video memory obtained after the multi-freeze processing, and the numbers in horizontal and vertical directions of the unit minor images after multi-freeze processing, the step of computing a relative/absolute coordinate conversion information by subtracting the coordinate at the upper left corner of the window cut-out area in the window cut-out area register from the coordinate at the upper left corner of the window write area in the window write area register, the step of computing a relative video display rectangle which is a maximum rectangle contained in both the video write area and the window cut-out area, the step of setting a write expansion/contraction rate by dividing the assumed second video memory video size information by the assumed first video memory video size information representing the size of the original video data not multi-frozen on the assumed first video memory, dividing the resulting horizontal value thereof by the number in horizontal direction of the unit minor images, and setting the resulting quotient as an expansion/contraction rate of the video data expansion/contraction write means, the step of computing the unit image width by multiplying the assumed first video memory video size information by the write expansion/contraction rate in horizontal direction, the step of computing the unit image height by multiplying the write expansion/contraction rate by the assumed first video memory video size information in vertical direction, the step of initialization for video data write start by setting a reference point of the video memory described in claim 2 in the video data write start coordinate register, the step of drawing unit minor images by writing in the video memory the video data covered by the write expansion/contraction rate from the video data write start coordinate, the step of updating the horizontal drawing by adding the unit minor image width in the horizontal direction of the video data write start coordinate after application of the unit minor image-drawing step and applying the unit minor image-drawing step again, the present step being repeated until he number of drawn unit minor images in horizontal direction reaches the number of the unit minor images in horizontal direction in the special effect description memory, the step of updating the direction of vertical drawing by adding the unit minor image height in the vertical direction to the video data write start coordinate while setting zero in the horizontal direction after application of the horizontal drawing-updating step, and updating the horizontal drawing again, the present step being repeated until the number of the drawn unit minor images in the vertical direction reaches the number of unit minor images in vertical direction stored in the special effect description memory, the step of setting a read expansion rate of the video data expansion read means to an equimutiple, the step of setting a video data read start coordinate by setting in the video data read start coordinate register the value obtained by subtracting the video offset information from the coordinate at the upper left corner of the relative video display rectrangle in each of horizontal and vertical directions, the step of setting a display area by adding the relative/absolute coordinate conversion information to the coordinate at the upper left and lower right corners of the relative video display rectangle in each of horizontal and vertical directions and setting the resulting absolute video display rectangle into the display area register, and the step of applying the color designated by the color-designating register to the whole pixels in the graphic memory corresponding to the absolute video display rectangle.

In a fourth method of processing the video data by the second video data processor according to the present invention, the video projecting means comprises: (i) an expansion/contraction process including the step of setting a write expansion/contraction rate for the video data expansion/contraction write means as the expansion/contraction rate stored in the special effect description memory on the basis of the expansion/contraction designation and the related expansion/contraction rate described as special effect information in the special effect description register, the step of setting a read expansion rate by setting the expansion rate of the video data expansion read means to an equimultiple, and the step of setting the coordinate for starting writing video data to the reference point of the video memory; (ii) a mosaicking process including the step of setting a write expansion/contraction rate in which the assumed second video memory video size information representing the size of the video data on the second video memory obtained after mosaicking is divided by the assumed first video memory video size information representing the size of the original video data not mosaicked on the assumed first video memory on the basis of the mosaicking designation described as special effect information in the special effect description memory, the assumed second video memory video size information and the tile size information representing the size of the tile used for mosaicking, the resulting quotient being further divided by the tile size information, the result being set as an expansion/contraction rate for the video data expansion/contraction write means, and the step of setting the tile size information as an expansion rate of the video data expansion read means; (iii) a multi-freezing process including the step of setting a write expansion/contraction rate in which the assumed second video memory video size information representing the size of the video data on the assumed video memory obtained after the multi-freezing is divided by the assumed first video memory video size information representing the size of the original video data not multi-frozen on the assumed first video memory on the basis of the multi-freeze designation described as special effect information in the special effect description memory, the assumed second video memory video size information and the numbers of unit minor images in both horizontal and vertical directions after multi-freezing, and the horizontal value of the result of division is further divided by the number of unit minor images in horizontal direction, the resulting quotient being set as an expansion/contraction rate for the video data expansion/contraction write means, the step of computing a unit image width by multiplying the write expansion/-contraction rate in horizontal direction of the assumed first video memory video size information, the step of computing the unit image height by multiplying the write expansion/contraction rate in vertical direction of the assumed first video memory video size information, the step of initialization for video data write start by setting a reference point of the video memory described in claim 2 in the video data write start coordinate register, the step of drawing a unit minor image by writing into the video memory the video data covered by the write expansion/contraction rate from the video data write start coordinate, the step of updating the horizontal drawing by adding the unit minor image width in the horizontal direction of the video data write start coordinate after application of the unit minor image-drawing step and then applying the unit minor image-drawing step again, the present step being repeated until the number in horizontal direction of the drawn unit minor images reaches the number in horizontal direction of the unit minor images stored in the special effect description memory, the step of updating the vertical drawing by adding the unit minor image height in vertical direction of the video data write start coordinate after application of the horizontal drawing-updating step, setting zero in horizontal direction, and applying the horizontal drawing-updating step again, the present step being repeated until the number of them drawn unit minor images in vertical direction reaches that of the unit minor images in vertical direction stored in the special effect description memory, and the step of setting a read expansion rate of the video data expansion read means to an equimultiple; and (iv) another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing the relative/absolute coordinate conversion information by subtracting the coordinate at the upper left corner of the window cut-out area in the window cut-out area register in each of horizontal and vertical directions from the coordinate at the upper left corner of the window write area stored in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle, dividing the resulting difference by the expansion read rate of the video data expansion read means, and setting the quotient in the video data read start coordinate register, the step of setting a display area by adding the relative/absolute coordinate conversion information to the coordinates at the upper left and lower right corners of the relative video display rectangle in each of horizontal and vertical directions and setting the resulting absolute video display rectangle in the display area register, the step of applying the color designated by the color-designating register to the whole pixels in the graphic memory corresponding to the absolute video display rectangle, the step of switching the special effect by selecting the expansion/contraction, the mosaicking or multi-freezing process according to the designation data stored in the special effect description memory.

In a third video-data processor according to the present invention, the video/graphic combination means of the second video-data processor is replaced by exclusive OR means for computing an exclusive logic sum of the video data obtained from the expansion read means and the graphic data in the graphic memory.

In a method of processing video data by the third video data processor according to the present invention, the hardware mapping means comprises: (i) an expansion/contraction process including the step of setting the expansion/contraction rate of the special effect description memory as an expansion/contraction rate of the video data expansion/contraction write means on the basis of the expansion/contraction designation and the expansion/contraction rate described as special effect information in the special effect description memory, the step of setting the expansion rate of the video data expansion read means to an equimultiple, and the step of setting the coordinate of video data write start to the reference point of the video memory; (ii) a mosaicking process including the step of setting a write expansion/contraction rate in which the assumed second video memory video size information representing the size of the video data on the assumed second video memory obtained after mosaicking is divided by the assumed first video memory video size information representing the size of the original video data not mosaicked on the assumed first video memory on the basis of the mosaicking designation described in the special effect description memory as special effect information, the assumed second video memory video size information and the tile size information representing the size of the tile mosaicked, and further the result of division is divided by the tile size information, the quotient being set as an expansion/contraction rate of the video data expansion/contraction write means, and the step of setting the tile size information as an expansion rate of the video data expansion read means; (iii) a multi-freezing process including the step of setting a write expansion/contraction rate in which the assumed second video memory video size information representing the size of the video data on the assumed second video memory obtained after multi-freezing is divided by the assumed first video memory video size information representing the size of the original video data not multi-frozen on the assumed first video memory, and further the horizontal value of the result of division is divided by the number in horizontal direction of the unit minor images with the resulting quotient being set as an expansion/contraction rate of the video data expansion/contraction write means, the step of computing the unit image width by multiplying the write expansion/contraction rate in the horizontal direction of the assumed first video memory video size information, the step of computing the unit image height by multiplying the write expansion/contraction rate in vertical direction of the assumed first video memory video size information, the step of initialization for video data write start by setting a reference point of the video memory in the video data write start coordinate register, the step of drawing a unit minor image by writing in the video memory the video data covered by the write expansion/contraction rate from the video data write start coordinate, the step of updating the horizontal drawing by adding the unit minor image width in horizontal direction of the video data write start coordinate after application of the unit minor image-drawing step, and applying again the unit minor image-drawing step, the present step begin repeated until the number in horizontal direction of the drawn unit minor images reaches that of the unit minor images stored in the special effect description memory, the step of updating the vertical drawing by adding the unit minor image height in vertical direction of the video data write start coordinate after application of the horizontal drawing-updating step, setting zero in horizontal direction, and applying again the horizontal drawing-updating step, the vertical drawing-updating step being repeated until the number in vertical direction of the drawn unit minor images reaches that of the unit minor images stored in the special effect description memory, and the step of setting the read expansion rate of the video data expansion read means to an equimultiple; and (iv) another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing the relative/absolute coordinate conversion information by subtracting the coordinate at the upper left corner of the window cut-out area in the window cut-out area register in each of horizontal and vertical directions from the coordinate at the upper left corner of the window write area stored in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle and dividing the difference by the expansion read rate of the video data expansion read means, the step of setting a display area by adding the relative/absolute coordinate conversion information in each of horizontal and vertical directions to the coordinates at the upper left and lower right corners respectively of the relative video display rectangle and setting the resulting absolute video display rectangle in the display rectangle register, the step of switching the special effect by selecting the write expansion/contraction process when the content of the special effect description memory is expansion/contraction and selecting the mosaicking process if the content of the special effect description memory is multi-freezing, and the step of applying the white color to the whole pixels in the graphic memory corresponding to the absolute video display rectangle on the basis of the designation of reverse color described in the special effect description memory.

In a fourth video-data processor according to the present invention, the video/graphic combination means of the second video-data processor is replaced by AND means for computing the logic product of the video data obtained from the expansion read means and the graphic data in the graphic memory.

In a method of processing the video data by the fourth video data processor according to the present invention, the hardware mapping means comprises: (i) an expansion/contraction process including the step of setting a write expansion/contraction rate stored in the special effect description memory as an expansion/contraction rate of the video data expansion/contraction write means on the basis of the designation of expansion/contraction and the related expansion/contraction rate described as special effect information in the special effect description memory, the step of setting the read expansion rate of the video data expansion read means to an equimultiple, and the step of setting a video data write start coordinate at a reference point of the video memory; (ii) a mosaicking process including the step of setting a write expansion/contraction rate in which the assumed second video memory video size information representing the size of the video data on the assumed second video memory obtained after mosaicking is divided by the assumed first video memory video size information representing the size of the original video size not mosaicked on the assumed first video memory, on the basis of the mosaicking designation described as special effect information in the special effect description memory, the assumed second video memory video size information and the tile size information representing the size of the mosaicking tile, and further, the result of division is divided by the tile size information, the resulting quotient being set as an expansion/contraction rate of the video data expansion/contraction write means, and the step of setting a read expansion rate by setting the tile size information as an expansion rate of the video data expansion read means; (iii) a multi-freezing process including the step of setting a write expansion rate in which the assumed second video memory video size information representing the size of the video data on the assumed second video memory obtained after multi-freezing is divided by the assumed first video memory video size information representing the size of the original video data not multi-frozen on the assumed first video memory on the basis of the multi-freeze designation described as special effect information in the special effect description memory, the assumed second video memory video size information and the horizontal and vertical numbers of unit minor images after multi-freezing, and the horizontal value of the result of division is divided by the number in horizontal direction of the unit minor images, the resulting quotient being set as an expansion/contraction rate of the video data expansion/contraction write means, the step of computing the unit image width by multiplying the write expansion/contraction rate in horizontal direction of the assumed first video memory video size information, the step of computing the unit image height by multiplying the write expansion/contraction rate in vertical direction of the assumed first video memory video size information, the step of initialization for video data write start by setting a reference point of the video memory described in claim 2 in the video data write start coordinate register, the step of drawing a unit minor image by writing in the video memory the video data covered by the write expansion/contraction rate from the video data write start coordinate, the step of updating the horizontal drawing by adding the unit minor image width in horizontal direction of the video data write start coordinate after application of the unit minor image-drawing step, applying the unit minor image-drawing step again, the present step being repeated until the number in horizontal direction of the drawn unit minor images reaches that of the unit minor images stored in the special effect description memory, the step of updating the vertical drawing by adding the unit minor image height in vertical direction of the video data write start coordinate after application of the horizontal drawing-updating step, setting the horizontal direction thereof to zero, and applying the horizontal drawing-updating step again, the present step being repeated until the number of the drawn unit minor images in vertical direction reaches that of the unit minor images stored in the special effect description memory in vertical direction, and the step of setting the read expansion rate of the video data read means to an equimultiple; and (iv) another process including the step of computing the video offset information by subtracting the coordinate at the upper left corner of the video cut-out area in the video cut-out area register in each of horizontal and vertical directions from the coordinate at the upper left corner of the video write area stored in the video write area register, the step of computing a relative/absolute coordinate conversion information by subtracting the coordinate conversion information by subtracting the coordinate at the upper left corner of the window cut-out area in the window cut-out area register in each of the horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information from the coordinate at the upper left corner of the relative video display rectangle in each of horizontal and vertical directions and dividing the difference by the expansion read rate of the video data expansion read means, the quotient being set in the video data read start coordinate register, the step of setting a display area by adding the relative/absolute coordinate conversion information in each of the horizontal and vertical directions to the coordinates at the upper left and lower right corners of the relative video display rectangle respectively and setting the resulting absolute video display rectangle in the display area register, and the step of switching the special effect by selecting the write expansion/contraction if the content of the special effect description memory is expansion, the mosaicking if the content thereof is mosaicking, and the multi-freezing if the content thereof is multi-freezing, and the step of drawing gray by applying the gray color to the whole pixels in the graphic memory corresponding to the absolute video display rectangle on the basis of the art effect designation described in the special effect description memory.

A fifth video-data processor according to the present invention, as compared with the second video-data processor described above, further comprises exclusive OR means for computing the exclusive logic sum of the video data obtained from the expansion read means and the graphic data in the graphic memory, AND means for computing the logic product of the video data and the graphic data, and video/graphic switching means for switching the application between the video/graphic combination means, the exclusive OR means and the AND means.

In a method of processing the video data in the fifth video-data processor according to the present invention, the hardware mapping means comprises: (i) an expansion/contraction process including the step of setting the write expansion/contraction rate in the special effect description memory as an expansion/contraction rate of the video data expansion/contraction write means on the basis of the designation of the expansion/contraction and the related expansion/contraction rate described as special effect information in the special effect description memory, the step of setting the expansion rate of the video data expansion read means to an equimultiple, and the step of setting a video data write start coordinate to a reference point of the video memory; (ii) a mosaicking process including the step of setting a write expansion/contraction rate in which the assumed second video memory video size information representing the size of the video data on the assumed second video memory obtained after mosaicking is divided by the assumed first video memory video size information representing the size of the original video data not mosaicked on the assumed first video memory on the basis of the mosaicking designation described as special effect information in the special effect description memory, the assumed second video memory video size information and the tile size information representing the size of the tile mosaicked, and further the result of division is divided by the tile size information, the resulting quotient being set as an expansion/contraction rate of the video data expansion/contraction write means, and the step of setting the tile size information as an expansion rate of the video data expansion read means; (iii) a multi-freezing process including the step of setting a write expansion/contraction rate in which the assumed second video memory video size information representing the size of the video data on the assumed second video memory obtained after multi-freezing is divided by the assumed first hypothetical video memory video size information representing the size of the original video data not multi-frozen on the assumed second video memory on the basis of the multi-freeze designation described as special effect information in the special effect description memory, the assumed second video memory video size information and the numbers in horizontal and vertical directions of the unit minor images after multi-freezing, and further the horizontal value of the result of division is divided by the number in horizontal direction of the unit minor images, the resulting quotient being set as an expansion/contraction rate of the video data expansion/contraction write means, the step of computing the unit minor image width by multiplying the assumed first video memory video size information by the write expansion/contraction rate in horizontal direction, the step of computing the unit image height by multiplying the assumed first video memory video size information by the write expansion/contraction rate in vertical direction, the step of initialization for video data write start by setting the reference point of the video memory described in claim 2 in the video data write start coordinate register, the step of drawing a unit minor image by writing in the video memory the video data covered by the write expansion/contraction rate from the video data write start coordinate, the step of updating the horizontal drawing by adding the unit minor image width in horizontal direction of the video data write start coordinate after application of the unit minor image-drawing step and applying the unit minor image-drawing step again, the present step being repeated until the number in horizontal direction of the drawn unit minor images reaches that of the unit minor images stored in the special effect description memory in horizontal direction, the step of updating the vertical drawing by adding the unit minor image height in vertical direction of the video data write start coordinate after application of the horizontal drawing-updating step, and applying the horizontal drawing-updating step again, the present step being repeated until the number of the drawn unit minor images in vertical direction reaches that of the unit minor images stored in the special effect description memory in vertical direction, and the step of setting the expansion rate of the video data expansion read means to an equimultiple; and (iv) another process including the step of computing the video offset information by subtracting the coordinate at the upper left corner of the video cut-out area in each of horizontal and vertical directions in the video cut-out area register from the coordinate at the upper left corner of the video write area in the video write area register, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle, dividing the difference by the expansion read rate of the video data expansion read means, and setting the resulting quotient in the video data read start coordinate register, the step of setting a display area by adding the relative/absolute coordinate conversion information in each of horizontal and vertical directions to the coordinates at the upper left and lower right corners of the relative video display rectangle and setting the resulting absolute video display rectangle in the display area register, the step of switching the special effect by selecting the write expansion/contraction if the content of the special effect description memory is the designation of expansion/contraction, the mosaicking processing if the content of the special effect description memory is the designation of mosaicking processing, and the multi-freezing processing if the content of the memory is the designation of multi-freezing, the step of selecting the video pixel processing by selecting the video/graphic combination means while at the same time carrying out the substep of applying the color designated in the color-designating register to the whole pixels in the graphic memory corresponding to the absolute video display rectangle if the pixel processing is not designated in the special effect description memory, by selecting the exclusive OR means while at the same time carrying out the substep of applying the white color to the whole pixels in the graphic memory corresponding to the absolute video display rectangle if the pixel processing is designated as reverse color in the special effect description memory, and by selecting the AND means while at the same time carrying out the substep of applying the gray color to the whole pixels in the graphic memory corresponding to the absolute video display rectangle if the pixel processing is designated as the art effect in the special effect description memory.

A sixth video data processor according to the present invention comprises a sampling area register for holding a rectangular area sampled within a single screen of the video data and video data-limiting A/D conversion means for effecting A/D conversion only in the rectangular area of the analog video data held in the sampling area register, in place of the video data A/D conversion means in the second video data processor, and further comprises means for adding the value of the sampling area register to the information computed by the hardware mapping means.

In a method of processing the video data by a sixth video data processor according to the present invention, the hardware mapping means comprises the step of computing the video offset information by subtracting the coordinate at the upper left corner of the video cut-out area in the video cut-out area register in each of horizontal and vertical directions from the coordinate value at the upper left corner of the video write area in the video write area register on the basis of the designation of expansion/contraction and the related expansion/contraction rate described in the special effect description memory, the step of computing a relative-/absolute coordinate conversion information by subtracting the coordinate at the upper left corner of the window cut-out area in the window cut-out register in each of horizontal and vertical directions from the coordinate value at the upper left corner of the window write area in the window write area register, the step of computing a relative video display rectangle which is a maximum rectangle contained in both the video write area and the window cut-out area, the step of setting a video data write start coordinate by adding the relative-/absolute coordinate conversion information in each of horizontal and vertical directions to the coordinate at the upper left corner of the relative video display rectangle, and setting the resulting coordinate at the upper left corner of the absolute video display rectangle into the video data write start coordinate register, the step of setting the expansion/contraction rate in the special effect description memory as an expansion/contraction rate of the video data expansion/contraction write means, the step of setting a sampling area by subtracting the video offset information in each of horizontal and vertical directions from the coordinates at the upper left and lower right corners respectively of the relative video display rectangle, dividing the difference by the expansion/contraction rate, and setting the quotient in the sampling area register, the step of setting the expansion rate of the video data expansion read means to an equimultiple, the step of setting a video data read start coordinate at a reference point of the video memory, the step of setting a display area register by setting the areas corresponding to the whole screen of the display means into the display area register, and the step of applying the color designated by the color-designating register to the whole of the pixels in the graphic memory corresponding to the absolute video display rectangle.

A seventh video-data processor according to the present invention, as compared with the sixth video-data processor, further comprises a video data recording medium having recorded therein the video data and the time address information providing numerical values allotted primarily to a single screen of the video data by optical or magnetic means, a time address storage register including at least an assumed first memory called an assumed first video memory and corresponding to each of the assumed first video memories, and means for selecting one of the assumed first video memories. Also, the video cut-out area register, the video write area register, the window cut-out area register and window write area register in the sixth video-data processor are replaced by a video cut-out area register, a video write area register, a window cut-out area register, and a window write area register respectively corresponding to the assumed first video memory. In addition, the seventh data processor comprises reproduction time address acquisition means for acquiring the time address information under reproduction and time address search and reproduction means for seaching a screen conforming to a given time address information and starting the reproduction of the video data from the particular screen, and means for adding the value of the time address storage register and the information on selection of the assumed first video memory selection means to the information providing the computation basis in the hardware mapping means, so that the value of the time address storage register is added to the information thus obtained.

In a first method of processing the video data by the seventh video-data processor according to the present invention, the hardware mapping means comprises the step of computing the video offset information by subtracting the coordinate at the upper left corner of the video cut-out area in the video cut-out area register corresponding to the assumed first video memory in each of horizontal and vertical directions from the coordinate value at the upper left corner of the video write area in the video write area register corresponding to the assumed first video memory selected by the assumed first video memory selection means, on the basis of the expansion/contraction designation and the related expansion/contraction rate described in the special effect description memory, the step of computing a relative/absolute coordinate conversion information by subtracting the coordinate at the upper left corner of the window cut-out area in the window cut-out area register corresponding to the assumed first video memory in each of horizontal and vertical directions from the coordinate value at the upper left corner of the window write area in the window write area register corresponding to the assumed first video memory, the step of computing a relative video display rectangle which is a maximum rectangle contained in both the video write area and the window cut-out area, the step of setting a video data write start coordinate by adding the relative/absolute coordinate conversion information in each of horizontal and vertical directions to the coordinate value at the upper left corner of the relative video display rectangle and setting the resulting coordinate at the upper left corner of the absolute video display rectangle into the video data write start coordinate register, the step of setting a write expansion/contraction rate by setting the expansion/contraction rate described in the special effect description memory as an expansion/contraction rate of the video data expansion/contraction write means, the step of setting a sampling area by subtracting the video offset information in each of horizontal and vertical directions from the coordinates at the upper left and lower right corners respectively of the relative video display rectangle and dividing the difference by the expansion/contraction rate, the resulting quotient being set in the sampling area register, the step of setting the expansion rate of the video data expansion read means to an equimultiple, the step of setting a video data read start coordinate at a reference point of the video memory, the step of setting a display area register by setting an area corresponding to the whole screen of the display means into the display area register, the step of applying the color designated in the color-designating register to the whole of the pixels in the graphic memory corresponding to the absolute video display rectangle, the step of setting a time address by retrieving the time address information on the screen under reproduction by the reproduction time address retrieval means and setting it in the time address storage register corresponding to the assumed first video memory thus far selected, in the case where the assumed first video selected by the assumed first video memory selection means is changed, and the step of restarting reproduction by reading the time address information from the time address storage register corresponding to an assumed first video memory newly selected and controlling the time address search and reproduction means in a manner to start reproduction from the particular time address.

A second method of processing video data by the seventh video-data processor according to the present invention, as compared with the first method of video-data processing, further comprises the step of deciding the redrawing in which when the absolute video display area corresponding to a selected assumed first video memory is relocated or otherwise moved, it is decided whether it is necessary to redraw the absolute video display area corresponding to the other unselected assumed first video memories, the step of reproducing a redrawn screen by reproducing only a screen of the video data recording medium having the time address information of the time address storage register corresponding to the first assumed video memory for which it has been decided that the redrawing is necessary at the redrawing decision step, the step of electing an assumed first video memory temporarily by the assumed first video memory selection means, and the step of writing a redrawn screen by drawing the particular screen in the video memory.

In an eighth video-data processor according to the present invention, as compared with the first video-data processor, the special effect description memory is replaced by special effect description means, the video cut-out area register by video cut-out area holding means, the video write area register by video write area holding means, the window cut-out area register by window cut-out area holding means, and the window write area register by window write area holding means, and further comprises an operating system configured of the special effect description means, the video cut-out area holding means, the video write area holding means, the window cut-out area holding means and the window write area holding means.

In the eighth video-data processor according to the present invention, as compared with the second, third, fourth, fifth, sixth and seventh video-data processors, the special effect description memory is replaced by special effect description means, the video cut-out area register by video cut-out area holding means, the video write area register by video write area holding means, the window cut-out area register by window cut-out area holding means, and the window write area register by window write area holding means, and further comprises an operating system configured of the special effect description means, the video cut-out area holding means, the video write area holding means, the window cut-out area holding means, the window write area holding means and the hardware mapping means.

DESCRIPTION OF THE PREFERRED EMBODIMENTS

Figure 1:
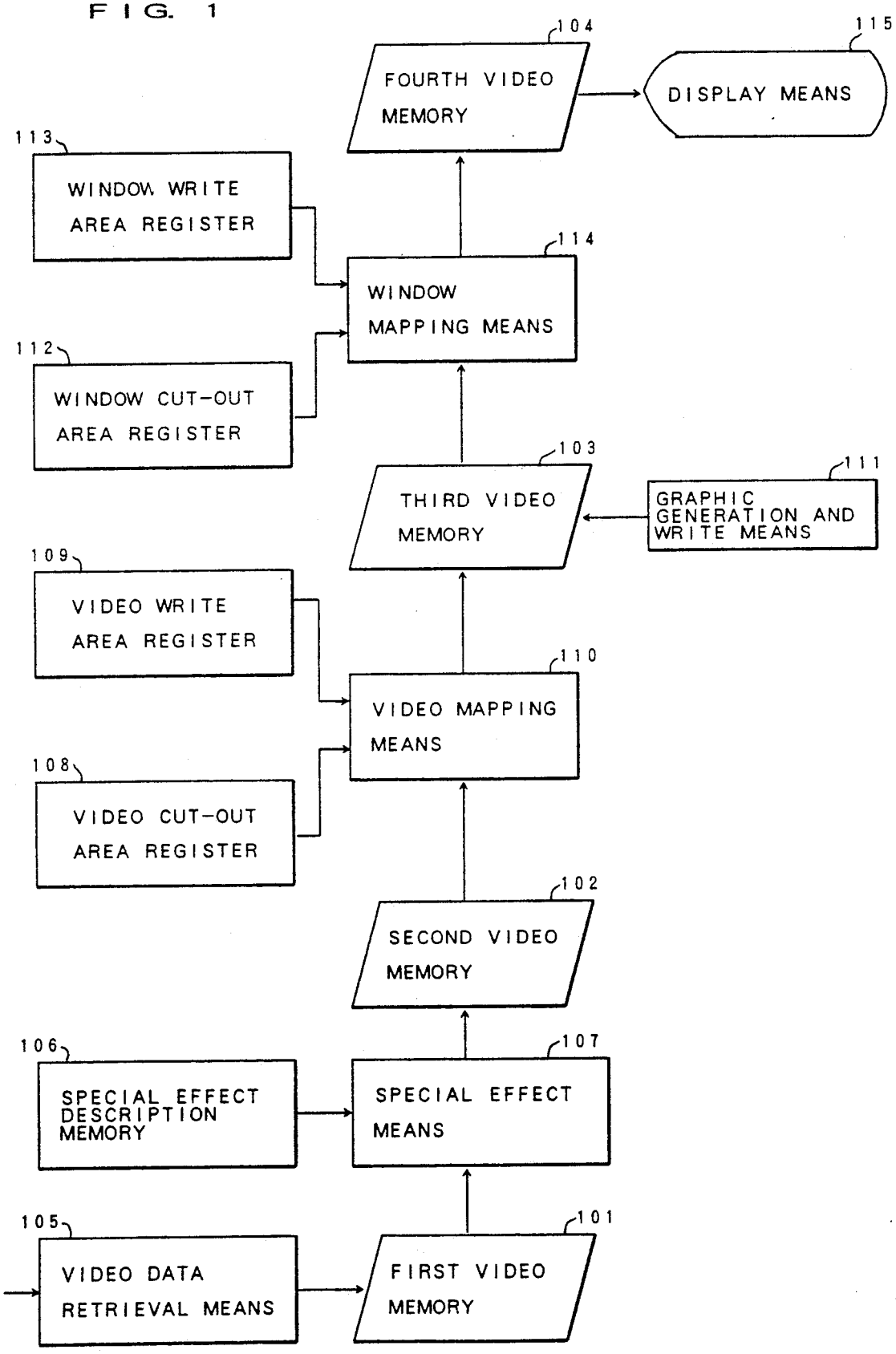
FIG. 1 is a block diagram showing an embodiment of a video-data processor according to the present invention.

FIG. 1 is a block diagram showing a video-data processor according to a first embodiment of the present invention. In FIG. 1, reference numeral 101 designates a first video memory, numeral 102 a second video memory, numeral 103 a third video memory, numeral 104 a fourth video memory, numeral 105 video data retrieval means for A/D converting an analog video data and writing it into the first video memory 101, numeral 106 a special effect description memory for describing the special effect information, numeral 107 special effect means for reading the video data out of the first video memory 101, subjecting the same data to the special effect in accordance with the special effect information described in the special effect description memory and writing the result thereof into the second video memory 102, numeral 108 a video cut-out area register for describing a rectangular area cut out from the second video memory 102, numeral 109 a video write area register for describing a rectangular area written in the third video memory 103, numeral 110 video projecting means for cutting out the video data in the rectangular area described in the video cut-out area register 108 and writing the result into the rectangular area described in the video write area register 109 in the third video memory 103, numeral 111 graphic generation and write means for generating a graphic data and writing into the third video memory 103, numeral 112 a window cut-out area register for describing a rectangular area cut out from the third video memory 103, numeral 113 a window write area register for describing a rectangular area written into the fourth video memory, numeral 114 window projecting means for cutting out the video/graphic data in the rectangular area described in the video cut-out area register in the third video memory 103 and writing into the rectangular area described in the window write area register in the fourth video memory 104, and numeral 115 display means for A/D converting and displaying the video/graphic data in the fourth video memory.

The manner in which the video data is processed in a video-data processor according to the present invention will be described below.

Figure 2:
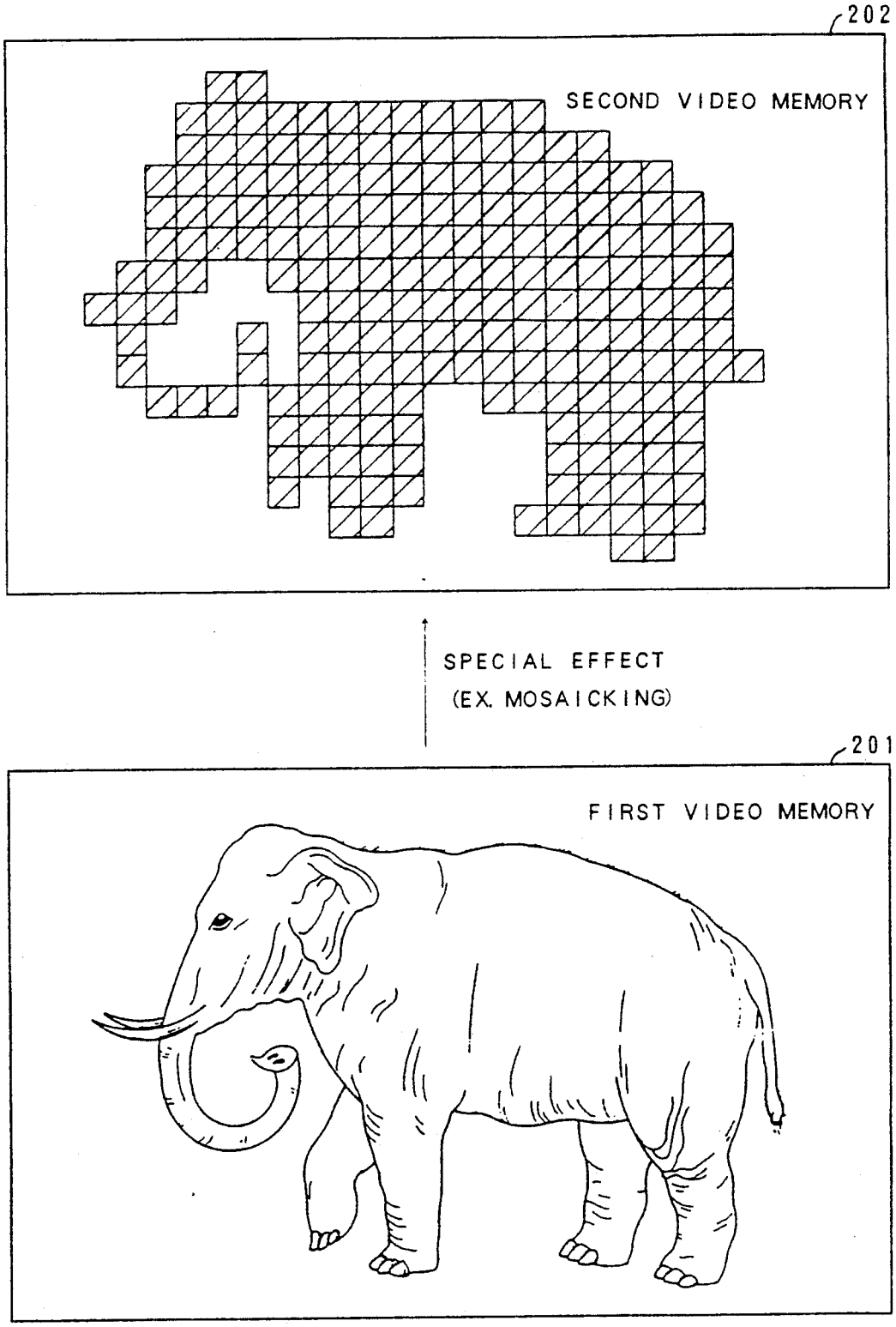
FIG. 2 is a diagram for explaining an example of processing in the special effect means.

An example of processing in the special effect means 107 is shown in FIG. 2. In FIG. 2, numeral 201 designates a video data on the first video memory 101, numeral 202 a video data on the second video memory subjected to special effect. In this example, since the description in the special effect description memory is mosaicking, the video data 201 on the first video memory is subjected to mosaicking process thereby to produce the video data 202 on the second video memory.

Figure 3:
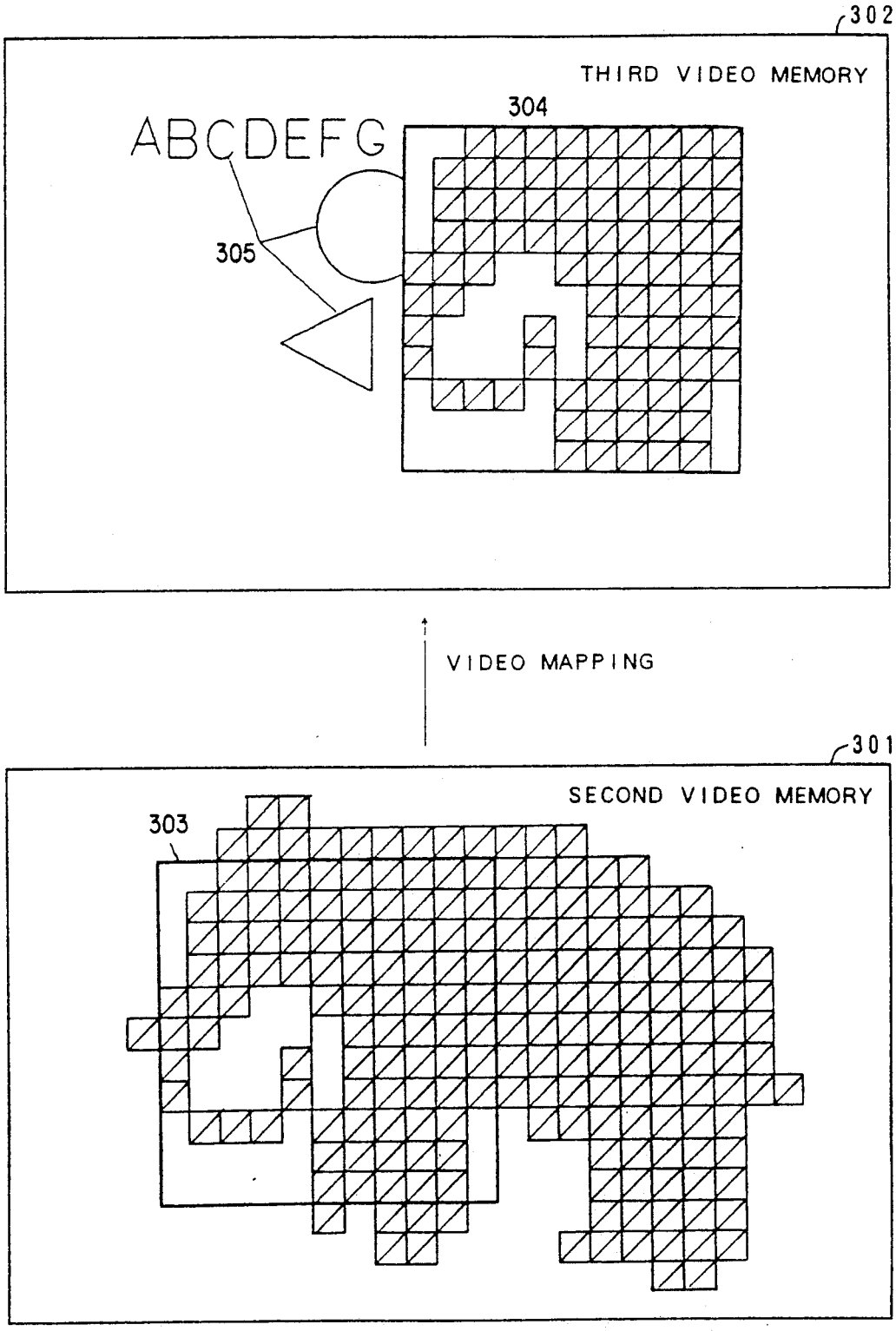
FIG. 3 is a diagram for explaining an example of processing in the video projecting means.

An example of processing in the video projecting means 110 is shown in FIG. 3. In FIG. 3, numeral 302 designates a video data on the third video memory 103 subjected to video projecting. Numeral 303 designates a video cut-out area set in the video cut-out area register 108, numeral 304 a video write area set in the video write area register 109, and numeral 305 a graphic written by the graphic generation write means 111. As will be seen from this, the video data in the video cut-out area 303 on the second video memory is written into the video write area on the third video memory 103 while at the same time being combined with the graphic 305.

Figure 4:
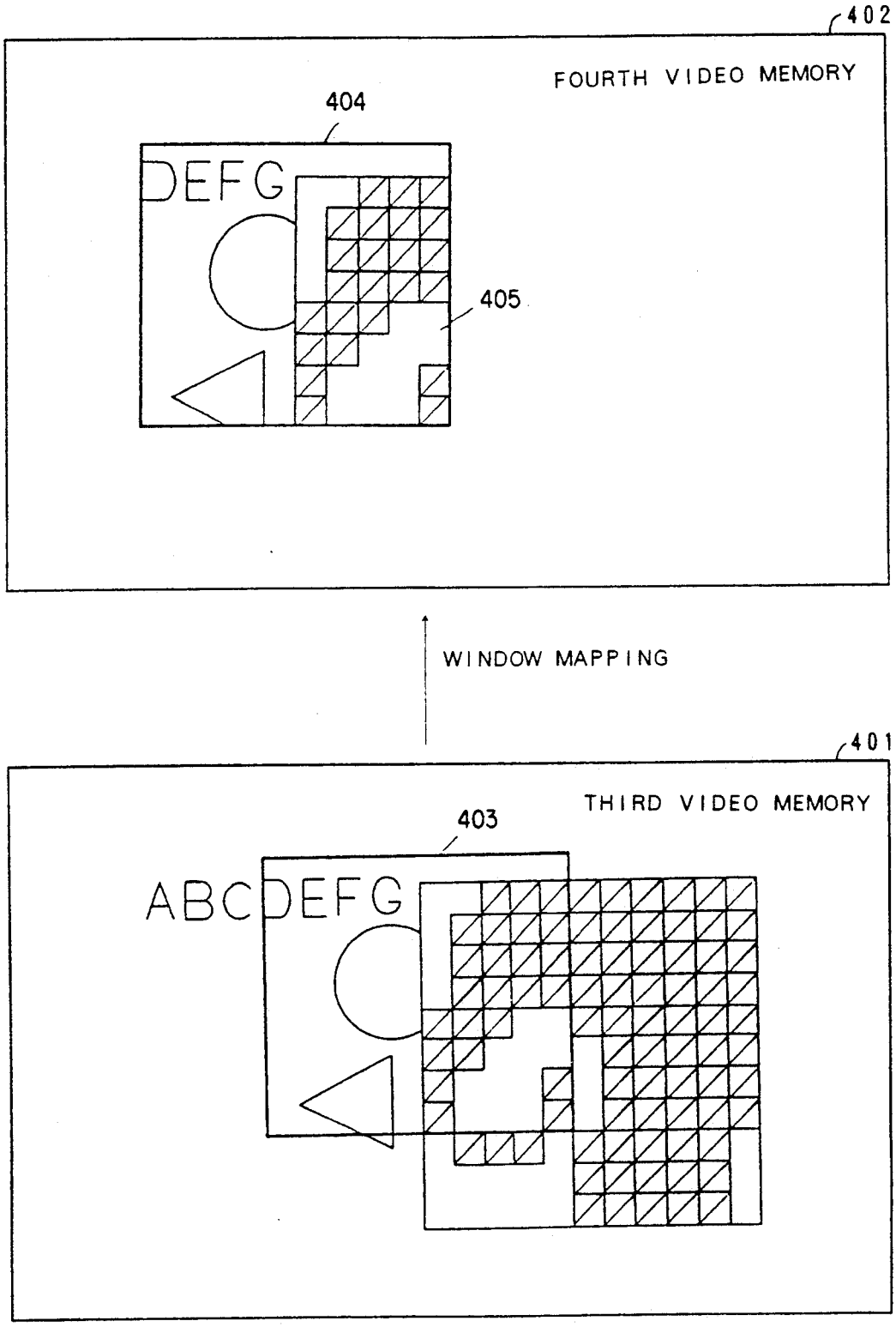
FIG. 4 is a diagram for explaining an example of processing in the window projecting means.

An example of processing in the window projecting means 114 is shown in FIG. 4. In FIG. 4, numeral 401 designates a video/graphic data 302 the third video which is identical to the part 302, and numeral 402 a video/graphic data on the fourth video memory 104 subjected to window projecting. Numeral 403 designates a window cut-out area set in the window cut-out area register 112, numeral 404 a window write area set in the window write area register 113, and numeral 405 a video write area visible in the window write area. As will be seen, the video/graphic data in the window cut-out area 403 on the third video memory 103 is written into the window write area on the fourth video memory 104.

The video-graphic fourth video memory is displayed as a multi-window screen. In other words, the window write area 404 constitutes a window visible to the eyes.

Figure 5:
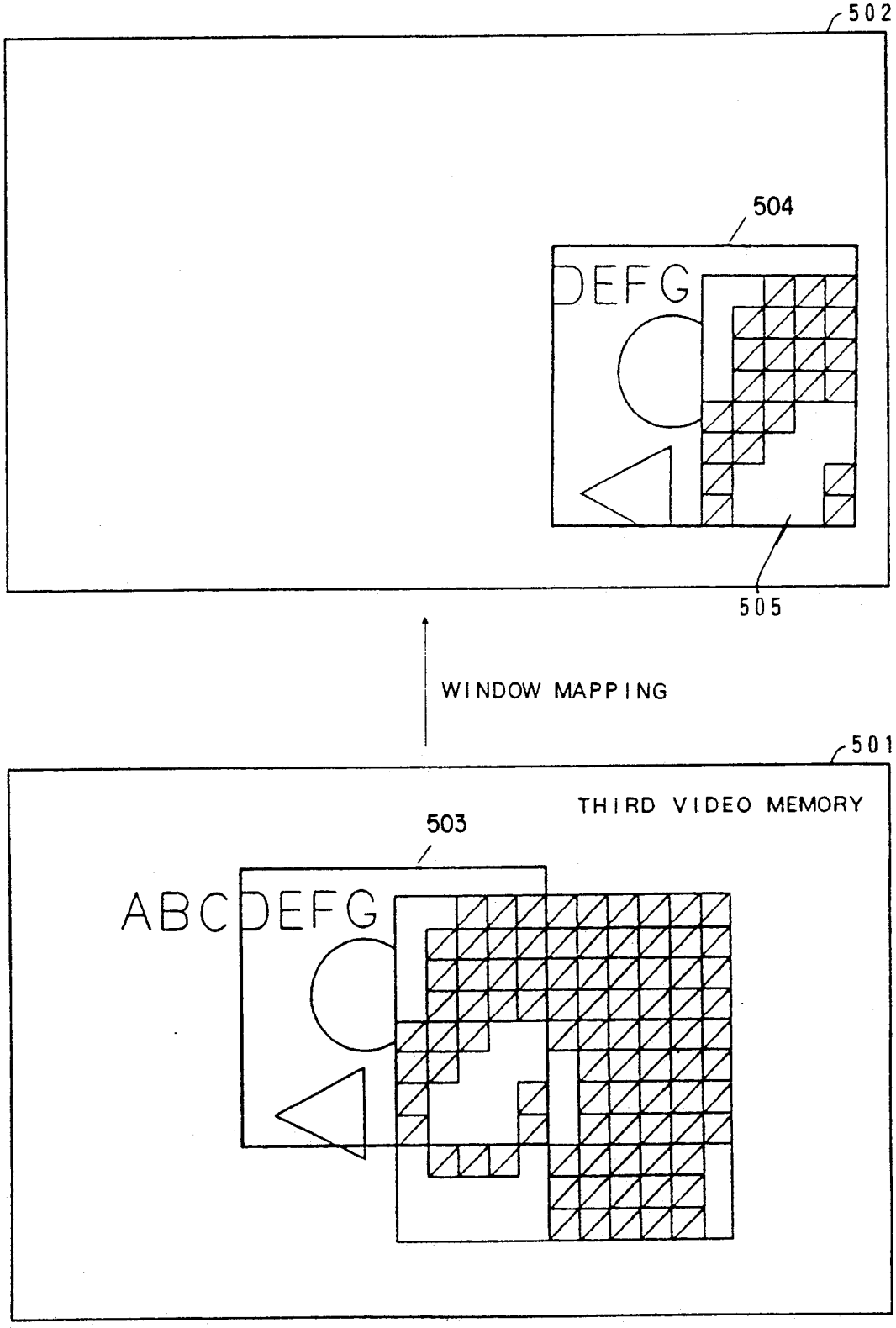
FIG. 5 is a diagram for explaining an example of window relocation.

The processing for realizing the relocation of the window from the states shown in FIGS. 2, 3 and 4 is shown in FIG. 5. The window of a video-data processor according to the present invention may be relocated simply by changing the value of the window write area register 113. Numeral 501 in FIG. 5 designates a video data/graphic on the third video memory identical to the part 401. Numeral 502 designates a video data/graphic on the fourth video memory 104 subjected to window projecting, numeral 503 a window cut-out area set in the window cut-out area register, numeral 504 a window write area after relocation set anew in the window write area register, and numeral 505 a video write area visible in the window write area after relocation. Comparison between the part 402 in FIG. 4 and the part 502 in FIG. 5 shows that according to the video-data processor of the present invention, the video data may be relocated with a window smoothly simply by changing the value of the window area register 113.

Figure 6:
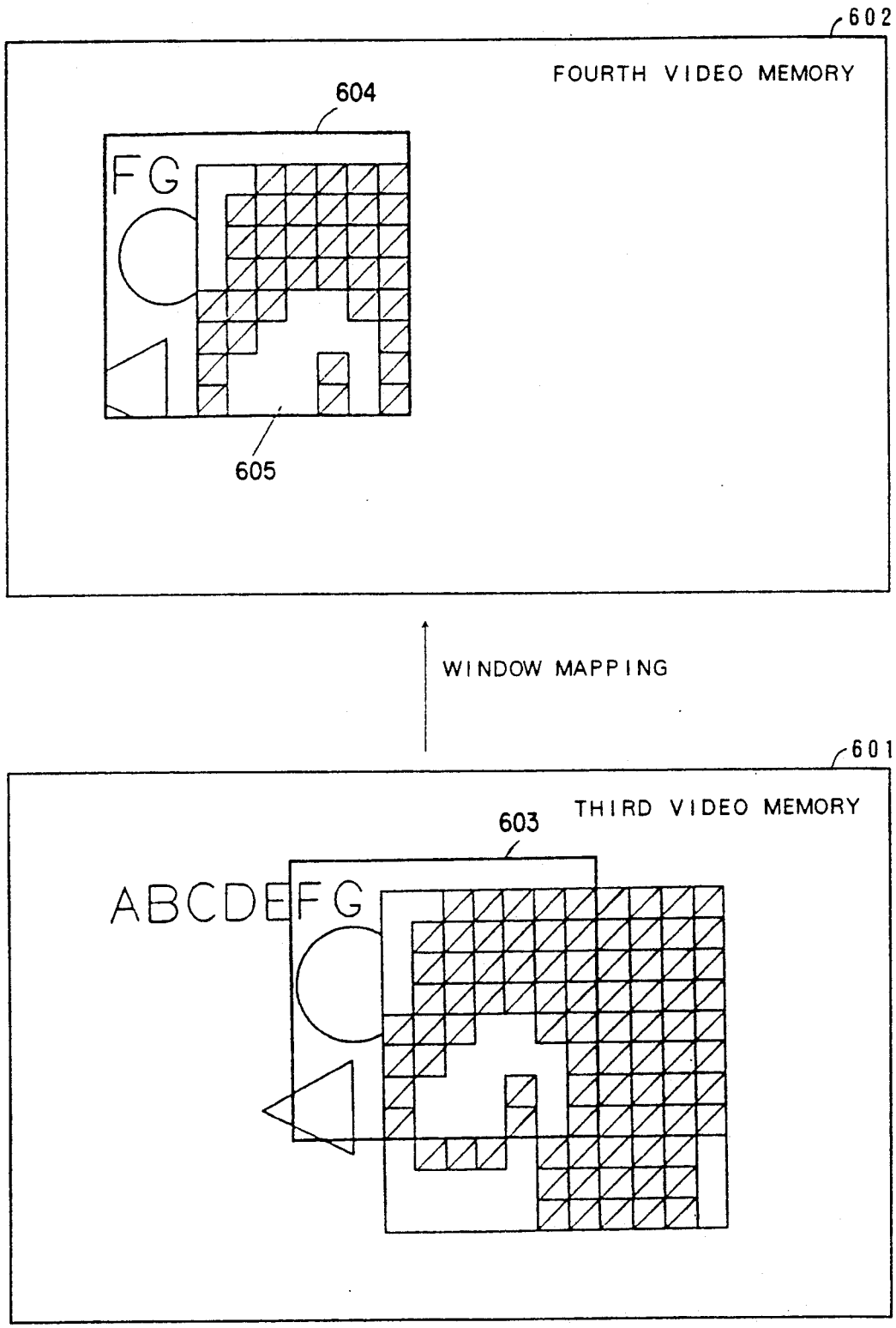
FIG. 6 is a diagram for explaining an example of scroll in a window.

The processing for realizing a scroll in the window with window position fixed from the state in FIGS. 2, 3 and 4 is shown in FIG. 6. In the video-data processor according to the present invention, the scroll in the window may be realized simply by changing the value of the window cut-out area register 112. Numeral 601 in FIG. 6 designates a video data graphic on the third video memory 103, numeral 602 a video data/graphic on the fourth video memory 104 subjected to window projecting, numeral 603 a window cut-out area set anew on the window cut-out area register 114, and numeral 604 a window write area set in the window write area register 113. Numeral 605 designates a video write area visible in the window write area after scroll. Comparison between the part 402 in FIG. 4 and the part 602 in FIG. 6 shows that in the video-data processor according to the present invention, the scroll of the video data in the window is realized smoothly simply by changing the value of the window cut-out area register 112.

Figure 7:
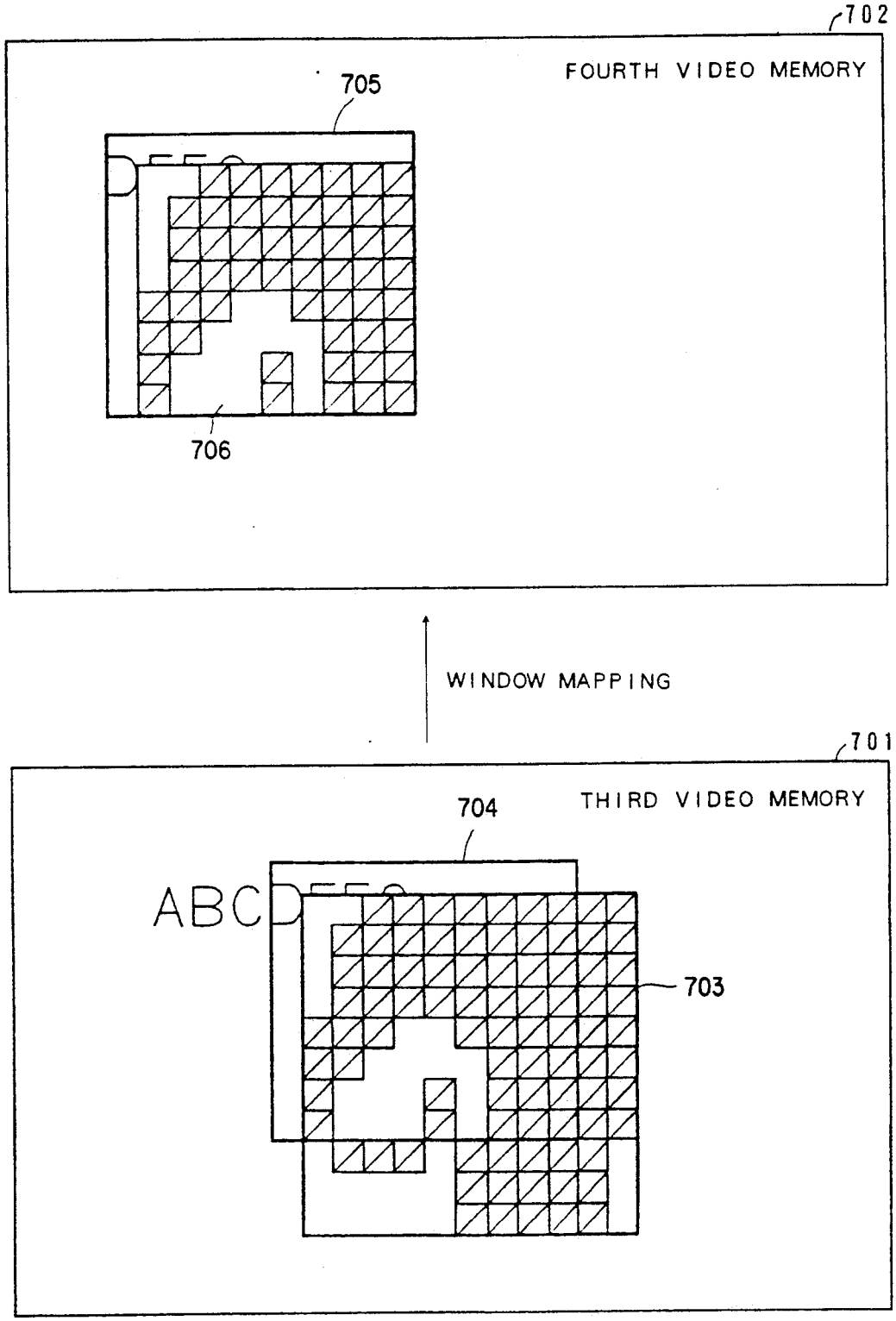
FIG. 7 is a diagram for explaining an example of relocation of only the video data.

FIG. 7 shows the processing of relocating the video data position alone from the state shown in FIGS. 2, 3 and 4 while fixing the window position and the graphic position. In the video-data processor according to the present invention, the video data position may be relocated with the graphic position fixed, simply by changing the value of the video write area register 109. In FIG. 7, numeral 701 designates a video data/graphic on the third video memory 103, and numeral 702 a video data/graphic on the fourth video memory subjected to video projecting. Numeral 703 designates a video write area set anew in the video cut-out area register 112, and numeral 704 a window cut-out area set in the window cut-out area register 112, numeral 705 a window write area set in the window write area register 113, and numeral 706 a video data write area 703 visible in the window write area 705. Comparison between the part 402 in FIG. 4 and the part 702 in FIG. 7 shows that in the video-data processor according to the present invention, only the video data position may be changed while fixing the graphic position, simply by changing the value of the video write area register 109.

Figure 8:
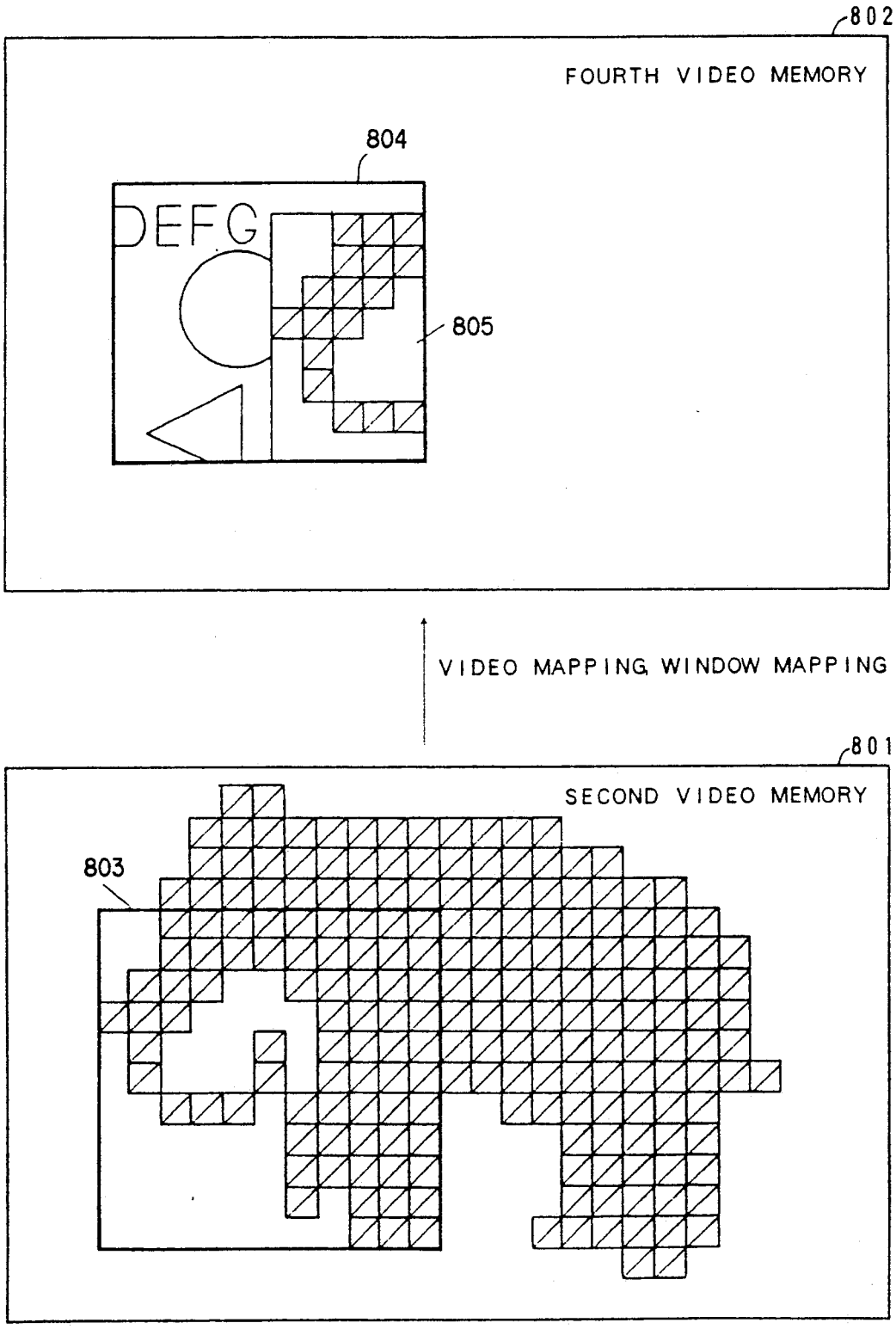
FIG. 8 is a diagram for explaining an example of the scroll only for the video data.

FIG. 8 shows the processing for realizing the scroll of the video data alone while fixing the position of the graphic/video data and the window position from the state shown in FIGS. 2, 3 and 4. In the video-data processor according to the present invention, the scroll of the video data may be realized simply by changing the value of the video cut-out area register 108. Numeral 801 in FIG. 8 designates a video data on the second video memory identical to the part 301, numeral 802 a video data/graphic on the fourth video memory subjected to video projecting and window projecting, numeral 803 a video cut-out area set anew in the video cut-out area register 108, numeral 804 a window write area set in the window write area register 113, and numeral 805 a video write area visible in the window write area. Comparison between the part 402 in FIG. 4 and the part 802 in FIG. 8 shows that in the video-data processor according to the present invention, the scroll only of the video data may be realized smoothly simply by changing the value of the video cut-out area register 108.

Figure 9:
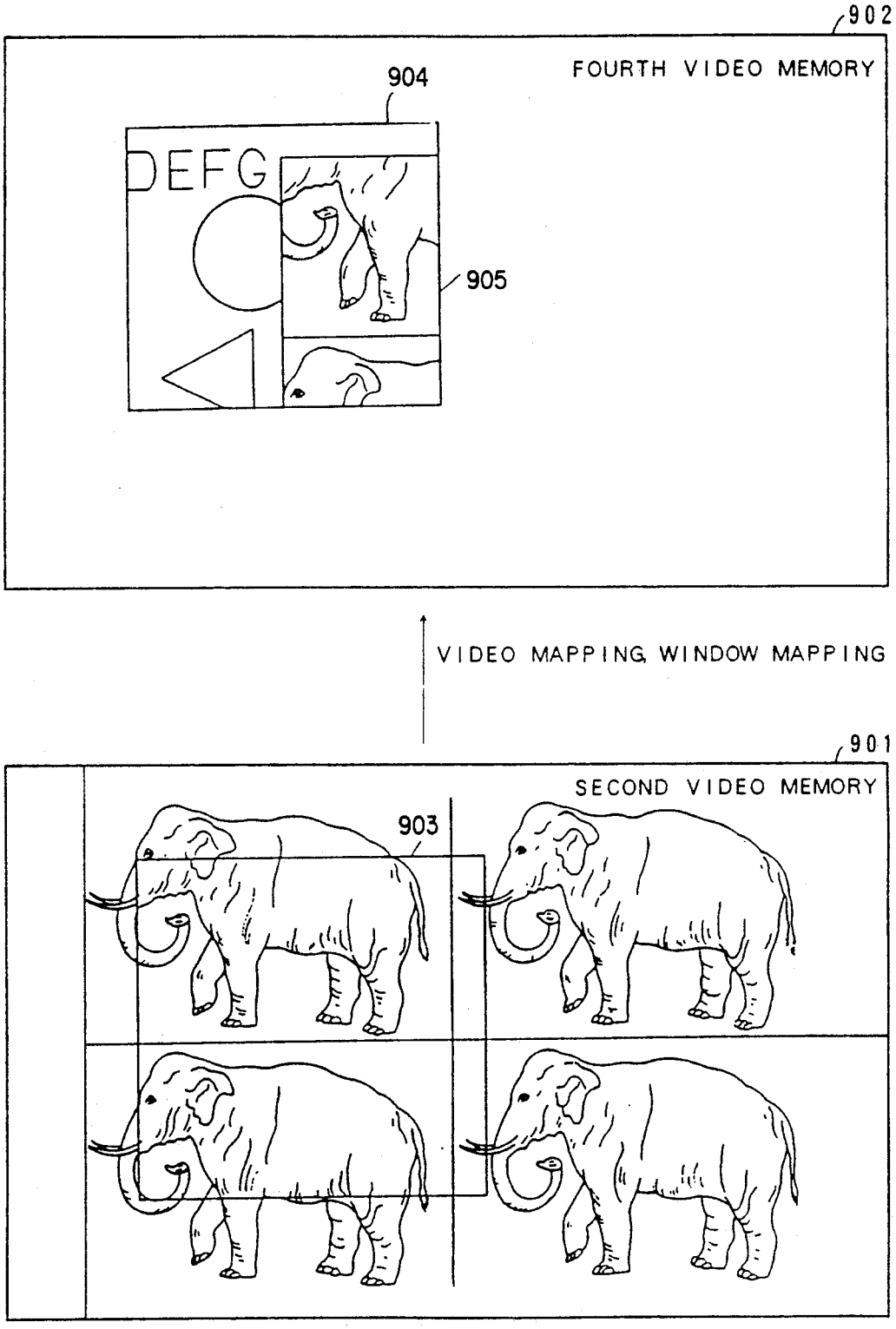
FIG. 9 is a diagram for explaining an example of changing only the special effect of the video data.

FIG. 9 shows the processing for changing the special effect exerted on the video data from the state shown in FIGS. 2, 3 and 4 while fixing window position and the graphic/video data. In the video data processor according to the present invention, the special effect of only the video data may be realized simply by changing the content of the special effect description memory 106. Numeral 901 in FIG. 9 designates a video data on the second video memory 102 subjected to multi-freezing by the special effect means as a result of change from mosaicking to multi-freezing in the contents of the special effect description memory, numeral 902 the video data/graphic on the fourth video memory 104 subjected to video projecting and window projecting, numeral 903 a video cut-out area set in the video cut-out area register 108, numeral 904 a window write area set in the window write area register 113, and numeral 905 a video write area visible in the window write area. Comparison between the part 402 in FIG. 4 and the part 902 in FIG. 9 shows that in the video-data processor according to the present invention, it is possible to realize only the special effect exerted on the video data smoothly simply by changing the contents of the special effect description memory.

Figure 10:
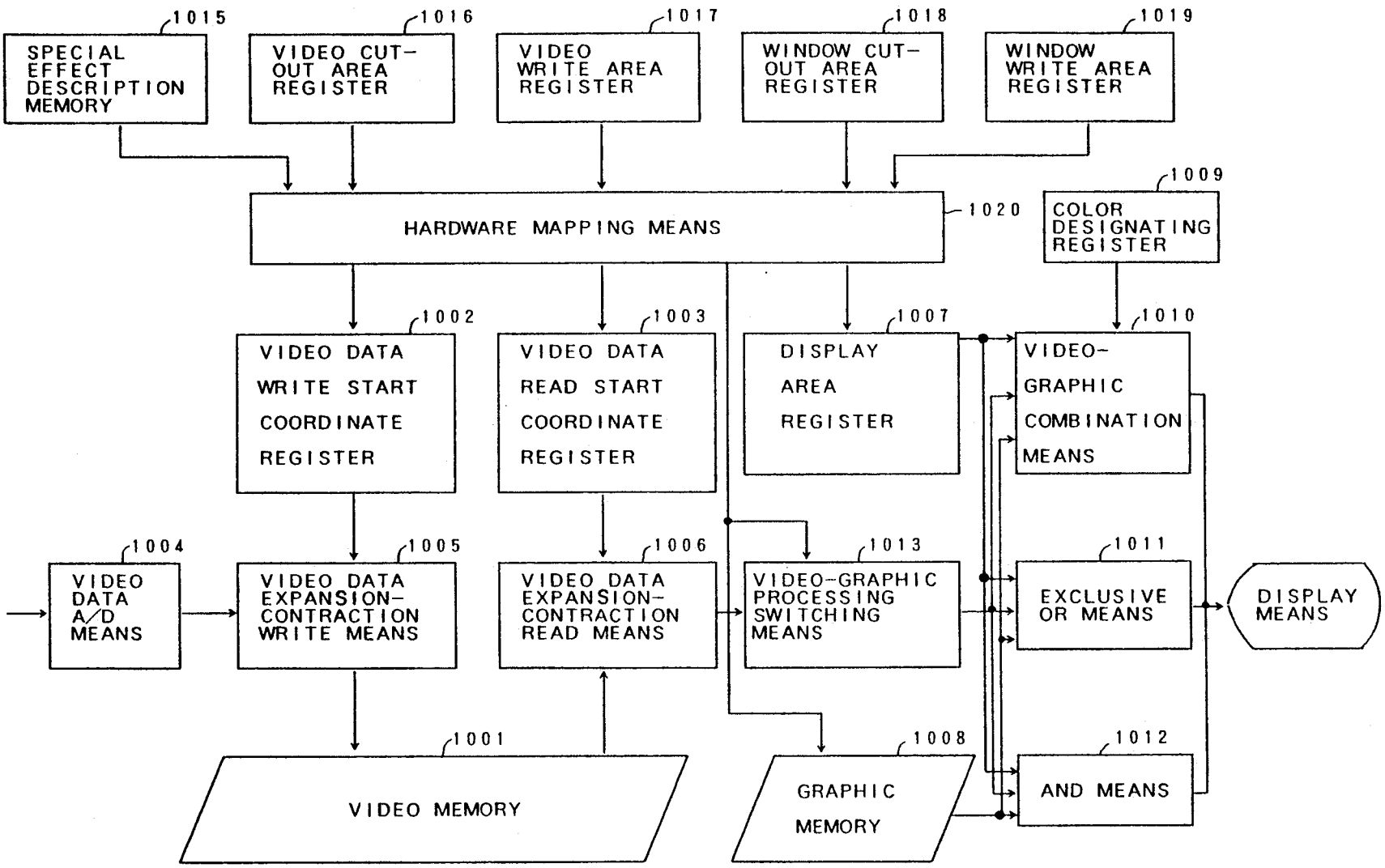
FIG. 10 is a block diagram showing a second embodiment of the video data processor according to the present invention.

A block diagram of a video-data processor according to a second embodiment of the present invention is shown in FIG. 10. In FIG. 10, numeral 1001 designates a video memory, numeral 1002 a video data write start coordinate register for holding a write start coordinate in the video memory 1001, numeral 1003 a video data read start coordinate register for holding a coordinate from which the video data starts being read from the video memory 1001, numeral 1004 video data A/D conversion means for A/D converting an analog video signal, numeral 1005 video data expansion/contraction write means for converting to an equimultiple, expanding or contracting the video data digitized by the video data A/D conversion means and writing into the video memory 1001 from the coordinate held in the video data write start coordinate register 1002, numeral 1006 video data expansion read means for reading the video data on the video memory 1001 from the coordinate held in the video data read start coordinate register 1003 and converting it to an equimultiple, numeral 1007 a display area register for holding the area for displaying the video data from the video data expansion read means, numeral 1008 a graphic memory for drawing a graphic, numeral 1009 a color-designating register for holding the value of a given color of the graphic, numeral 1010 video/graphic combination means for combing a video data and a graphic data by selecting a video data when the graphic on the graphic memory 1008 in the display area set in the display area register 1007 coincides with the content of the color-designating register 1009 and selecting the graphic otherwise, numeral 1011 exclusive OR means for producing the exclusive logic sum of the video data and the graphic on the graphic memory 1008 in the display area set in the display area register 1007, numeral 1013 video/graphic switching means for switching between the video/graphic combination means 1010, the exclusive OR means 1011 and the AND means 1012, numeral 1014 display means for D/A converting and displaying the output of any of the video/graphic combination means 1010, the exclusive OR means 1011 and the AND means 1012, numeral 1015 a special effect description memory similar to the one included in the first embodiment, numeral 1016 a video cut-out area register similar to the one used in the first embodiment, numeral 1018 a window cut-out area register similar to the one used in the first embodiment, numeral 1019 a window write area register similar to the one used in the first embodiment, and numeral 1020 hardware mapping means for determining the video data write start coordinate set in the video data write start coordinate register 1002, the video data read start coordinate set in the video data read start coordinate register 1003, the write expansion/contraction rate of the video data expansion/contraction write means 1005, the read expansion rate of the video data expansion read means 1006, the display area set in the display area register 1007, the video/graphic switching of the video/graphic switching means 1013 and the drawing of the graphic memory 1008 from the special effect description memory 1015, the video cut-out area register 1016, the video write area register 1017, the window cut-out area register 1018 and the window write area register 1019.

In the video-data processor according to the second embodiment of the present invention, there is not physically provided the first video memory, the second video memory, the third video memory or the fourth video memory unlike in the first embodiment, although the description of the video data processing based on the assumption of the presence of a four-stage video memory, including the special effect description and the description of the processing by the video cut-out area, video write area, window cut-out area and the window write area are available. The first, second, third and fourth video memories assumed in the second embodiment will be referred to as the assumed first, second, third and fourth memories respectively.

Figure 11:
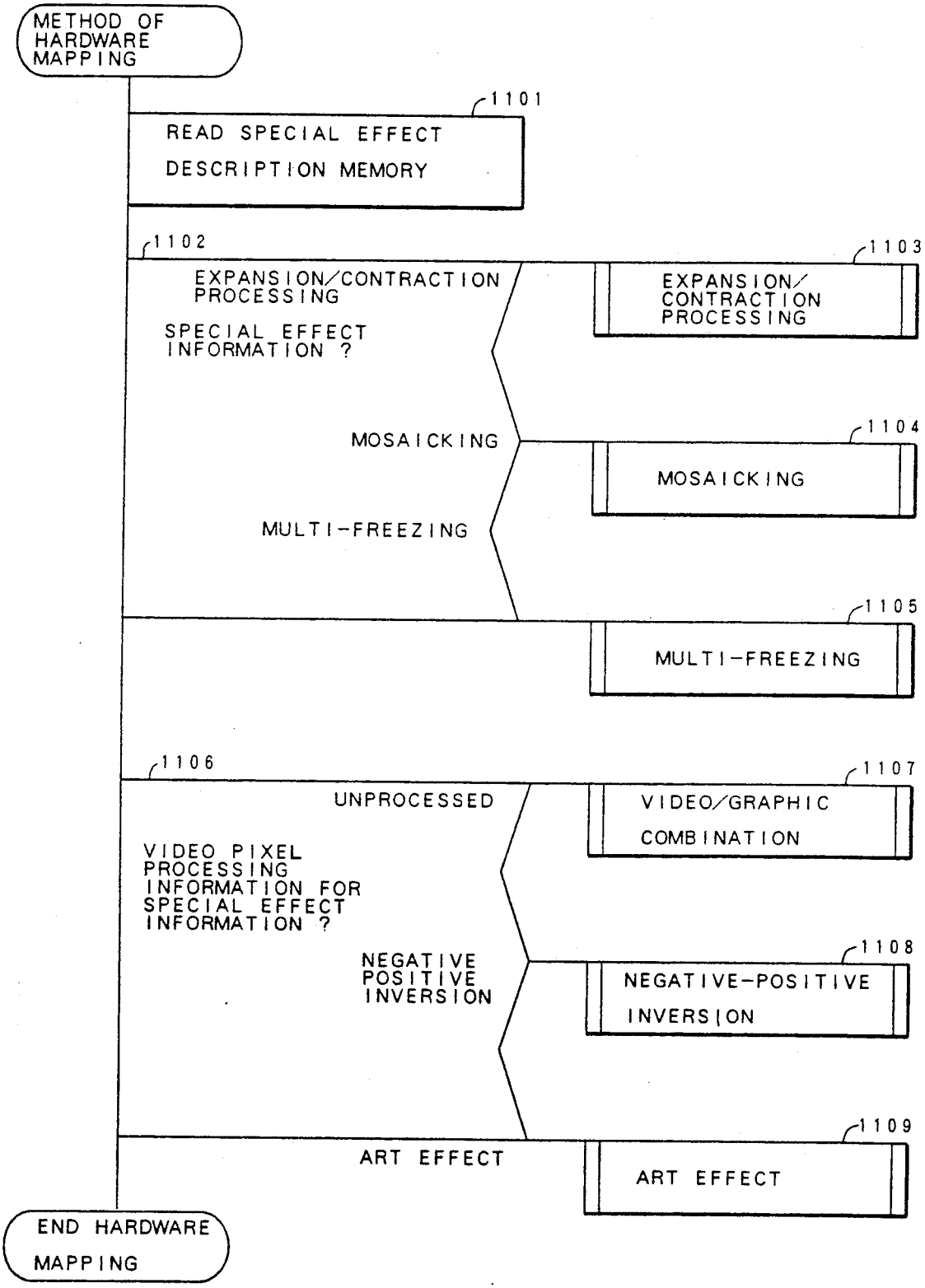
FIG. 11 is a PAD chart showing a main routine for the hardware mapping means in the second embodiment.

FIG. 11 is a PAD chart showing the main routine of hardware mapping of the hardware mapping means shown in the block diagram of the second embodiment. In FIG. 11, numeral 1101 designates means for reading the content of the special effect description memory 1015, and numeral 1102 means for executing the subroutine in accordance with a particular processing. Specifically, if the special effect information relates to the expansion/contraction processing, the expansion/contraction subroutine 1103 is executed, while if the special effect information is for mosaicking, the mosaicking processing subroutine 1104 is executed. So is the multi-freezing processing 1105, which is executed if the special effect information is multi-freezing. Numeral 1106 designates a subroutine executed for processing pixels of the video data of all the special effects. Specifically, the video/graphic combination subroutine is executed if the information on the video pixel processing is yet to be processed, the negative/positive inversion subroutine 1108 if the negative/positive inversion is involved, and the art effect subroutine 1109 is executed if the art effect is involved.

Figure 12:
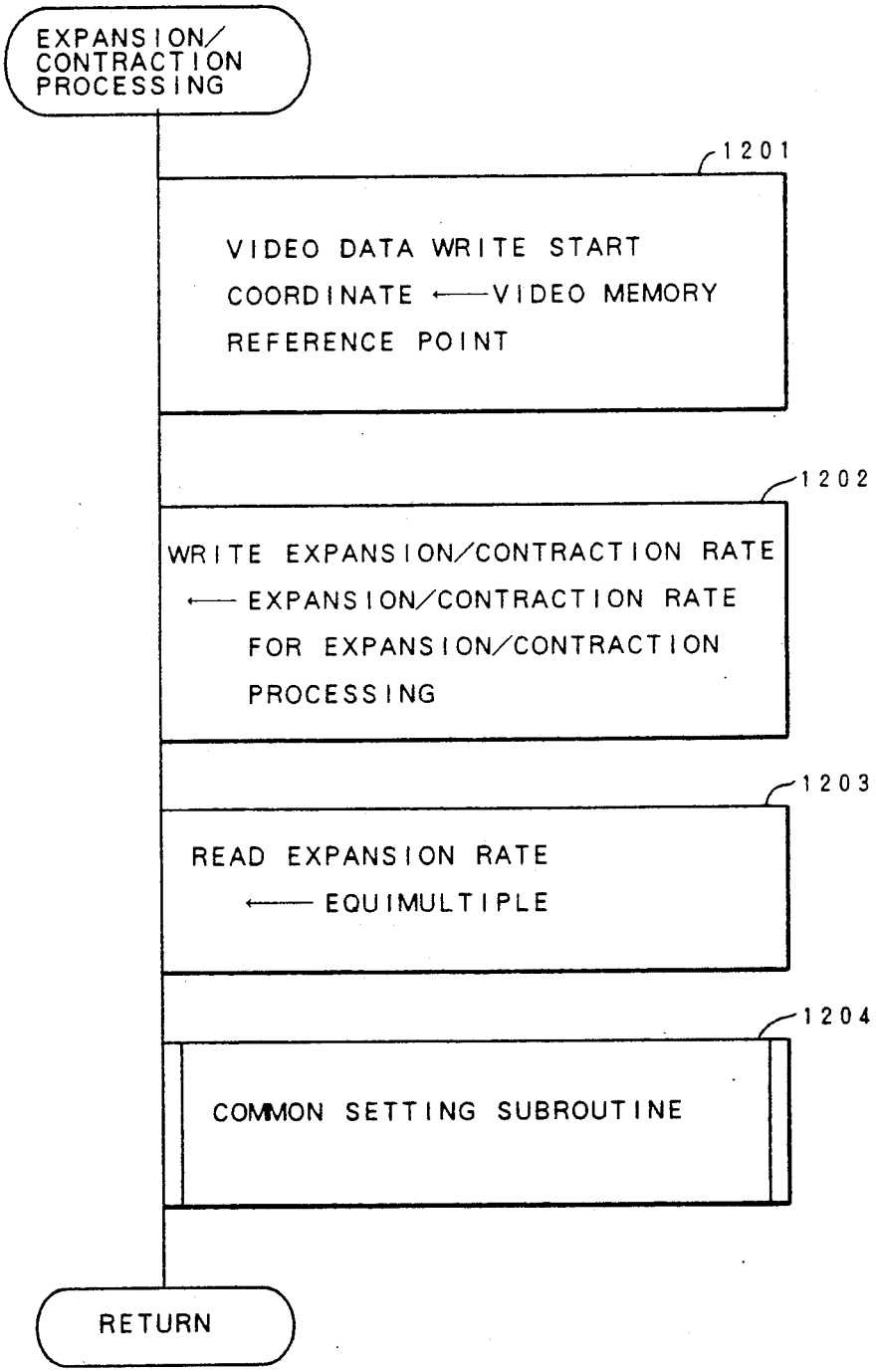
FIG. 12 is a PAD chart for an expansion/contraction subroutine.

FIG. 12 is a PAD chart for the expansion/contraction subroutine. In this expansion/contraction subroutine, numeral 1201 designates means for setting the video data write start coordinate at the reference point (0, 0) of the video memory 1001 in the video data write start coordinate register 1002. Numeral 1202 designates means for setting the write expansion/contraction rate of the video data expansion/contraction write means 1005 at the expansion/contraction rate of the special effect information. Numeral 1203 designates means for setting the read expansion rate of the video data expansion read means 1006 to an equimultiple. Step 1204 executes the common setting.

Figure 13:
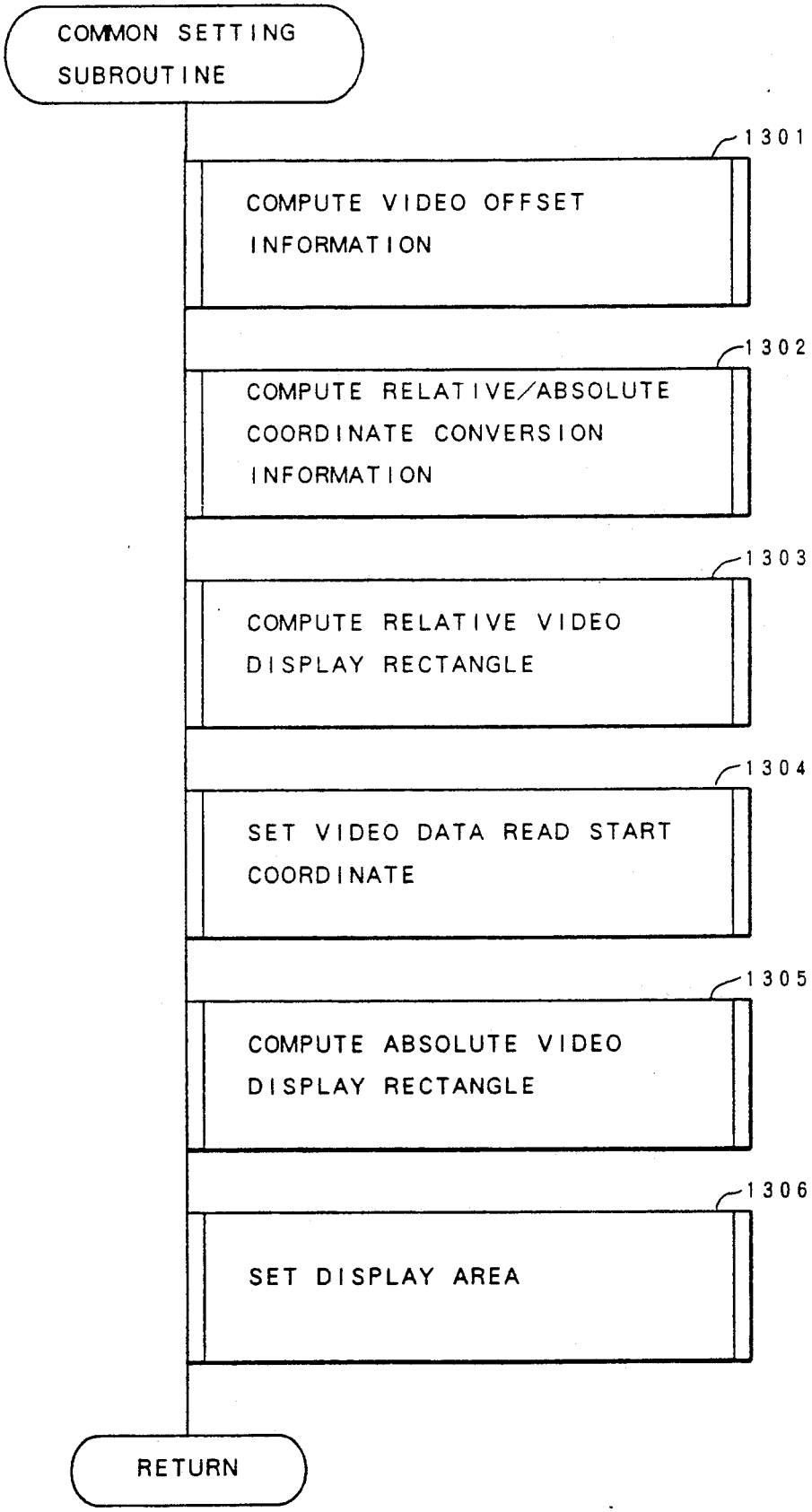
FIG. 13 is a PAD chart for a common setting subroutine.

FIG. 13 shows a PAD chart of a common setting subroutine. In this common setting subroutine, step 1301 computes the video offset information, step 1302 computes relative/absolute coordinate information, step 1303 computes a relative video display rectangle, and step 1304 computes a video data read start coordinate and sets the result into the video data read start coordinate register 1003. Step 1305 computes an absolute video display rectangle and, step 1306 sets a display area into the display area register 1007.

Figure 14:
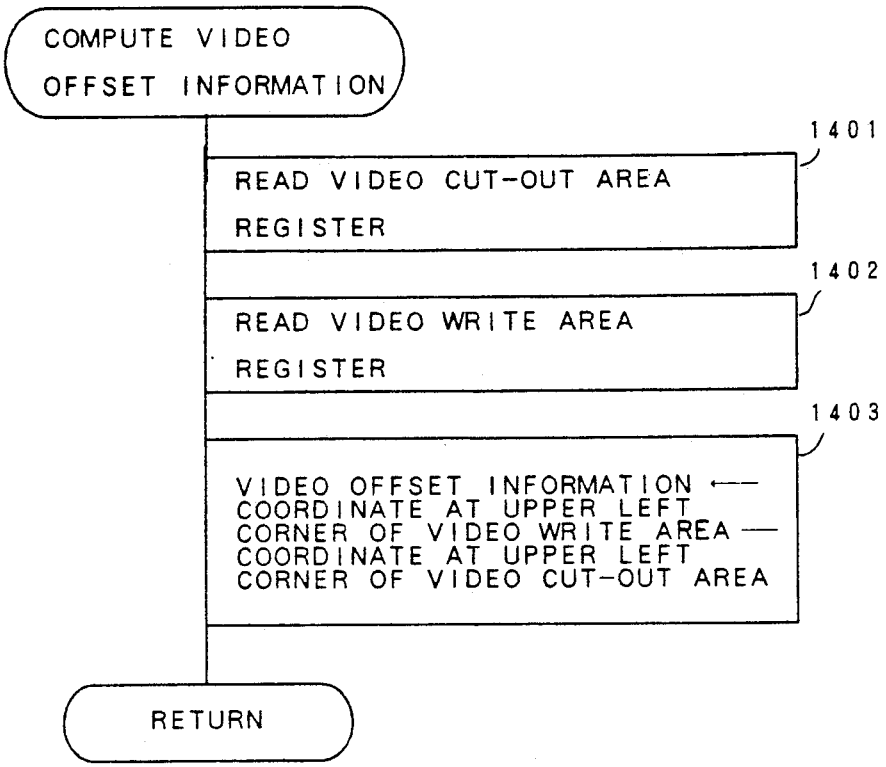
FIG. 14 is a PAD chart showing a subroutine for computing the video offset information.

FIG. 14 is a PAD chart showing a subroutine for computing the video offset information. In this video offset information computation routine, step 1401 reads the content of the video area cut-out register 1016, step 1402 reads the content of the video write area register 1017, and step 1403 produces the video offset information by subtracting the value of the coordinate at the upper left corner of the video cut-out area from that at the upper left corner of the video write area in each of horizontal and vertical directions.

Figure 15:
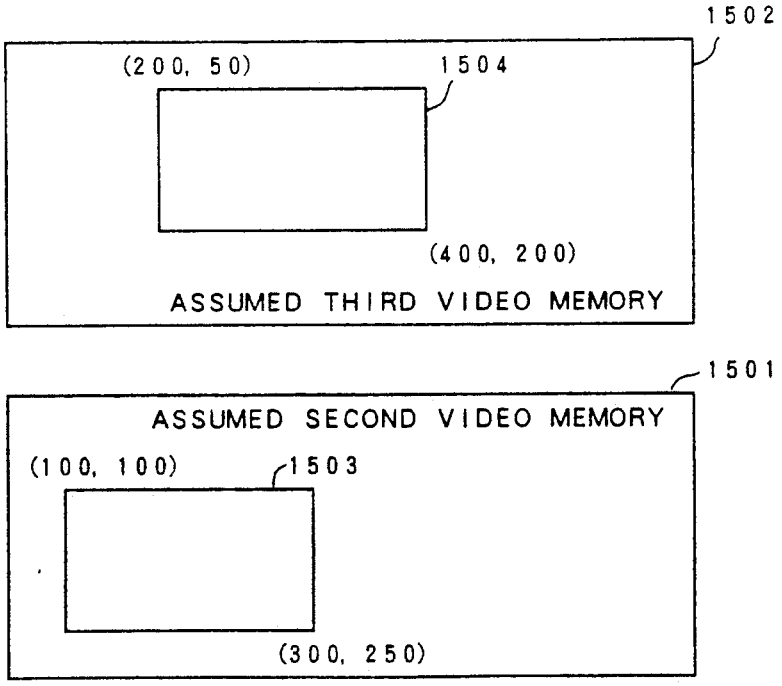
FIG. 15 is a diagram for explaining an example of computing the video offset information.

FIG. 15 is a diagram showing an example of computing the video offset information. In FIG. 15, numeral 1501 designates an assumed second video memory, numeral 1502 an assumed third video memory, numeral 1503 a rectangular area designated by (100, 100) to (300, 250) in the video cut-out area on the assumed second video memory set in the video cut-out area register 1016, and numeral 1504 a rectangular area designated by (200, 50) to (400, 200) of the video write area on the assumed third video memory set in the video write area register 1017. The video offset information is thus computed to be 100 (=200−100) in horizontal direction and −50 (=50−100) in vertical direction.

Figure 16:
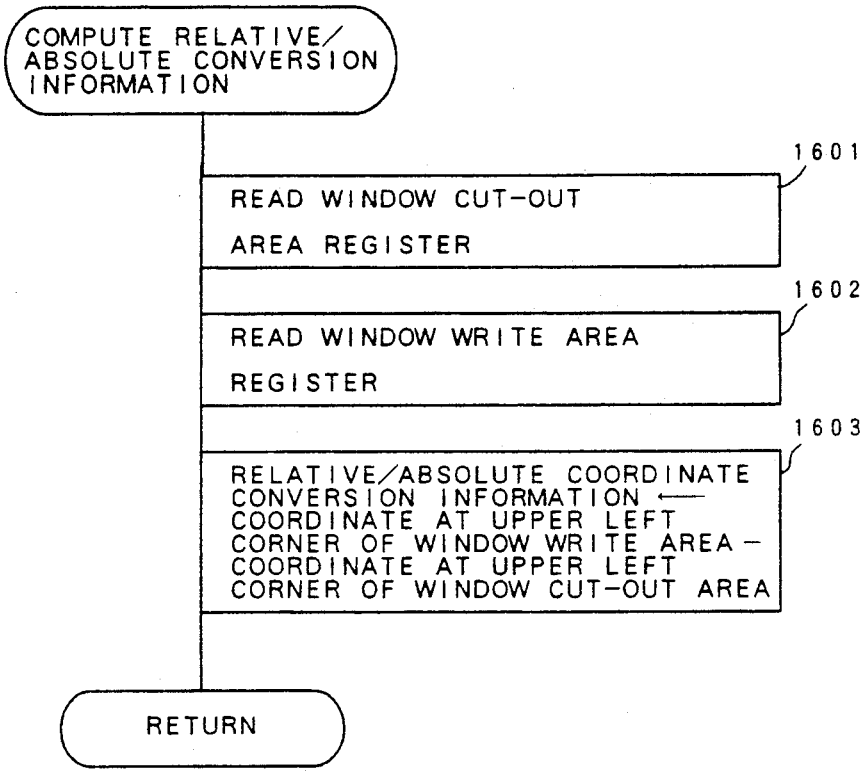
FIG. 16 is a PAD chart of a subroutine for computing the relative/absolute coordinate conversion information.

FIG. 16 is a PAD chart of the subroutine for computing the relative/absolute coordinate conversion information. In this subroutine for computing the relative-/absolute coordinate conversion information, step 1601 reads the content of the window cut-out area register 1019, step 1602 reads the content of the window write area register 1019, and step 1603 produces relative/absolute coordinate conversion information by subtracting the value of the coordinate at the upper left corner of the window cut-out area in each of horizontal and vertical directions from that at the upper left corner of the window write area.

Figure 17:
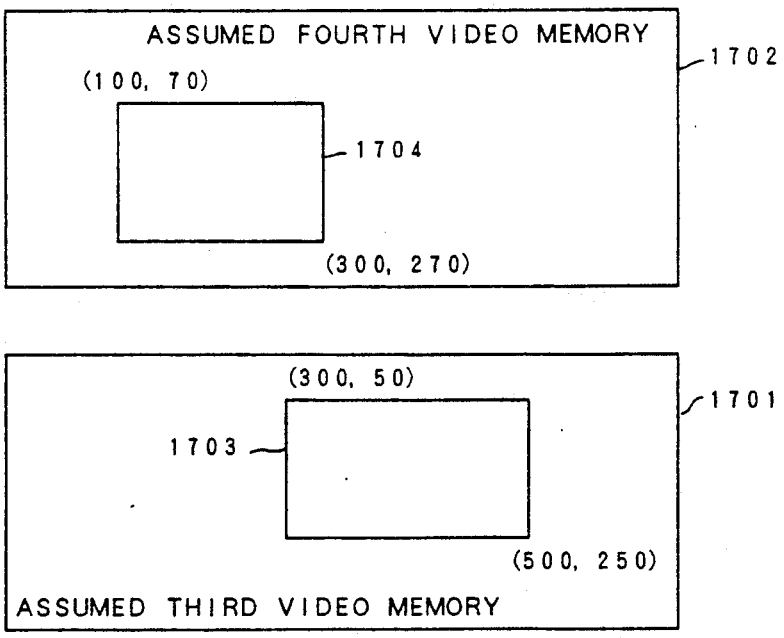
FIG. 17 is a diagram for explaining an example of computing the relative/absolute coordinate conversion information.

FIG. 17 shows an example of computing the relative-/absolute coordinate conversion information. In FIG. 17, numeral 1701 designates an assumed third video memory, numeral 1702 an assumed fourth video memory, numeral 1703 a rectangular area (300, 50) to (500, 250) of the window cut-out area on the assumed third video memory set in the window cut-out area register 1018, and numeral 1704 a rectangular area (100, 70) to (300, 270) of the window write area on the assumed fourth video memory set in the window write area register 1019. The relative/absolute coordinate conversion information is thus computed to be −200 (=100−300) in horizontal direction and 20 (=70−50) in vertical direction.

Figure 18:
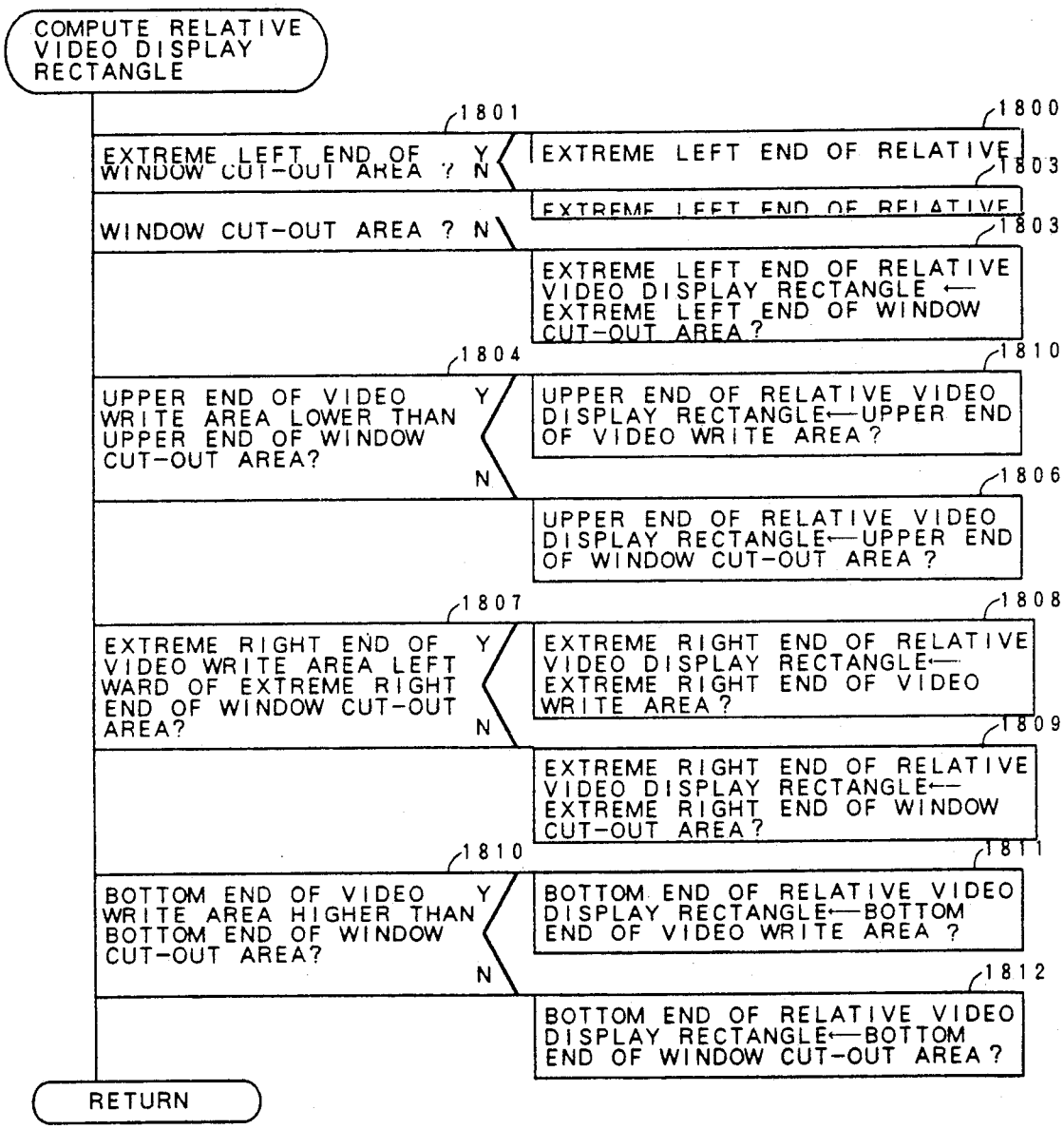
FIG. 18 is a PAD chart of a subroutine for computing a relative video display rectangle.

FIG. 18 is a PAD chart for computing the relative video display rectangle. The relative video display rectangle is a maximum rectangle and is contained in both the video write area and the window cut-out area on the assumed third video memory. Step 1801 computes the coordinate at the top, step 1807 the coordinate at extreme right end, and step 1801 the coordinate of the bottom end.

Figure 19:
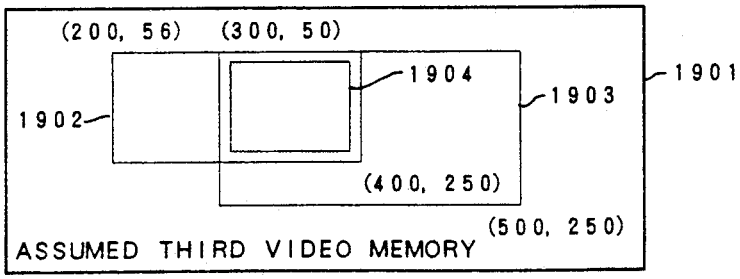
FIG. 19 is diagram for explaining an example of computing a relative video display rectangle.

FIG. 19 shows an example of computing the relative video display rectangle. In FIG. 19, numeral 1901 designates an assumed third video memory, numeral 1902 a rectangular area (200, 50) to (400, 250) of the video write area set in the video write area register 1017, and numeral 1903 a rectangular area (300, 50) to (500, 250) of the window cut-out area set in the window cut-out area register 1018. The relative video display rectangle thus constitutes a rectangular area 1904 designated by (300, 50) to (400, 250).

Figure 20:
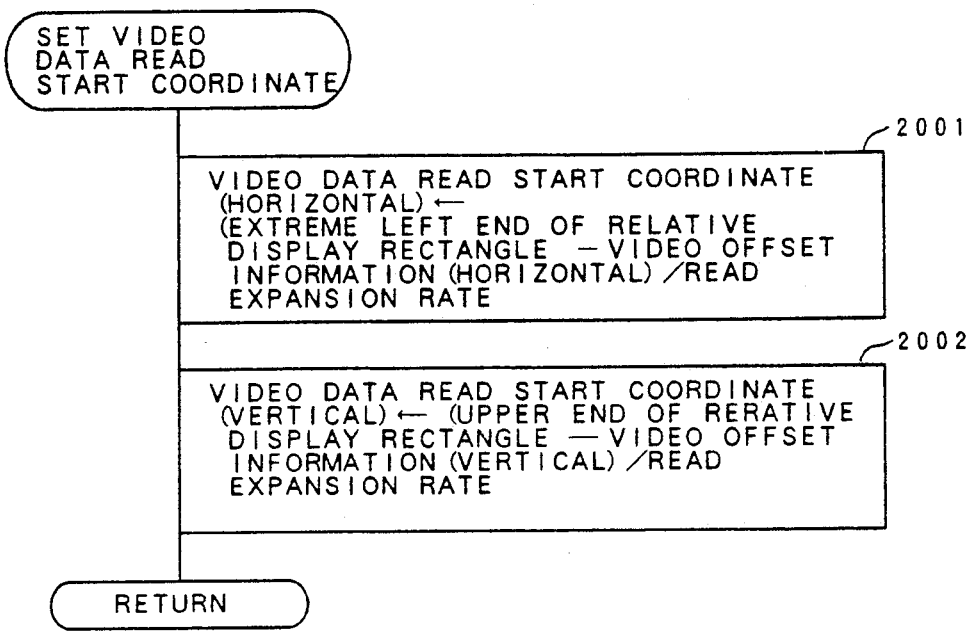
FIG. 20 is a PAD chart of a subroutine for setting a video data read start coordinate.

FIG. 20 is a PAD chart of a subroutine for setting the video read start coordinate. Step 2001 determines the value in horizontal direction of the video data read start coordinate, and step 2002 the value in vertical direction of the video data read start coordinate.

Figure 21:
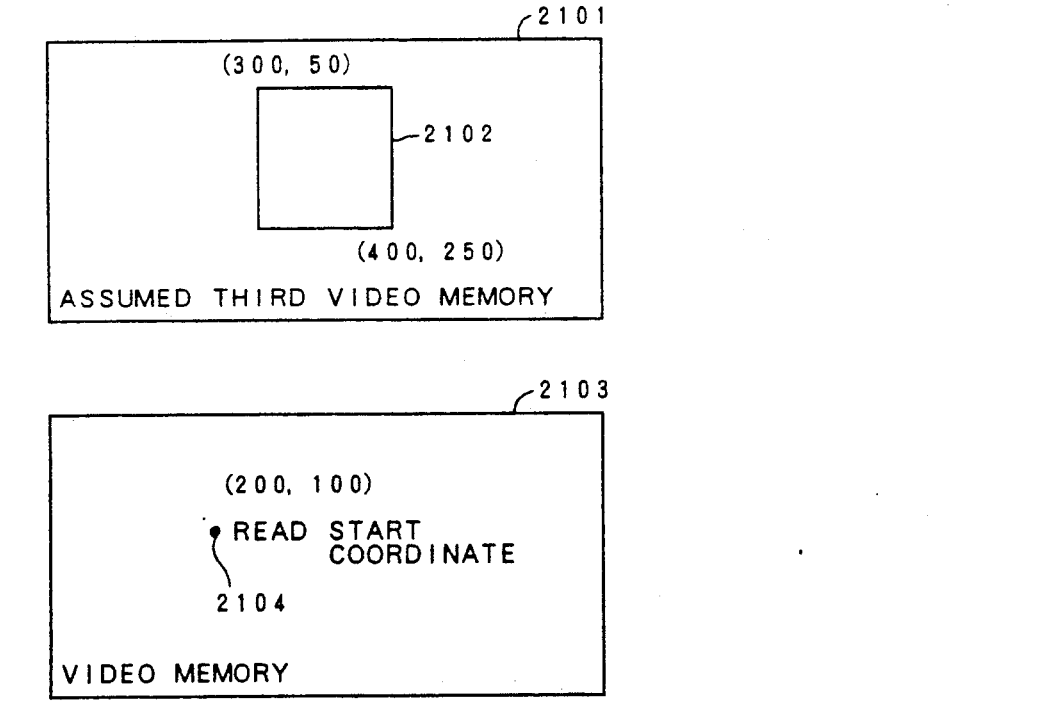
FIG. 21 is a diagram for explaining an example of setting a video data read start coordinate.

An example of setting a video data read start coordinate is shown in FIG. 21. Numeral 2101 designates an assumed third video memory, and numeral 2102 a rectangular area (300, 50) to (400, 250) of the relative video display rectangle determined in FIG. 19. The read expansion rate is set to an equimultiple in the expansion/-contraction subroutine 1203. The video offset information determined in FIG. 15 is 200 in horizontal direction and −50 in vertical direction. The result is that the video data read start coordinate is 200 (= (300−100)/1) in horizontal direction and 100 (=(50−(−50))/1) in vertical direction. The coordinate defined as (200, 100) is thus set in the video data start coordinate register 1002. In FIG. 21, numeral 2103 designates a video memory 1001, and numeral 2104 a set video data read start coordinate.

Figure 22:
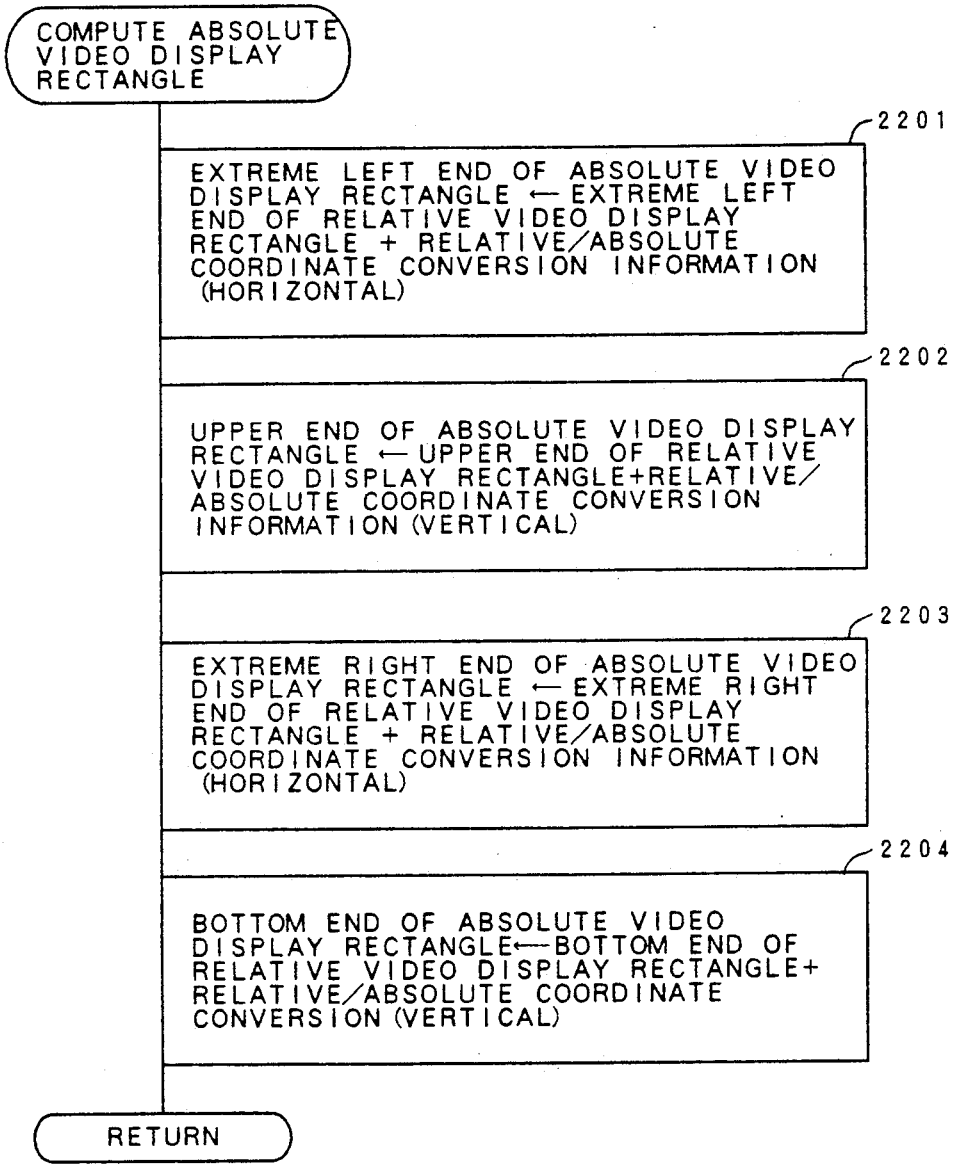
FIG. 22 is a diagram for explaining an example of the PAD chart of a subroutine for computing an absolute video display rectangle.
Figure 23:
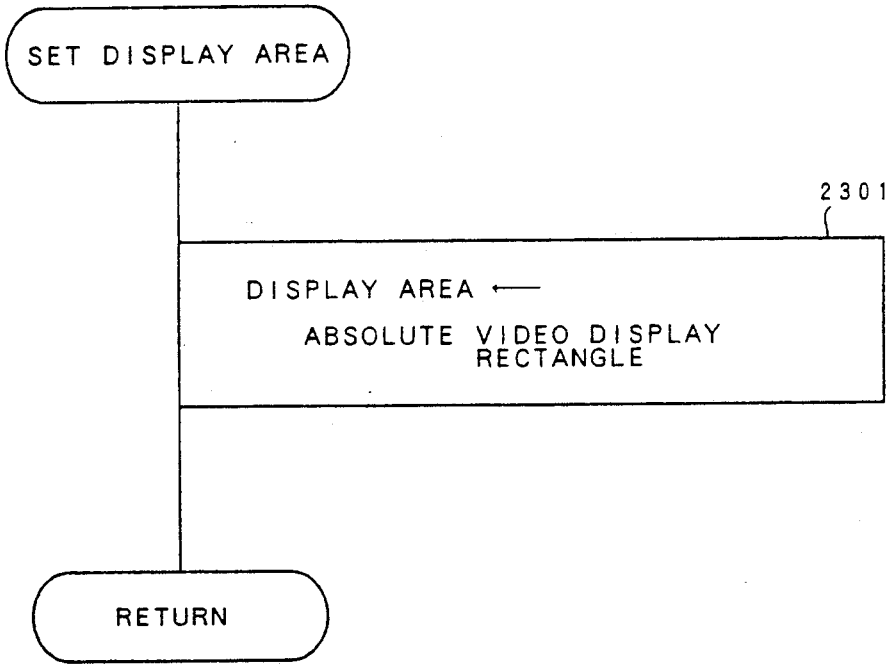
FIG. 23 is a diagram for explaining an example of a subroutine for setting a display area.

FIG. 22 shows a PAD chart and an example of computation in the subroutine for computing the absolute video display rectangle. In FIG. 22, step 2201 computes the coordinate at the extreme left end, step 2202 that of the top end, step 2203 that of extreme right end and step 2204 that of the bottom end of an absolute video display rectangle. The relative video display rectangle determined in FIG. 19 is represented by (300, 50) to (400, 250) and the relative/absolute coordinate conversion information determined in FIG. 17 is −200 in horizontal direction and 20 in vertical direction, and therefore the computed absolute video display rectangle constitutes a rectangular area given by (100, 70) to (200, 270).

Figure 24:
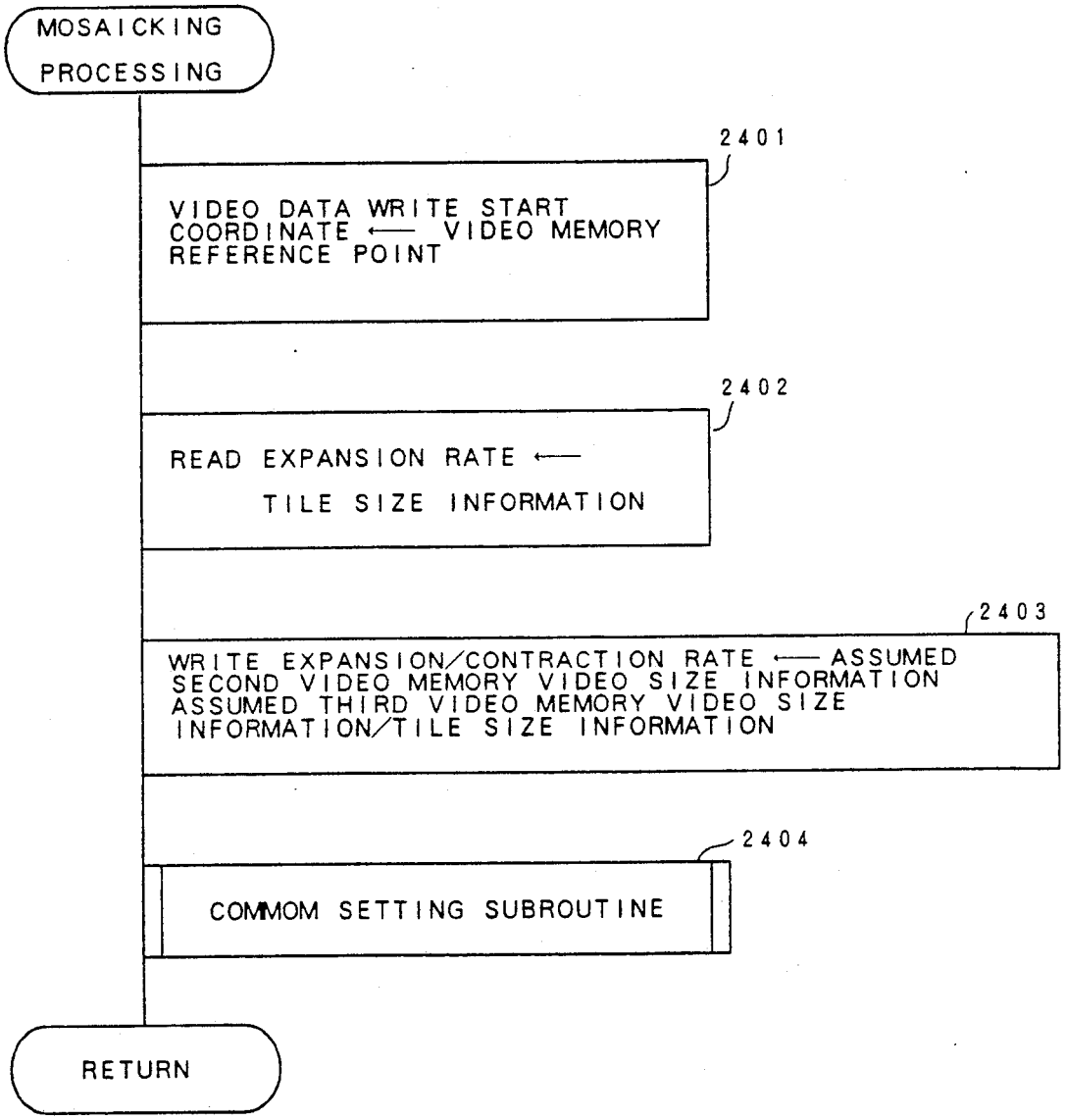
FIG. 24 is a PAD chart of a mosaicking subroutine.

FIG. 24 shows a PAD chart and an example of computation for the mosaicking subroutine. In FIG. 24, step 2401 sets the video data write start coordinate at the reference point (0, 0) of the video memory. Step 2402 sets, as a read expansion rate, the tile size information making up the mosaic unit in the special effect information in the special effect description memory. Step 2403 sets a write expansion/contraction rate as a value obtained in such a manner that the video data representing the assumed second video memory video size information providing the size of the video data on the assumed second video memory after mosaicking contained in the special effect information in the special effect description memory is divided by the assumed first video memory video size information representing the size of the unprocessed video data at the time of sampling, and the result of division is further divided by the tile size information, the quotient being set as a write expansion/contraction rate. Assume, for example, that the assumed first video memory video size information is 640 in horizontal direction and 480 in vertical direction, the assumed second video memory video size information 320 in horizontal direction and 240 in vertical direction, and that the mosaicking processing with the tile size of 4 in horizontal direction and 4 in vertical direction is designated in the special effect description memory. Then the read expansion rate is set to a quadruple from four in the tile size information and the write expansion rate to one eighth from $640/320/4=\frac{1}{8}$. Upon completion of these settings, the common setting subroutine 2404 is executed. This is identical to the corresponding subroutine shown in FIG. 13.

Figure 25:
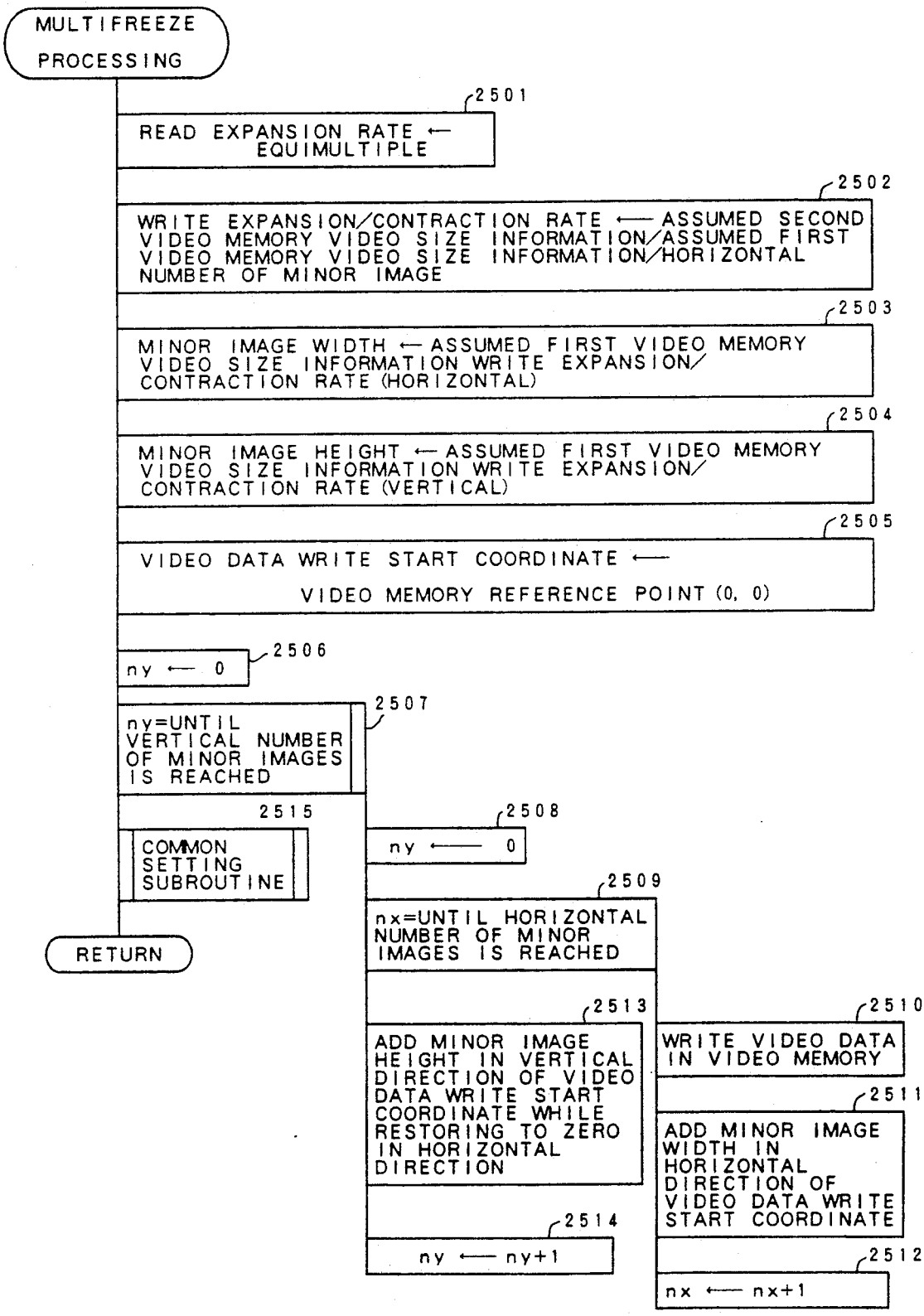
FIG. 25 is a PAD chart of a multi-freezing subroutine.

FIG. 25 is a PAD chart for a multi-freeze subroutine. In FIG. 25, step 2501 sets the read expansion rate to an equimultiple. Step 2502 sets, as an expansion/contraction rate, the value obtained by dividing the assumed second video memory video size information by the assumed first video memory video size information and further dividing the result by the number of minor images in horizontal direction. Step 2503 produces the width of the minor image constituting the multi-freeze unit by multiplying the assumed first video memory video size information by the write expansion/contraction rate determined at step 2503. Step 2504 determines the height of the minor image in similar fashion. Step 2505 sets the video data write start coordinate first at the reference point (0,0) of the video memory, followed by step 2506 for proceeding to draw the video data in the video memory 1001 while relocating the video data write start coordinate. Step 2506 initializes the variable ny to zero for counting the vertical number of minor images, and steps including and subsequent to 2507 repeat the process until the value reaches the number of minor images in vertical direction. Step 2508 initializes to zero the variable nx for counting the number of minor images in horizontal direction, followed by step 2509 and subsequent steps for repeating the process until the value ny reaches the number of minor images in horizontal direction. Step 2510 draws a screen in the video memory 1001 from the set video data write start coordinate. Step 2511 moves the video data write start coordinate by the width of the minor image in horizontal direction, followed by step 2515 for incrementing the variable nx by one. Step 2513 moves the video data write start coordinate by the height of the minor image in vertical direction, followed by step 2514 for incrementing the variable ny by one. After repeating this process, the common setting subroutine 2515 is executed. This subroutine is identical to the corresponding one in FIG. 13.

Figure 26:
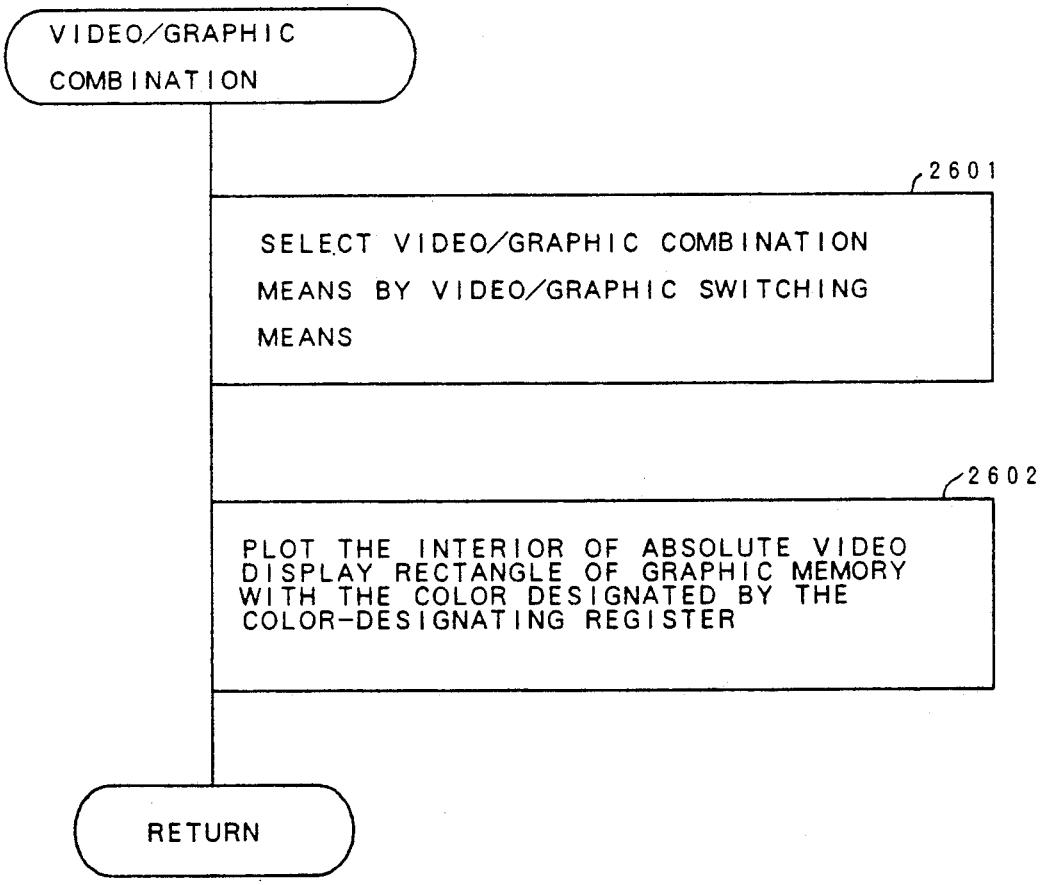
FIG. 26 is a PAD chart of a subroutine for video/graphic combination.

FIG. 26 is a PAD chart for a subroutine for video/graphic combination. Step 2601 selects the video/graphic combination means at the video/graphic switching means 1013, and step 2602 draws the interior of the absolute video display rectangle of the graphic memory by the color designated in the color-designating register 1009. The color of the pixels of the video data in the video data memory 1001 is thus produced without being changed.

Figure 27:
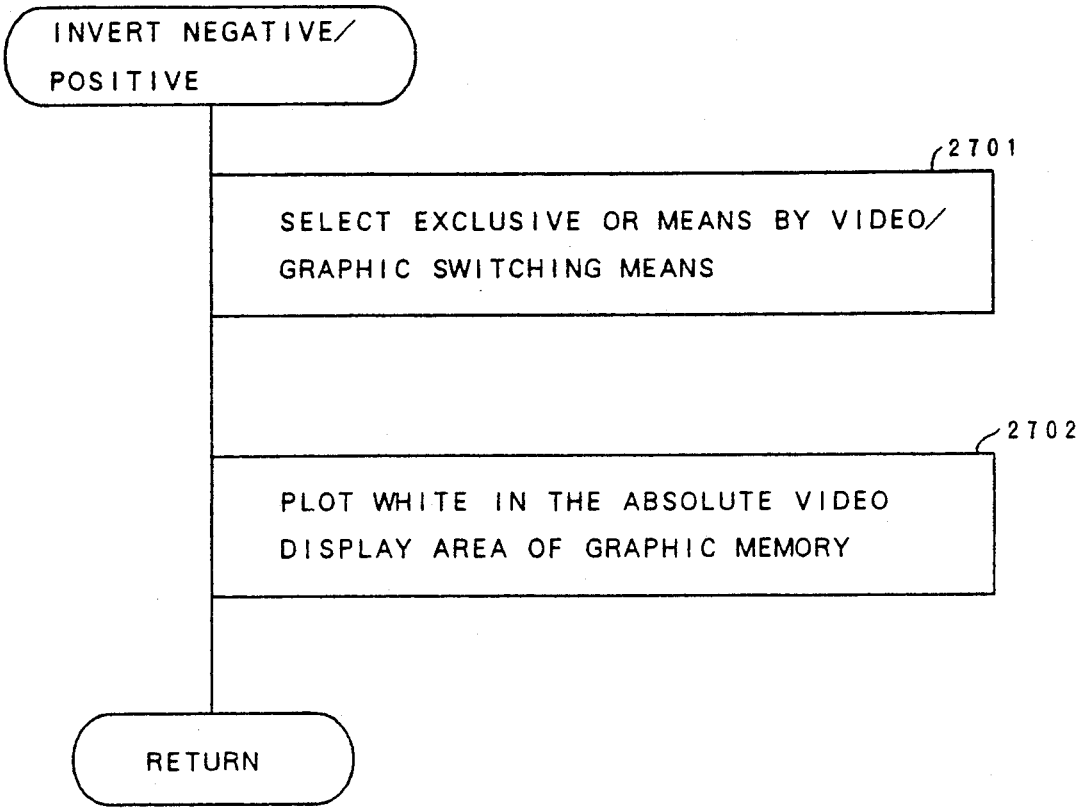
FIG. 27 is a PAD chart of a subroutine for reverse color.

FIG. 27 is a PAD chart for a negative/positive inversion subroutine. Step 2701 selects the exclusive OR means 1011 at the video/graphic switching means 1013, and step 2702 draws the interior of the absolute video display rectangle of the graphic memory with white color. The color of the pixels of the video data in the video data memory 1001 is thus produced by being inverted in negative/positive states.

Figure 28:
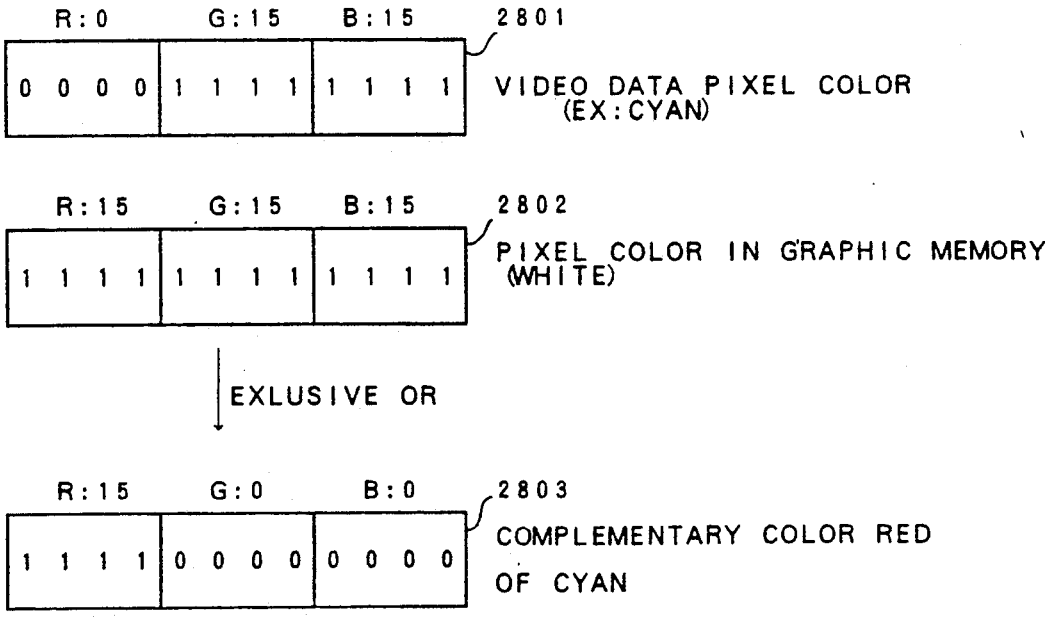
FIG. 28 is a diagram for explaining an example showing the principle of reverse color.

The principle of negative/positive inversion is shown in FIG. 28. Numeral 2801 is assumed to designate the color of cyan of the pixels of the video data. Numeral 2802 designates the color of the graphic pixels which is white as the result of step 2702. The exclusive logic sum of these two elements is shown at 2803 representing the red color which is the complimentary color of cyan.

Figure 29:
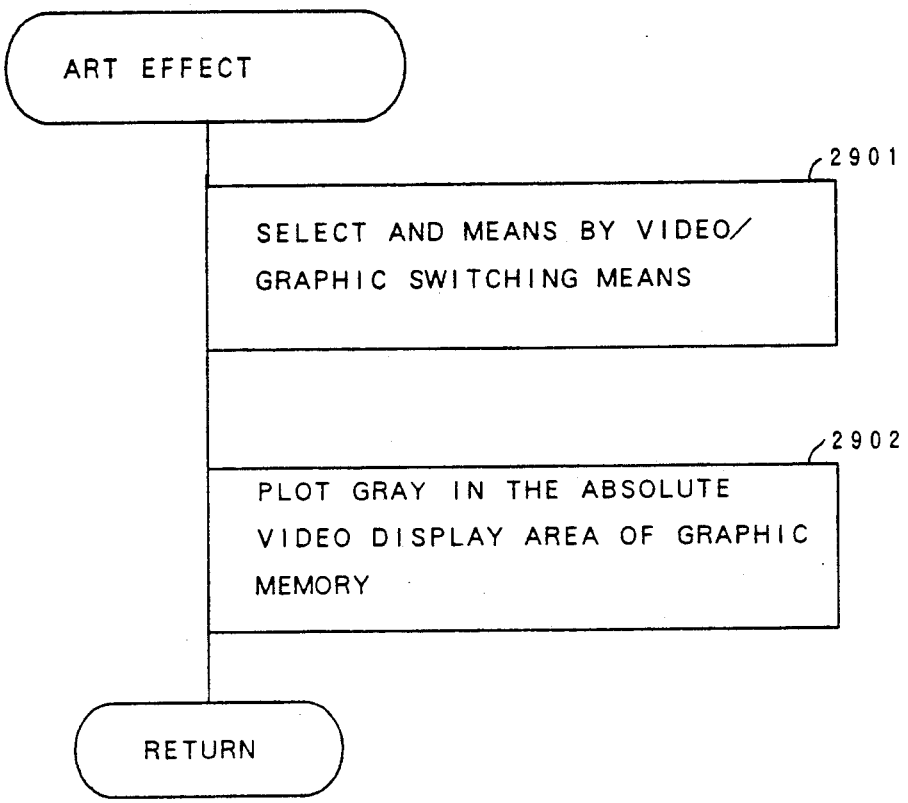
FIG. 29 is a PAD chart of an art effect subroutine.

FIG. 29 is a PAD chart for an art effect subroutine. Step 2901 selects the AND means 1012 at the video/graphic switching means 1013, and step 2902 draws the interior of the absolute video display rectangle of the graphic memory with gray. The color of pixels of the video data in the video memory 1001 is thus produced under the art effect.

Figure 30:
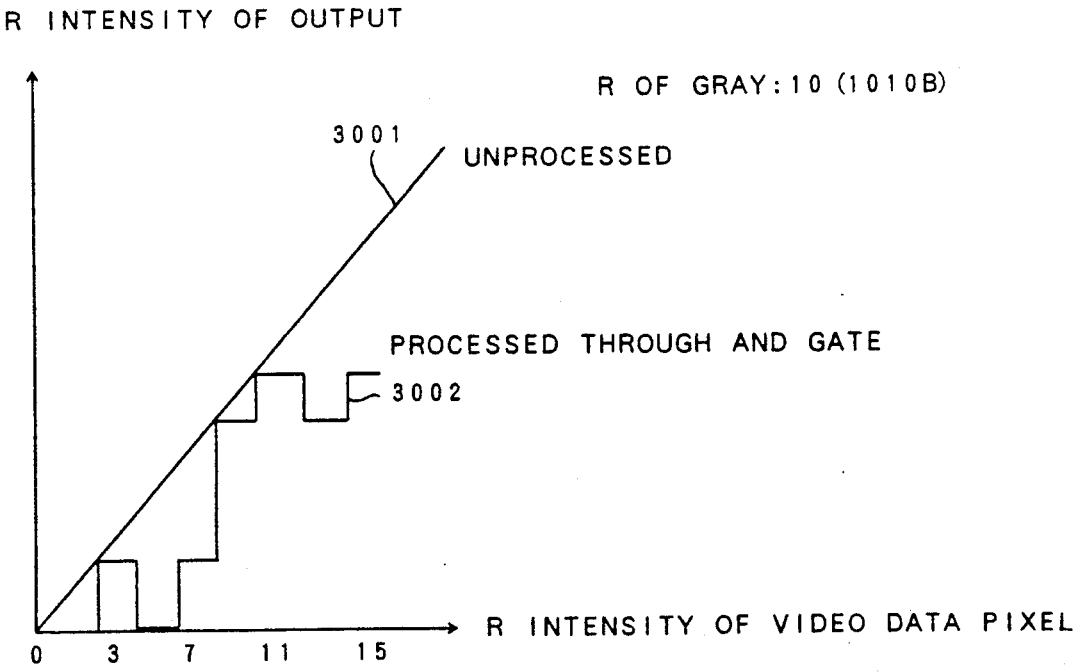
FIG. 30 is a diagram showing an example of the principle of the art effect.

FIG. 30 shows the principle of the art effect. The graph shown in FIG. 30 represents the intensity of the R component of the pixels of the video data along the abscissa and the intensity of the R component after the appropriate processing along the ordinate. Curve 3001 represents an unprocessed case indicating a linear characteristic with the gradation reproduced directly. Curve 3002, on the other hand, represents the case in which a logic sum with gray is obtained, indicating large two stages except for small fluctuations. In other words, an output is capable of being produced with a reduced ability to reproduce the gradation in response to an input, and therefore the same art effect is obtainable as if drawn with paint or the like.

Figure 31:
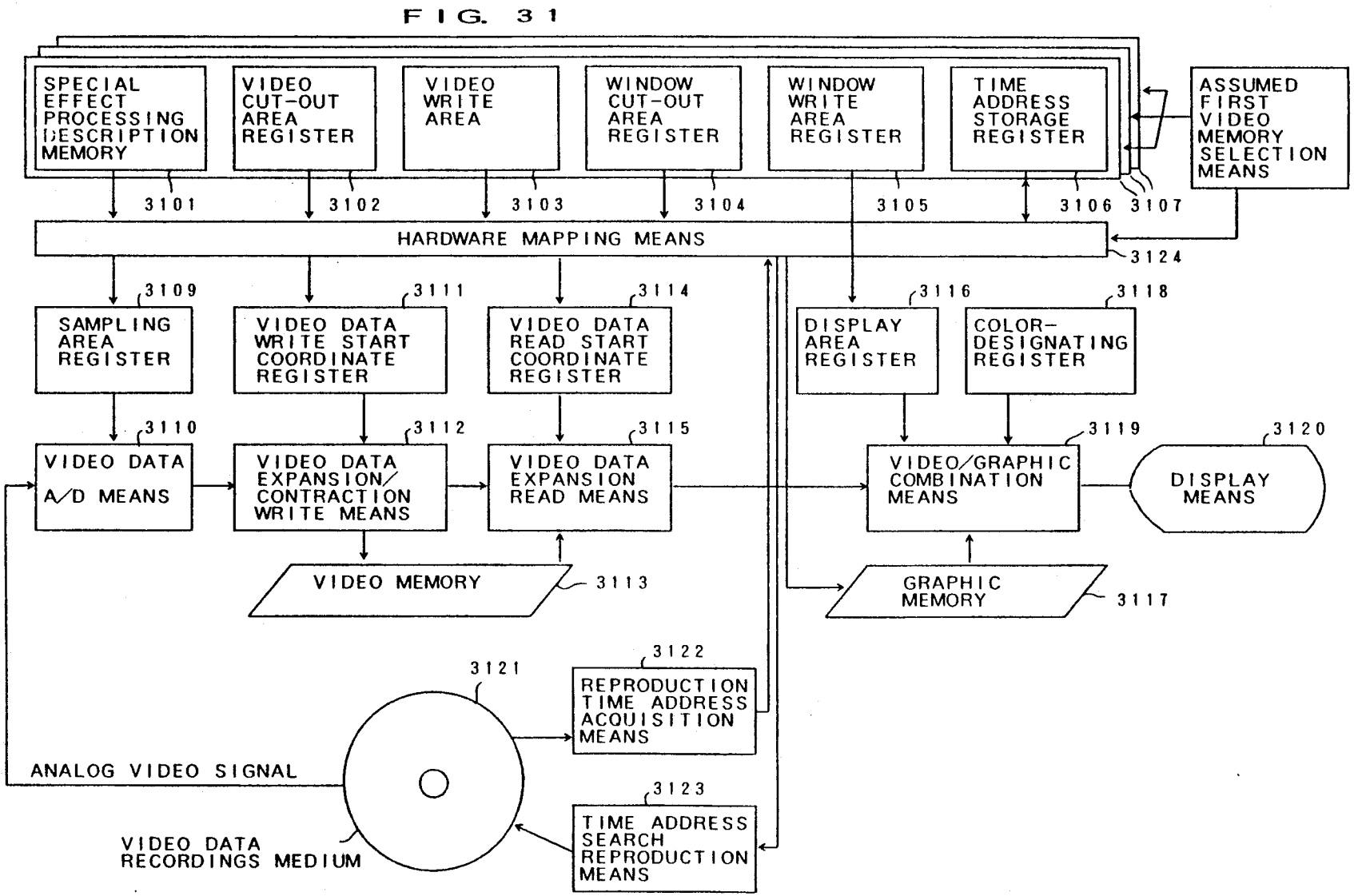
FIG. 31 is a block diagram showing a third embodiment of the video-data processor according to the present invention.

FIG. 31 shows an embodiment of the third video-data processor according to the present invention. Numeral 3101 designates a special effect description memory associated with a given assumed first video memory, numeral 3102 a video cut-out area register associated with the same assumed first video memory, numeral 3103 a video write area register associated with the same assumed video memory, numeral 3104 a window cut-out area register associated with the same assumed first video memory, numeral 3105 a window write area register associated with the same assumed first video memory, numeral 3106 a time address storage register associated with the same assumed first video memory, and numeral 3107 the assumed first video memory which numbers at least one. Numeral 3108 designates assumed first video memory selection means for selecting one of the assumed first video memories, numeral 3109 a sampling area register for holding an area sampled in the analog video signal, numeral 3110 video data-limiting A/D conversion means for A/D converting the analog video signal in accordance with the sampling area register 3109, numeral 3111 a video data write start coordinate register identical to the part 1002 in the second embodiment, numeral 3112 video data expansion/contraction write means identical to the part 1005 in the second embodiment, numeral 3113 a video memory identical to the part 1001 in the second embodiment, numeral 3114 a video data read start coordinate register identical to the part 1003 in the second embodiment, numeral 3115 video data expansion read means identical to the part 1006 in the second embodiment, numeral 3116 a display area register identical to the part 1007 in the second embodiment, numeral 3117 a graphic memory identical to the part 1008 in the second embodiment, numeral 3118 a color-designating register identical to the part 1009 in the second embodiment, numeral 3119 video/graphic combination means identical to the part 1010 in the second embodiment, and numeral 3120 display means identical to the part 1014 in the second embodiment. Numeral 3121 designates a video data recording medium having time address information recorded in parallel therein, numeral 3122 reproduction time address retrieval means for retrieving the time address information corresponding to the screen in the video data recording medium 3121 reproduced, and numeral 3123 time address search and reproduction means for searching for and reproducing a screen in the video data recording medium having a given time address information. Numeral 3124 designates hardware mapping means for computing the sampling area in the sampling area register 3109, the video data write start coordinate in the video data write start coordinate register 3111, the write expansion rate in the video data expansion/contraction write means 3112, the video data read start coordinate in the video data read start coordinate register 3114, the read expansion rate in the video data expansion read means 3115, the display area in the display area register 3116, the control of the time address search and reproduction means 3123 and the time information in the time address storage register 3106, on the basis of the selection information of the assumed first video memory selection means 3108, the special effect information in the special effect description memory corresponding to the assumed first video memory selected, the video cut-out area in the video cut-out area register, the video write area in the video write area register, the window cut-out area in the window cut-out area register, the window write area in the window write area register, the time address information in the time address storage register, and the reproduction time address retrieval means 3122.

Figure 32:
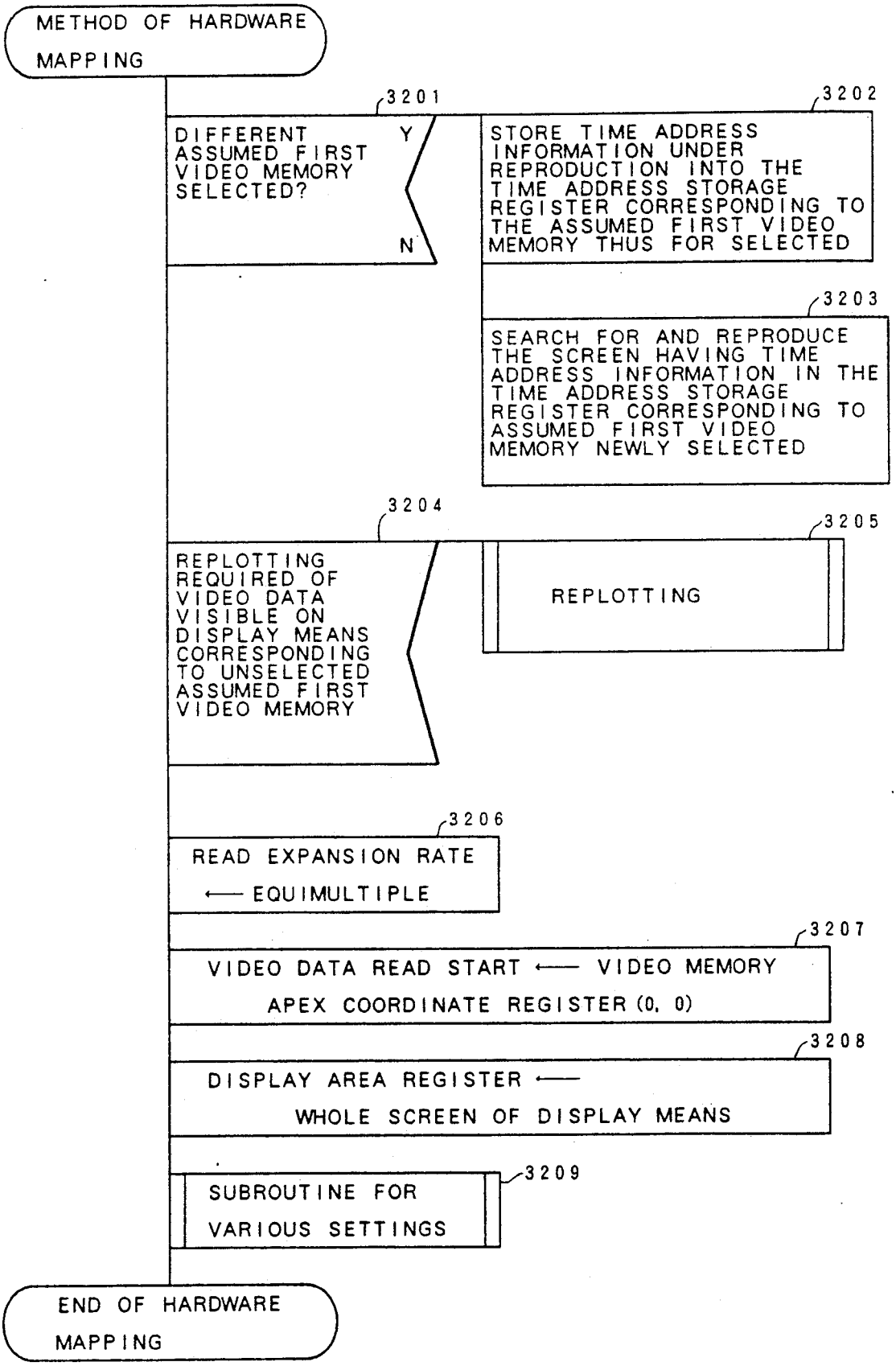
FIG. 32 is a PAD chart of a main routine of hardware mapping by the hardware mapping means in the third embodiment.

FIG. 32 is a PAD chart showing a method of hardward mapping for the hardward mapping means in the video-data processor according to the third embodiment of the present invention. Numeral 3201 designates a step of deciding whether a selected assumed firts video memory has been changed, and if it is changed, step 3202 retrieves the time address information under reproduction by the reproduction time address retrieval means 3122 and stores it in the time address storage register corresponding to the assumed first video memory thus far selected. Step 3203 restarts reproduction by the time address search and reproduction means 3123 from the screen having the time address information in the time address storage register corresponding to the asssumed first video memory selected anew. Step 3204 decides whether the redrawing of the video data on the display means corresponding to the assumed first video memory not selected is necessary or not, and if it is necessary, the redrawing process 3205 mentioned below is executed. Step 3206 sets the read expansion rate to an equimultiple, step 3207 sets a reference point (0, 0) of the video memory in the video data read start coordinate register, and step 3208 sets the display area register in such a manner that the whole screen of the display means represents the display area. A subroutine for various settings is then executed.

Figure 33:
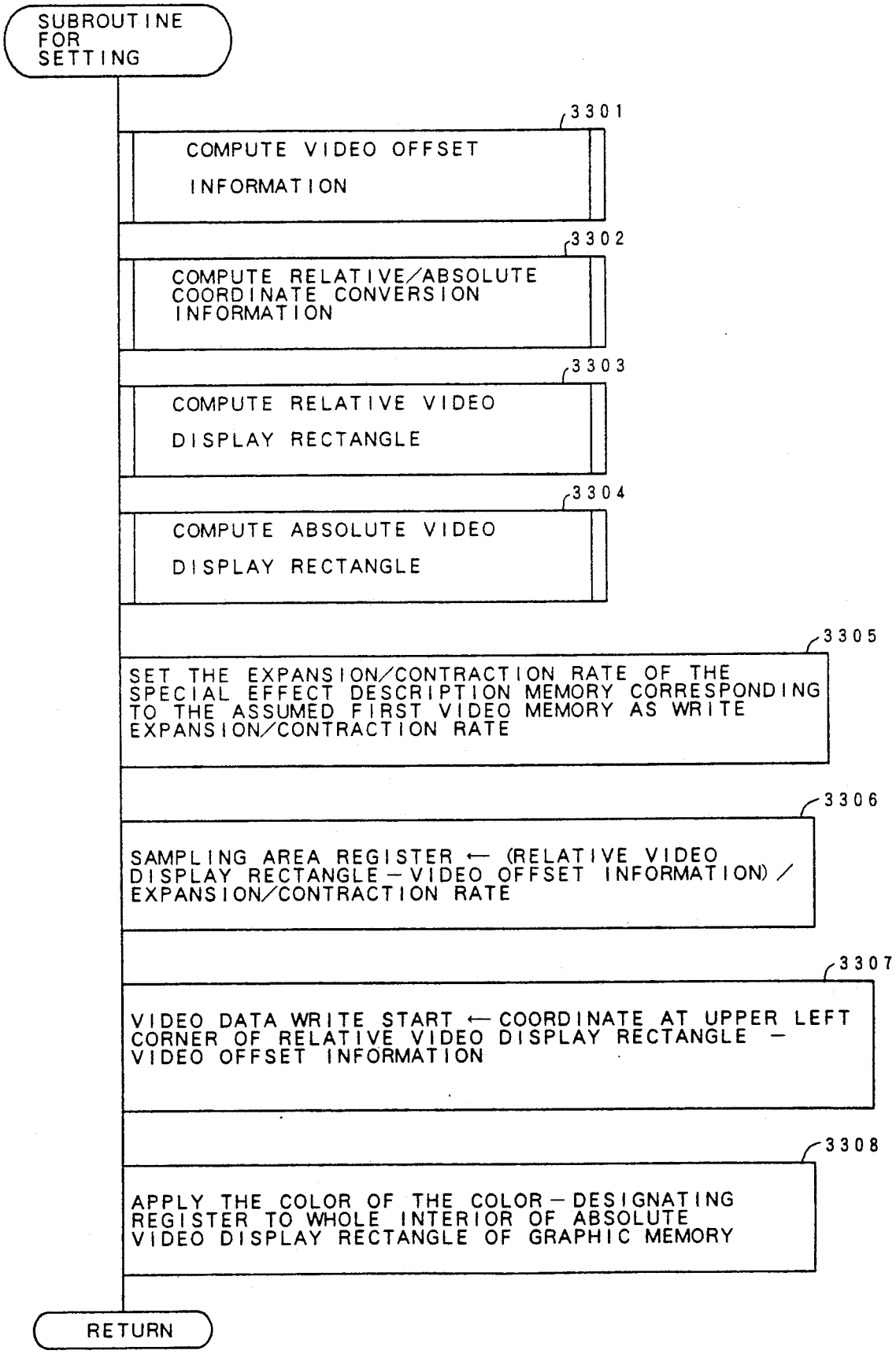
FIG. 33 is a PAD chart of a subroutine for various settings.

FIG. 33 is a PAD chart of a subroutine for various settings. Numeral 3301 designates a step of computing the video offset information in the same manner of processing as in FIG. 14. Step 3302 is for computing the relative/absolute coordinate conversion information in the same manner of process as in FIG. 16. Step 3303 is for computing a relative video display rectangle in the same manner of processing as in FIG. 18. Step 3304 is for computing an absolute video display rectangle in the same manner of processing as in FIG. 22. Now, assume that the special effect information in the special effect description memory is that of expansion/contraction processing. Step 3305 sets this expansion/contraction rate as a write expansion/contraction rate. Step 3306 subtracts the video offset information determined at step 3301 from the relative video display rectangle determined at step 3303, divides the difference by the expansion/contraction rate obtained at 3305 and sets the resulting rectangle in the sampling area register. Step 3307 subtracts the video offset information produced at step 3301 from the coordinate at the upper left corner of the relative video display rectangle obtained at step 3303 and sets the resulting coordinate in the video data write start coordinate register. As a result, the video data with the sampling area thereof digitized is written on the video memory 3113 from the video write start coordinate. Step 3308 draws by applying the color designated in the color-designating register 3118 to the area of the graphic memory 3117 corresponding to the absolute video display rectangle computed at step 3304. As a result, the area corresponding to the whole screen of the display means of the video memory 3113 is applied to the video/graphic combination means 3119. However, the video data is produced only for the area containing the video data on the graphic memory 3117, while the graphics are applied directly from the video/graphic combination means 3119 to the display means 3120 for the other areas.

Figure 34:
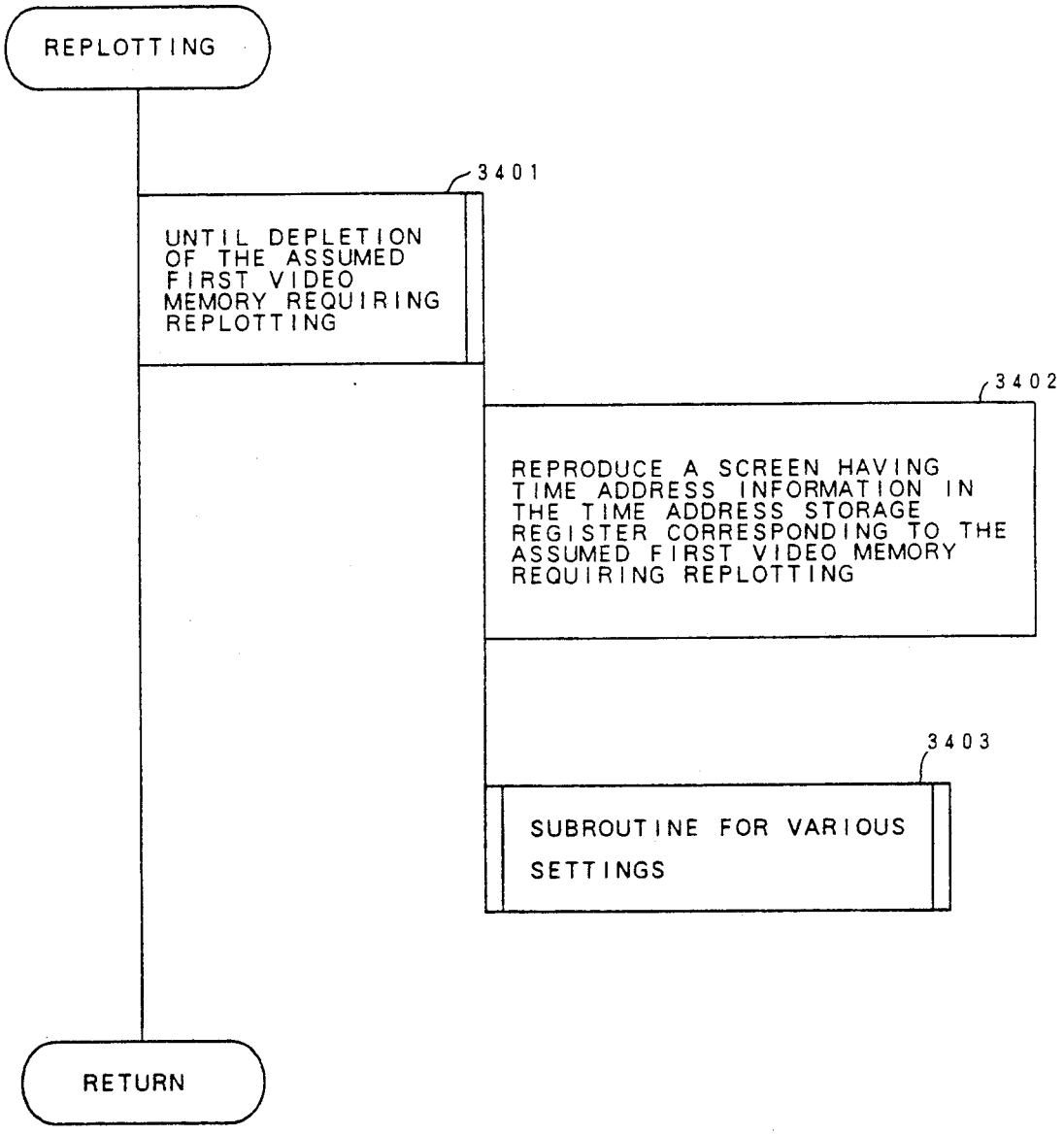
FIG. 34 is a PAD chart for the redrawing processing.
Figure 35A:
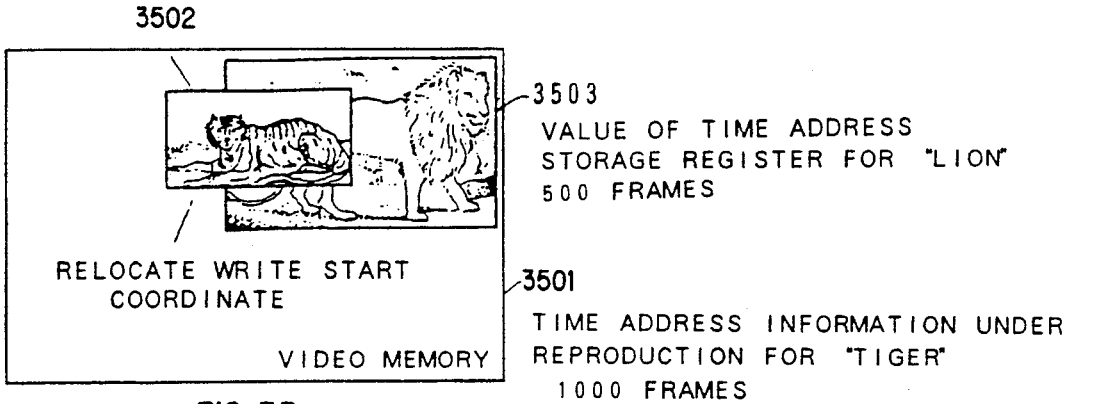
FIG. 35 is a diagram showing an example of the principle of redrawing process.
Figure 35B:
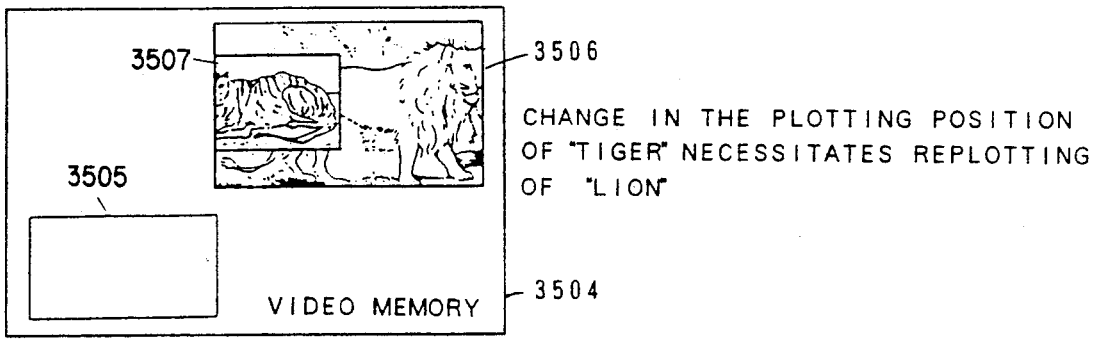
Figure 35C:
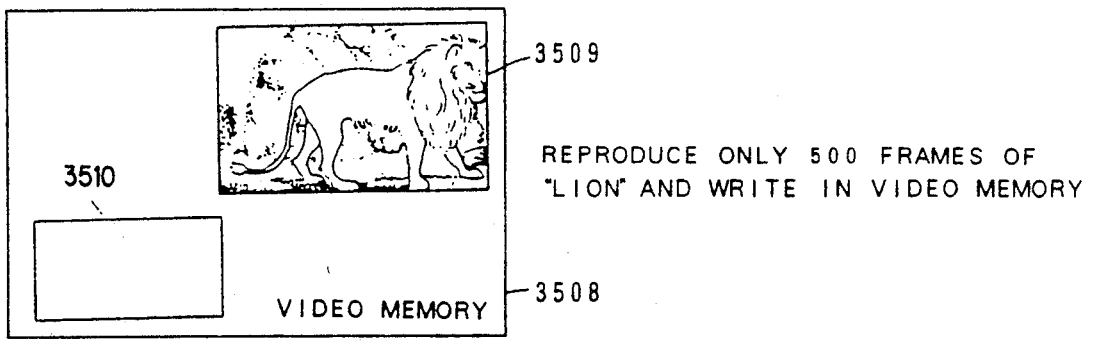
Figure 35D:
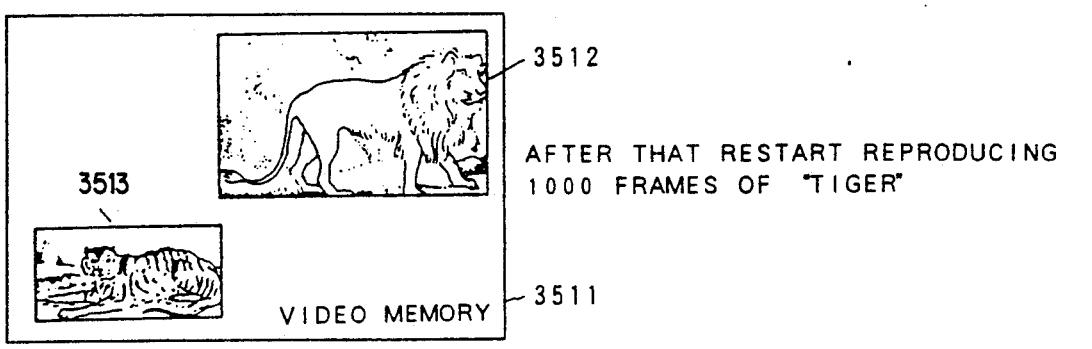
Figure 36:
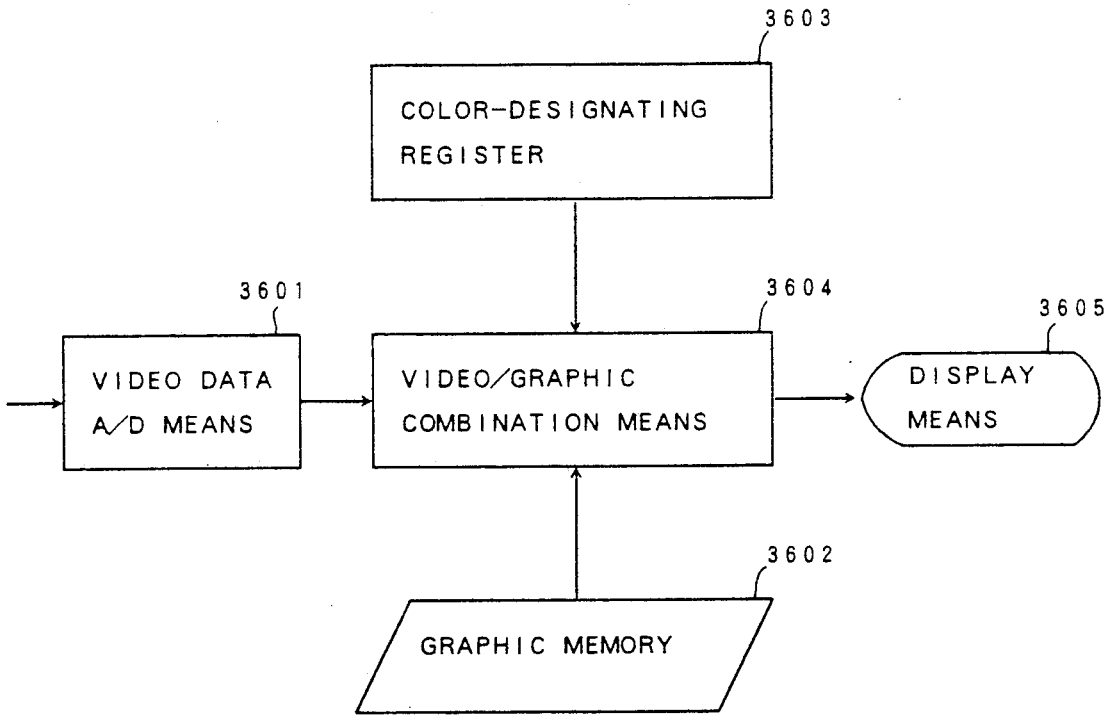
FIG. 36 PRIOR ART
FIG. 36 is a block diagram showing a conventional video data processor.
Figure 37A:
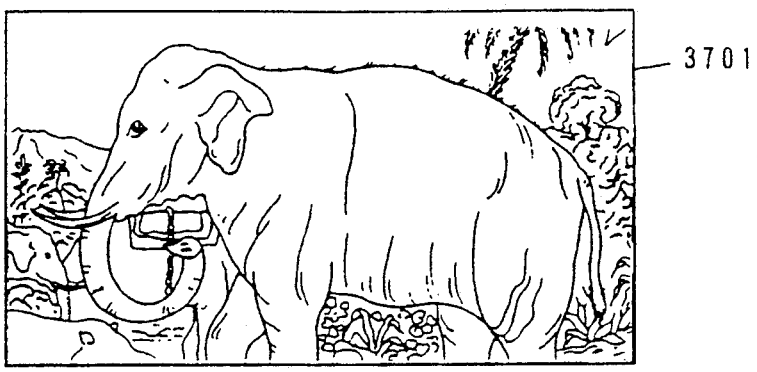
FIG. 37 is a diagram for explaining an example of an application in which the conventional video data processing is not adaptable to a multi-window screen.
Figure 37B:
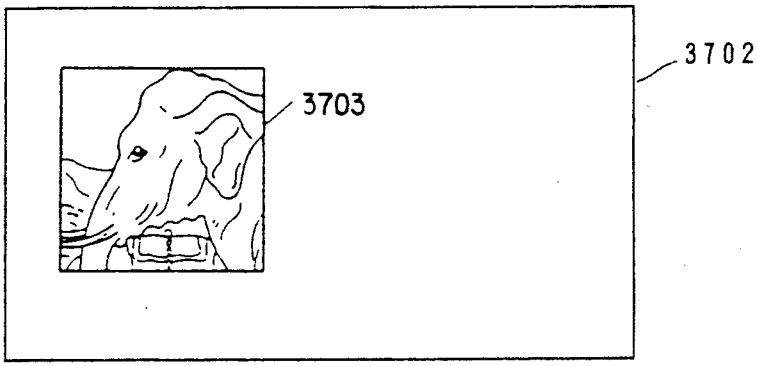
Figure 37C:
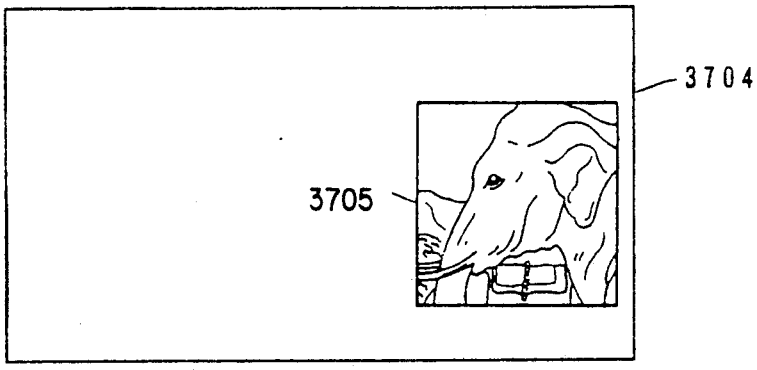
Figure 37D:
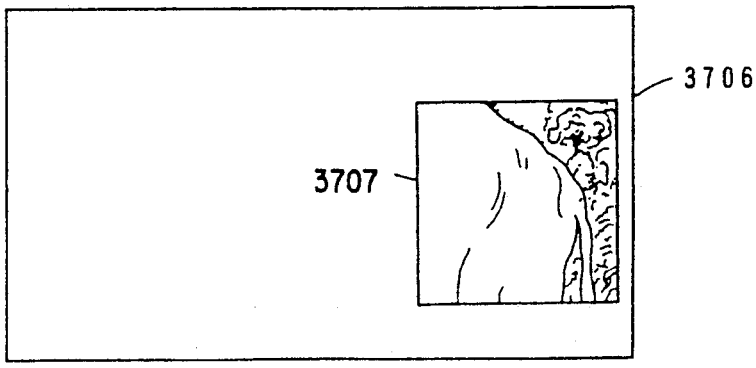

FIG. 34 is a PAD chart for redrawing process. Step 3401 repeats the steps including and subsequent to step 3402 until the assumed first video memories requiring redrawing are eliminated. Step 3402 reproduces by the reproduction address search and reproduction means 3123 only a screen having the time address information in the time address storage register corresponding to the assumed first video memory requiring redrawing. Subsequently, step 3403 executes the various setting subroutine shown in FIG. 33 on the basis of the values of the registers corresponding to the assumed first video memory requiring redrawing.

The principle of this redrawing is shown in FIG. 35. Numeral 3501 in FIG. 35(*a*) shows the content of the video memory 3113 before the requirement for redrawing occurs. Numeral 3502 designates the video data corresponding to the assumed first video memory in selection, and the time address information under reproduction is given as 1000 frames. Numeral 3503 designates the video data corresponding to the assumed first video memory not selected at present, and the time address storage register stores therein the value of 500 frames of the time address information corresponding to the screen "Lion" designated by 3503. Numeral 3506 in FIG. 35(*b*) designates the content of the video memory 3113 as of the time of occurrence of the requirement of redrawing. Numeral 3506 designates a write area after relocation of the video data corresponding to the assumed first video memory under selection. Numeral 3506 designates a video data corresponding to the assumed first video memory not selected at the present. Since a part of the video data 3502 is left as shown by 3507, it is necessary to redraw the particular part. The 500 frames of the time address information in the time address storage register of the video data corresponding to the assumed first video memory not selected is reproduced temporarily, and written in the area 3506, the result of which is shown by (c). Numeral 3508 designates the content of the video memory 3113 after complete redrawing. Numeral 3509 designates a video data corresponding to the assumed first video data not selected but redrawn, and numeral 3501 a write area after relocation of the video data corresponding to the assumed first video memory under selection, which is similar to the one designated by 3505. Subsequently, a video data corresponding to the assumed first video memory selected initially is written, the result of which is shown in FIG. 35(*c*). Numeral 3511 designates the content of the video memory 3113 after complete writing of the video data corresponding to the assumed first video memory wholly selected. Numeral 3512 designates the video data corresponding to the assumed first video memory not selected but completely redrawn. Numeral 3513 designates a video data corresponding to the assumed first video memory selected for which the reproduction has been restarted.

Also, if the method of hardware mapping for the hardware mapping means included in the second or third embodiment of the video data processor according to the present invention is applied to the operating system of the personal computer, smooth video data processing on the multi-window screen is possible in all the application software using the video data executed on the particular operating system.

We claim:

1. A video-data processor comprising a first video memory, a second video memory, a third video memory, a fourth video memory, a special effect description memory for describing special effect information, a video cut-out area register for holding the coordinate of a video cut-out rectangular area on said second video memory, a video write area register for holding the coordinate of a video write rectangular area on the third video memory, a window cut-out area register for holding the coordinate of a window cut-out rectangular area on the third video memory, a window write area register for holding the coordinate of a window write rectangular area on the fourth video memory, video data retrieval means for A/D converting an analog video signal and writing the converted digital video data into the first video memory, special effect means for subjecting the video data written in the first video memory to the special effect processing corresponding to the special effect information described in the special effect description memory and writing the resulting video data into the second video memory, video projecting means for cutting out the video data in the video cut-out rectangular area held in the video cut-out area register from the second video memory and writing into the video write rectangular area held in the video write area register of the third video memory, graphic generation and write means for generating a graphic data and writing into the third video memory, window projecting means for cutting out the video data and graphic data in the window cut-out rectangular area held in the window cut-out area register from the third video memory and writing into the window write rectangular area held in the window write area register of the fourth video memory, and display means for D/A converting and displaying the content of the fourth video memory.

2. A video-data processor according to claim 1, wherein the first video memory has at least one unit, the second video memory has at least one unit corresponding to each unit of the first video memory, the third video memory has a unit corresponding to at least one unit of the second video memory, and the fourth video memory has a unit corresponding to all the units of the third video memory.

3. In a video data-processor according to claim 1, a method of video data processing comprising the step of exerting special effect corresponding to the special effect description memory on the video data written in the first video memory and writing the resulting video data in the second video memory, the step of video projecting by cutting out the video data held in the video cut-out area in the video cut-out area register from the second video memory and writing into the video write area held in the video write area register of the third video memory, the step of generating graphic data and writing into the third video memory, and the step of window projecting by cutting out the video data and the graphic data in the window cut-out area held in the window cut-out area register from the third video memory and writing into the window write area held in the window write area register of the fourth video memory.

4. A video-data processor according to claim 1 or 2, wherein the special effect description memory is replaced by special effect description means, the video cut-out area register by video cut-out area holding means, the video write area register by video write area holding means, the window cut-out area register by window cut-out area holding means, and the window write area register by window write area holding means, said processor further comprising an operating system configured therein of said special effect description means, said video cut-out area holding means, said video write area holding means, said window cut-out area holding means, and said window write area holding means.

5. A video-data processor comprising video memory means assuming the presence of first to fourth video memories therein, a video data write start coordinate register for holding a coordinate on the video memory, a video data read start coordinate register for holding a coordinate on the video memory, video data A/D means for A/D converting an analog video signal and producing a digital video data, video data expansion/contraction write means for subjecting the video data obtained from the video data A/D means to selected one of equimultiple conversion, expansion and contraction and writing into the video memory from the coordinate held in the video data write start coordinate register, video data expansion read means for reading the video data written in the video memory means from the coordinate held in the video data read start coordinate register and subjecting the video data to selected one of equimultiple conversion and expansion, a display area register for holding a display rectangular area on the display screen for displaying the video data produced from the video data expansion read means, video/graphic combination means for combining the video data produced from the video data expansion read means with the graphic data in the graphic memory, display means for A/D converting and displaying the video data/graphic data produced from the video/graphic combination means, a special effect description memory for describing the special effect information assuming the presence of the first and second memories, a video cut-out area register for holding the coordinate of a video cut-out rectangular area on the second video memory under the condition assuming the presence of the second video memory, a video write area register for holding the coordinate of a video write rectangular area on the third video memory under the condition assuming the presence of the third video memory, a window cut-out area register for holding the coordinate of a window cut-out rectangular area on the third video memory under the condition assuming the presence of the third video memory, a window write area register for holding the coordinate of a window write rectangular area on the fourth video memory under the condition assuming the presence of the fourth video memory, and hardware mapping means for computing the expansion/contraction rate of the video data expansion/contraction write means, the value of the video data write start coordinate register, the expansion rate of the video data expansion read means, the value of the video data read start coordinate register and the value of the display area register on the basis of the special effect information in the special effect description memory, the video-cut area held in the video cut-out area register, the video write area register held in the video write area register, the window cut-out area held in the window cut-out area register, and the window write area held in the window write area register.

6. A video-data processor comprising video memory means assuming the presence of first to fourth video memories therein, a video data write start coordinate register for holding a coordinate on the video memory, a video data read start coordinate register for holding a coordinate on the video memory, video data A/D conversion means for A/D converting an analog video signal and producing a digital video data, video data expansion/contraction write means for subjecting the video data produced from the video data A/D conversion means to selected one of equimultiple conversion, expansion and contraction, and writing into the video memory from the coordinate held in the video data write start coordinate register, video data expansion read means for reading the video data in the video memory from the coordinate held in the video data read start coordinate register and subjecting the video data to selected one of equimultiple conversion and expansion, a display area register for holding a display rectangular area on the display screen for displaying the video data produced from the video data expansion read means, a graphic memory for writing the graphic data, a color-designating register for designating a given color in the graphic data, video/graphic combination means for selecting the video data produced from the video data expansion read means for the coordinate contained in the display rectangular area on the display screen held in the display area register and having the same color as the one designated in the color-designating register in the corresponding area on the graphic memory and selecting the graphic data in the graphic memory for other coordinates, display means for D/A converting and displaying the video data/graphic data produced from the video/graphic combination means, a special effect description memory for describing special effect information assuming the presence of the first and second memories, a video cut-out area register for holding the coordinate of a video cut-out rectangular area on the second video memory assuming the presence of the second video memory, a video write area register for holding the coordinate of a video write rectangular area on the third video memory assuming the presence of the third video memory, a window cut-out area register for holding the coordinate of a window cut-out rectangular area on the third video memory assuming the presence of the third video memory, a window write area register for holding the coordinate of a window write rectangular area on the fourth video memory assuming the presence of the fourth video memory, and hardware mapping means for computing the expansion/contraction rate of the video data expansion/contraction write means, the value of the video data write start coordinate register, the expansion rate of the video data expansion read means, the value of the video data read start coordinate register and the value of the display area register on the basis of the special effect information in the special effect description memory, the video cut-out area held in the video cut-out area register, the video write area held in the video write area register, the window cut-out area held in the window cut-out area register, and the window write area held in the window write area register, said hardware mapping means applying the color set in the color-designating register on the graphic memory to the rectangular area corresponding to the value of the display area register.

7. In a video-data processor according to claim 6, a method of video data processing wherein the hardware mapping means comprises the step of computing the video offset information by subtracting the coordinate at the upper left corner of the video cut-out area in the video cut-out area register in each of horizontal and vertical directions from the coordinate at the upper left corner of the video write area in the video write area register on the basis of the designation of expansion/-contraction processing described as special effect information and the related expansion/contraction rate stored in the special effect description memory, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle and setting the difference in the video data read start coordinate register, the step of setting a display area by adding the relative/absolute coordinate conversion information in each of horizontal and vertical directions to the coordinates at upper left and lower right corners of the relative video display rectangle and setting the resulting absolute video display rectangle in the display area register, the step of setting the expansion/contraction rate in the special effect description memory as an expansion/contraction rate of the video data expansion/contraction write means, the step of setting the expansion rate of the video data expansion read means to an equimultiple, the step of setting a video data write start coordinate at a reference point of the video memory, and the step of applying the color designated in the color-designating register to the whole pixels in the graphic memory corresponding to the absolute video display rectangle.

8. In a video-data processor according to claim 6, a method of video data processing wherein the hardware mapping means comprises the step of computing the video offset information by subtracting the coordinate at the upper left corner of the video cut-out area in the video cut-out area register in each of horizontal and vertical directions from the coordinate at the upper left corner of the video write area in the video write area register on the basis of the mosaicking designation of the processing described in the special effect memory as special effect information, the assumed second video memory video size information representing the size of the video data on the second video memory obtained after the mosaicking processing and the tile size information representing the size of the tile mosaicked, the step of computing the relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a write expansion/contraction rate by dividing the assumed second video memory video size information by the assumed first video memory video size information representing the size of the original video data not mosaicked on the assumed first video memory, further dividing the result thereof by the tile size information, and setting the quotient thereof in the video data expansion/contraction write means as an expansion/contraction rate, the step of setting a video data read start coordinate by subtracting the video offset information from the coordinate at the upper left corner of the relative video display rectangle in each of horizontal and vertical directions, dividing the difference by the expansion rate and setting the quotient in the video data read start coordinate register, the step of setting a display area by adding the relative/absolute coordinate conversion information to the coordinates at the upper left and lower right corners of the relative video display rectangle in each of horizontal and vertical directions and setting the resulting absolute video display rectangle into the display area register, and the step of applying the color designated in the color-designating register to the whole pixels in the graphic memory corresponding to the absolute video display rectangle.

9. In a video data processor according to claim 6, a method of video data processing wherein the hardware mapping means comprises the step of computing the video offset information by subtracting the coordinate at the upper left corner of the video cut-out area in the video cut-out area register in each of horizontal and vertical directions from the coordinate at the upper left corner of the video write area in the video write area register on the basis of the designation of the multi-freeze processing described in the special effect description memory as special effect information, the assumed second video memory video size information representing the size of the video data on the assumed second video memory obtained after multi-freezing and the number of unit minor images after multi-freezing in horizontal and vertical directions, the step of computing relative/absolute coordinate conversion information by substracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained both in the video write area and the window cut-out area, the step of setting a write expansion/contraction rate by dividing the assumed second video memory video size information by the assumed first video memory video size information representing the size of the original video data not multi-frozen on the assumed first video memory, dividing the resulting horizontal value by the number of the unit minor images in the horizontal direction, and setting the quotient as an expansion/contraction rate of the video data expansion/contraction write means, the step of computing the unit image width by multiplying the value of the assumed first video memory video size information in horizontal direction by the write expansion/contraction rate, the step of computing the unit image height by multiplying the assumed first video memory video size information in vertical direction by the write expansion/contraction rate, the step of initialization for starting writing video data by setting a reference point of the video memory described in claim 2 into the video data write start coordinate register, the step of drawing a unit minor image by writing the video data covered by the write expansion/contraction rate into the video memory from the video data write start coordinate, the step of updating the horizontal drawing by adding the unit minor image width in horizontal direction of the video data write start coordinate after application of the unit minor image-drawing step and applying the unit minor image-drawing step again, the present step being repeated until the number in horizontal direction of the unit minor images drawn reaches that in horizontal direction of the unit minor images stored in the special effect description memory, the step of updating the vertical drawing by adding the unit image height in vertical direction of the video data write start coordinate after application of the horizontal drawing-updating step while setting zero in horizontal direction, and applying the horizontal drawing-updating step again, the present step being repeated until the number of the drawn unit minor images in vertical direction reaches that of the unit minor images in vertical direction stored in the special effect description memory, the step of setting a read expansion rate by setting the expansion rate of the video data expansion read means to an equimultiple, the step of setting a video data read start coordinate by subtracting the video offset information in each of horizontal and vertical directions from the coordinate at the upper left corner of the relative video display rectangle and setting the difference into the video data read start coordinate register, the step of setting a display area by adding the relative/absolute coordinate conversion information in each of horizontal and vertical directions to the coordinates at the upper left and lower right corners of the relative video display rectangle respectively and setting the resulting absolute video display rectangle in the display area register, and the step of applying the color in the color-designating register to the whole pixels in the graphic memory corresponding to the absolute video display rectangle.

10. In a video data processor according to claim 6, a method of video data processing wherein the hardware mapping means comprises:

an expansion/contraction process including the step of setting the write expansion/contraction rate stored in the special effect description memory as an expansion/contraction rate of the video data expansion/contraction write means on the basis of the designation of the expansion/contraction processing and the related expansion/contraction rate described in the special effect description memory as special effect information, the step of setting a read expansion rate by setting the expansion rate of the video data expansion read means to an equimultiple, and the step of setting a video data write start coordinate at a reference point of the video memory;

a mosaicking process including the step in which the assumed second video memory video size information representing the size of the video data on the assumed second video memory obtained after mosaicking is divided by the assumed first video memory video size information representing the size of the original video data not mosaicked on the assumed first video memory on the basis of the mosaicking design described in the special effect description memory as special effect information, the assumed second video memory video size information and the tile size information representing the size of the tile mosaicked, and the result thereof is further divided by the tile size information, the resulting quotient being set as an expansion/contraction rate of the video data expansion/contraction write means, and the step of setting a read expansion rate by setting the tile size information as an expansion rate of the video data expansion read means;

a multi-freezing process including the step of setting a write expansion/contraction rate in which the assumed second video memory video size information representing the size of the video data on the assumed second video memory obtained after multi-freezing is divided by the assumed first video memory video size information representing the size of the original data not multi-frozen on the assumed first video memory on the basis of the designation of the multi-freeze processing described as special effect information in the special effect description memory, the assumed second video memory video size information and the numbers in horizontal and vertical directions of the unit minor images after multi-freezing, the resulting value in horizontal direction is further divided by the number in horizontal direction of the unit minor images, and the resulting quotient is set as an expansion/contraction rate of the video data expansion/contraction write means, the step of computing the unit minor image width by multiplying the assumed first video memory video size information by the write expansion/contraction rate in horizontal direction, the step of computing the unit minor image height by multiplying the assumed first video memory video size information by the write expansion/contraction rate in vertical direction, the step of initialization for starting writing the video data by setting a reference point of the video memory described in claim 2 in the video data write start coordinate register, the step of drawing a unit minor image by writing in the video memory means the video data covered by the write expansion/contraction rate from the video data write start coordinate, the step of updating the horizontal drawing by adding the unit minor image width in horizontal direction to the video data write start coordinate after application of the unit minor image-drawing step and applying the unit minor image-drawing step again, the present step being repeated until the number in horizontal direction of the drawn unit minor images reaches that of the horizontal unit minor images stored in the special effect description memory, the step of updating the vertical drawing by adding the unit minor image height in vertical direction to the video data write start coordinate after application of the horizontal drawing-updating step while setting zero in horizontal direction and applying the horizontal drawing-updating step again, the present step being repeated until the number of the drawn unit minor images in vertical direction reaches that of the unit minor images in vertical direction stored in the special effect description memory, and the step of setting the expansion rate of the video data expansion read means to an equimultiple; and another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing the relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle dividing the difference by the read expansion rate of the video data expansion read means, and setting the quotient in the video data read start coordinate register, the step of setting a display area by adding the relative/absolute coordinate conversion information to the coordinates at the upper left and lower right corners of the relative video display rectangle in each of horizontal and vertical directions and setting the resulting absolute video display rectangle in the display area register, the step of applying the color designating register to the whole pixels in the graphic memory corresponding to the absolute video display rectangle, and the step of switching the special effect by selecting the write expansion/contraction processing if the content of the special effect description memory is expansion/contraction processing, selecting the mosaicking processing if the content of the special effect description memory is mosaicking processing, and selecting the multi-freezing if the content of the special effect description memory is multi-freezing.

11. A video-data processor according to claim 6, wherein the video/graphic combination means is replaced by exclusive OR means for computing the exclusive logic sum of the video data produced from the expansion read means and the graphic data in the graphic memory.

12. In a video-data processor according to claim 11, a method of video data processing wherein the hardware mapping means comprises:

an expansion/contraction process including the step of setting the write expansion/contraction rate stored in the special effect description memory as an expansion/contraction rate of the video data expansion/contraction write means on the basis of the designation of the expansion/contraction processing and the related expansion/contraction rate described as special effect information in the special effect description memory, the step of setting the expansion rate of the video data expansion read rate to an equimultiple, and the step of setting a video data write start coordinate at a reference point of the video memory means;

a mosaicking process including the step of setting a write expansion/contraction rate in which the assumed second video memory video size information representing the size of the video data on the assumed second video memory obtained after mosaicking processing is divided by the assumed first video memory video size information representing the size of the original video data not mosaicked on the assumed first video memory on the basis of the designation of mosaicking processing described as special effect information in the special effect description memory, the assumed second video memory video size information and the tile size information representing the size of the tile mosaicked, and the result thereof is further divided by the tile size information, the quotient thereof being set as an expansion/contraction rate of the video data expansion/contraction write means, and the step of setting the tile size information as an expansion rate of the video data expansion read means;

the multi-freezing process including the step in which the assumed second video memory video size information representing the size of the video data on the assumed second video memory obtained after multi-freezing is divided by the assumed first video memory video size information representing the size of the original video data not multi-frozen on the assumed first video memory on the basis of the multi-freeze designation described as special effect information in the special effect description memory, the assumed second video memory video size information and the numbers in horizontal and vertical directions of the unit minor images obtained after multi-freezing, the horizontal result of division is further divided by the number of the unit minor images in horizontal direction, and the quotient thereof is set as an expansion/contraction rate of the video data expansion/contraction write means, the step of computing a unit minor image width by multiplying the write expansion/contraction rate by the assumed first video memory video size information in horizontal direction, the step of computing the unit minor image height by multiplying the write expansion/contraction rate by the assumed first video memory video size information in vertical direction, the step of initialization for video data write start by setting a reference point of the video memory means in the video data write start coordinate register, the step of drawing a unit minor image by writing in the video memory means the video data covered by the write expansion/contraction rate from the video data write start coordinate, the step of updating the horizontal drawing by adding the unit minor image width to the video data write start coordinate in horizontal direction after application of the unit minor image-drawing step and applying the unit minor image-drawing step again, the present step being repeated until the number of the drawn unit minor images in horizontal direction reaches that of the unit minor images stored in the special effect description memory in horizontal direction, the step of updating the vertical drawing by adding the unit minor image height to the video data write start coordinate in vertical direction after application of the horizontal drawing-updating step and applying the horizontal drawing-updating step again while setting zero in horizontal direction, the present step being repeated until the number of the drawn unit minor images in vertical direction reaches that of the unit minor images in vertical direction stored in the special effect description memory, and the step of setting the read expansion rate of the video data expansion read means to an equimultiple; and another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle, dividing the difference by the expansion read rate of the video data expansion read means and setting the quotient into the video data read start coordinate register, the step of setting a display area by adding the relative/absolute coordinate conversion information in each of horizontal and vertical directions to the coordinates at the upper left and lower right corners of the relative video display rectangle and setting the resulting absolute video display rectangle in the display area register, the step of switching the special effect by selecting the write expansion/contraction processing if the content of the special effect description memory is the expansion/contraction processing, the mosaicking processing if the content of the special effect description memory is mosaicking and the multi-freezing processing of the content of the special effect description memory is multi-freezing, and the step of applying the white color to the whole pixels in the graphic memory corresponding to the absolute video display rectangle on the basis of the designation of negative/positive inversion described in the special effect description memory.

13. A video-data processor according to claim 6, wherein the video/graphic combination means is replaced by AND means for computing the logic product of the video data obtained from the expansion read means and the graphic data in the graphic memory.

14. In a video-data processor according to claim 13, a method of video data processing wherein the hardware mapping means comprises:

an expansion/contraction process including the step of setting a write expansion/contraction rate by setting the expansion/contraction rate stored in the special effect description memory as an expansion/contraction rate of the video data expansion/contraction write means on the basis of the expansion/contraction designation and the related expansion/contraction information described as special effect information in the special effect description memory, the step of setting the read expansion rate of the video data expansion read means to an equimultiple, and the step of setting a video data write start coordinate at a reference point of the video memory means;

a mosaicking process including the step of setting a write expansion/contraction rate in which the assumed second video memory video size information representing the size of the video data on the assumed second video memory obtained after mosaicking is divided by the assumed first video memory video size information representing the size of the original video data not mosaicked on the assumed first video memory, on the basis of the mosaicking designation described as special effect information in the special effect description memory, the assumed second video memory video size information and the tile size information representing the size of the tile mosaicked, the result of division is further divided by the tile size information and the quotient is set as an expansion/contraction rate of the video data expansion/contraction write means, and the step of setting the tile size information as an expansion rate of the video data expansion read means;

a multi-freezing process including the step of setting a write expansion/contraction rate in which the assumed second video memory video size information representing the size of the video data on the assumed second video memory obtained after multi-freezing is divided by the assumed first video memory video size information representing the size of the original data not multi-frozen on the assumed first video memory on the basis of the multi-freeze designation described as special effect information in the special effect description memory, the assumed second video memory video size information and the numbers of the unit minor images in horizontal and vertical directions after multi-freezing, the resulting horizontal value of division is further divided by the number in horizontal direction of the unit minor images, and the resulting quotient is set as an expansion/contraction rate of the video data expansion/contraction write means, the step of computing a unit minor image width by multiplying the assumed first video memory video size information by the write expansion/contraction rate in horizontal direction, the step of computing the unit minor image height by multiplying the write expansion/contraction rate by the assumed first video memory video size information in vertical direction, the step of initialization for video data write start by setting a reference point of the video memory means described in claim 2 into the video data write start coordinate register, the step of drawing a unit minor image by writing into the video memory means the video data covered by the write expansion/contraction rate from the video data write start coordinate, the step of updating the horizontal drawing by adding the unit minor image width to the video data write start coordinate in horizontal direction after application of the unit minor image-drawing step and applying the unit minor image-drawing step again, the present step being repeated until the number of the drawn unit minor images in horizontal direction reaches that of the unit minor images stored in the special effect description memory in horizontal direction, the step of updating the vertical drawing by adding the unit minor image height in vertical direction to the video data write start coordinate after application of the horizontal drawing-updating step while setting zero in horizontal direction, and applying the horizontal drawing-updating step again, the present step being repeated until the number of the drawn unit minor images in vertical direction reaches that of the unit minor images stored in the special effect description memory in vertical direction, and the step of setting a read expansion rate by setting the expansion rate of the video data expansion read means to an equimultiple; and another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information from the coordinate at the upper left corner of the relative video display rectangle in each of horizontal and vertical directions, dividing the difference by the expansion read rate of the video data expansion read means and setting the quotient into the video data read start coordinate register, the step of setting a display area by adding the relative/absolute coordinate conversion information to the coordinates at the upper left and lower right corners of the relative video display rectangle in each of horizontal and vertical directions and setting the resulting absolute video display rectangle in the display area register, the step of switching the special effect by selecting the write expansion/contraction processing if the content of the special effect memory is the expansion/contraction processing, the mosaicking processing if the content of the special effect description memory is mosaicking processing and the multi-freezing processing if the content of the special effect description memory is the multi-freezing processing, and the step of applying the grapy color to the whole pixels in the graphic memory corresponding to the absolute video display rectangle on the basis of the art effect designation described in the special effect description memory.

15. A video-data processor comprising video memory means assuming the presence of first to fourth video memories therein, a video data write start coordinate register for holding a coordinate on the video memory means, a video data read start coordinate register for holding a coordinate on the video memory means, video data A/D conversion means for A/D converting an analog video signal and producing a digital video data, video data expansion/contraction write means for subjecting the video data produced from the video data A/D conversion means to selected one of equimultiple conversion, expansion and contraction, and writing into the video memory from the coordinate held in the video data write start coordinate register, video data expansion read means for reading the video data written in the video memory means from the coordinate held in the video data read start coordinate register and subjecting the video data to selected one of equi-multiple conversion, expansion and contraction, a display area register for holding a display rectangular area on the display screen for displaying the video data produced from the expansion read means, a graphic memory for writing the graphic data, a register for designating a given color in the graphic data, video/graphic combination means for selecting the video data produced from the video data read means in respect of coordinates contained in said display rectangular area on the display screen held in the display area register and having the same color as the color-designating register in a corresponding area on the graphic memory corresponding to and selecting the graphic data in the graphic memory in respect of the other coordinates, exclusive OR means for computing the exclusive logic sum of the video data produced from the video data expansion read means and the graphic data in the graphic memory, AND means for computing the logic product of the video data and the graphic data, video/graphic switching means for switching the application between video/graphic combination means, the exclusive OR means and the AND means, display means for D/A converting and displaying the video data/graphic data produced from the video/graphic switching means, a special effect description memory for describing the special effect information assuming the presence of the first and second video memories, a video cut-out area register for holding the coordinate of a video cut-out rectangular area on the second video memory assuming the presence of the second video memory, a video write area register for holding the coordinate of a video write rectangular area on the third video memory assuming the presence of the third video memory, a window cut-out area register for holding the coordinate of a window cut-out rectangular area on the third video memory assuming the presence of the third video memory, a window write area register for holding the coordinate of a window write rectangular area on the fourth video memory assuming the presence of the fourth video memory, and hardware mapping means in which the expansion/contraction rate of the video data expansion/contraction write means, the value of the video data write start coordinate register, the expansion rate of the video data expansion read means, the value of the video data read start coordinate register and the value of the display area register are computed on the basis of the special effect information in the special effect description memory, the video cut-out area held in the video cut-out area register, the video write area held in the video write area register, the window cut-out area held in the window cut-out area register and the window write area held in the window write area register, the color designated in the color-designating register on the graphic memory is applied to the display rectangular area corresponding to the value of the display area register, and the video/-graphic switching means is switched accordingly.

16. In a video-data processor according to claim 15, a method of video data processing wherein the hardware mapping means comprises:

the expansion/contraction process including the step of setting the expansion/contraction rate stored in the special effect description memory into the video data expansion/contraction means as an expansion/contraction rate thereof on the basis of the designation of the expansion/contraction processing and the related expansion/contraction rate described in the special effect description memory, the step of setting the expansion rate of the video data read means to an equimultiple, and the step of setting a video data write start coordinate to a reference point of the video memory means;

a mosaicking process including the step of setting a write expansion/contraction rate in which the assumed second video memory video size information representing the size of the video data on the assumed second video memory obtained after mosaicking is divided by the assumed first video memory video size information representing the size of the original video data not mosaicked on the assumed first video memory on the basis of the mosaicking designation described in the special effect description memory as special effect information, the assumed second video memory video size information and the tile size information representing the size of the tile mosaicked, the result thereof is further divided by the tile size information and the resulting quotient is set as an expansion/contraction rate of the video data expansion/contraction write means, and the step of setting the tile size information as a read expansion rate of the video data expansion read means;

the multi-freezing process including the step of setting a write expansion/contraction rate in which the assumed second video memory video size information representing the size of the video data on the assumed second video memory produced after multi-freezing is divided by the assumed first video memory video size information representing the size of the original video data not multi-frozen on the assumed first video memory on the basis of the multi-freeze designation described as special effect information in the special effect description memory, the assumed second video memory video size information and the numbers in horizontal and vertical directions of the unit minor images multi-frozen, the resulting horizontal value is further divided by the number in horizontal direction of the unit minor images and setting the resulting quotient as an expansion/contraction rate of the video data expansion/contraction write means, the step of computing the unit minor image width by multiplying the write expansion rate by the assumed first video memory video size information in horizontal direction, the step of computing the unit minor image height by multiplying the write expansion/contraction rate by the assumed first video memory video size information in vertical direction, the step of initialization for video data write start by setting a reference point of the video memory in the video data write start coordinate register, the step of drawing a unit minor image by writing in the video memory means the video data covered by the write expansion/contraction rate from the video data write start coordinate, the step of updating the horizontal drawing by adding the unit minor image width in horizontal direction of the video data write start coordinate after application of the unit minor image-drawing step and applying the unit minor image-drawing step again, the present step being repeated until the horizontal number of the drawn unit minor images reaches that of the unit minor images stored in the special effect description memory in horizontal direction, the step of updating the vertical drawing by adding the unit minor image height in vertical direction of the video data write start coordinate while setting zero in horizontal direction after application of the horizontal drawing-updating step and applying the horizontal drawing-updating step again, the present step being repeated until the vertical number of the unit minor images reaches that of the unit minor images in vertical direction stored in the special effect description memory, and the step of setting the read expansion rate of the video data expansion read means to an equimultiple; and another process including the step of computing the video offset information by subtracting the coordinate at the upper left corner of the video cut-out area in the video cut-out area register in each of horizontal and vertical directions from the coordinate at the upper left corner of the video write area in the video write area register, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data read start coordinate by subtracting the video offset information in each of horizontal and vertical directions from the coordinate at the upper left corner of the relative video display rectangle, dividing the difference by the expansion read rate of the video data expansion read means, and setting the result thereof in the video data read start coordinate register, the step of setting a display area by adding the relative/absolute coordinate conversion information in each of horizontal and vertical direction to the coordinates at the upper left and lower right corners of the relative video display rectangle and setting the resulting absolute video display rectangle in the display area register, the step of switching the special effect by selecting the write expansion/contraction processing if the content of the special effect description memory is that of expansion/contraction processing, the mosaicking processing if the content of the special effect description memory is that of mosaicking processing, and the multi-freeze processing if the content of the special effect description memory is that of multi-freezing, and the step of selecting the video pixel processing by selecting the video/graphic combination means while at the same time applying the color designated in the color-designating register to the whole pixels in the graphic memory corresponding to the absolute video display rectangle if the pixel processing designation in the special effect description memory is that of no-processing, selecting the exclusive OR means while at the same time applying the white color to the whole pixels in the graphic memory corresponding to the absolute video display rectangle if the pixel processing designation in the special effect description memory is that of negative/positive inversion, and selecting the AND means while at the same time applying the gray color to the whole pixels in the graphic memory corresponding to the absolute video display rectangle if the pixel processing designation in the special effect description memory is that of art effect processing.

17. A video-data processor comprising video memory means assuming therein the presence of first to fourth memories, a video data write start coordinate register for holding a coordinate on the video memory means, a video data read start coordinate register for holding a coordinate on the video memory means, a sampling area register for holding a sampling rectangular area sampled in a screen of video data, video data-limiting A/D conversion means for A/D converting only the analog video data in the sampling rectangular area held in the sampling area register and producing a digital video data, video data expansion/contraction write means for subjecting the video data produced from the video data-limiting A/D conversion means to selected one of equimultiple conversion, expansion and contraction, and writing into the video memory means from the coordinate held in the video data write start coordinate register, video data expansion read means for subjecting the video data written into the video memory means from the coordinate held in the video data read start coordinate register, to selected one of equimultiple conversion and expansion, a display area register for holding a display rectangular area on the display screen for displaying the video data produced from the video data expansion read means, a graphic memory for writing graphic data, a color-designating register for designating a given color in the graphic data, video/graphic combination means for selecting the video data produced from the video data expansion read means for the coordinate contained in the display rectangular area on the display screen held in the display area register and having the same color as the color-designating register in a corresponding area on the graphic memory, and selecting the graphic data in the graphic memory for the other coordinates, display means for D/A converting and displaying the video data/graphic data produced from the video/graphic combination means, a special effect description memory for describing the special effect information assuming the presence of the first and second memories, a video cut-out area register for holding the coordinate of a video cut-out rectangular area on the second video memory assuming the presence of the second video memory, a video write area register for holding the coordinates of a video write rectangular area on the third video memory assuming the presence of the third video memory, a window cut-out area register for holding the coordinates of a window cut-out rectangular area on the third video memory assuming the presence of the third video memory, a window write area register for holding the coordinates of a window write rectangular area on the fourth video memory assuming the presence of the fourth video memory, and hardware mapping means in which the expansion/contraction rate of the video data expansion/contraction write means, the value of the video data write start coordinate register, the expansion rate of the video data expansion read means, the value of the video data read start coordinate register, the value of the display area register and the value of the sampling area register are computed on the basis of the special effect information in the special effect description memory, the video cut-out area held in the video cut-out area register, the video write area held in the video write area register, the window cut-out area held in the window cut-out area register and the window write area held in the window write area register, and the color set in the color-designating register on the graphic memory is applied to the display rectangular area corresponding to the value of the display area register.

18. In a video-data processor according to claim 17, a method of video data processing wherein the hardware mapping means comprises the step of computing the video offset information by subtracting the coordinate value at the upper left corner of the video cut-out area in the video cut-out area register in each of horizontal and vertical directions from the coordinate value at the upper left corner of the video write area in the video write area register on the basis of the expansion/contraction designation and the related expansion/contraction rate described in the special effect description memory, the step of computing a relative/absolute coordinate conversion information by subtracting the coordinate at the upper left corner of the window cut-out area in the window cut-out area register in each of horizontal and vertical directions from the coordinate at the upper left corner of the window write area in the window write area register, the step of computing a relative video display rectangle which is a maximum rectangle contained in both the video write area and the window cut-out area, the step of setting a video data write start coordinate by adding the relative/absolute coordinate conversion information in each of horizontal and vertical directions to the coordinate at the upper left corner of the relative video display rectangle and setting the resulting coordinate at the upper left corner of the absolute video display rectangle into the video data write start coordinate register, the step of setting the write expansion/contraction rate stored in the special effect description memory into the video data expansion/contraction write means as an expansion/contraction rate thereof, the step of setting a sampling area by subtracting the video offset information from the coordinates at the upper left and lower right corners of the relative video display rectangle in each of horizontal and vertical directions, dividing the difference by the expansion/contraction rate and setting the quotient into the sampling area register, the step of setting the read expansion rate of the video data expansion read means to an equimultiple, the step of setting the video data read start coordinate to a reference point of the video memory means, the step of setting a display area register by setting an area corresponding to the whole screen of the display means into the display area register, and the step of applying the color designated in the color-designating register to the whole pixels in the graphic memory corresponding to the absolute video display rectangle.

19. A video-data processor comprising video memory means assuming therein the presence of first to fourth memories, a video data recording medium for recording a video data together with the time address information representing numerals primarily allotted to a screen of the video data by means of selected one of optical and magnetic means, a time address storage register corresponding to each of at least one assumed first video memory which constitutes at least a first video memory assumed to be present, assumed first video memory selection means for selecting one of the assumed first video memories, a video data write start coordinate register for holding a coordinate on the video memory means, a video data read start coordinate register for holding a coordinate on the video memory means, a sampling area register for holding a sampling rectangular area sampled in a screen of the video data, video data-limiting A/D conversion means for A/D converting an analog video data only within the sampling rectangular area held in the sampling area register and producing a digital video data, video data expansion/contraction write means for subjecting the video data produced from the video data-limiting A/D conversion means to selected one of equimultiple conversion, expansion and contraction and writing into the video memory means from the coordinate held in the video data write start coordinate register, video data expansion read means for reading the video data written in the video memory from the coordinate held in the video data read start coordinate register and subjecting the video data to selected one of equimultiple conversion, expansion and contraction, a display area register for holding a display rectangular area on the display screen for displaying the video data produced from the video data expansion read means, a graphic memory for writing graphic data, a register for designating a given color in the graphic data, video/graphic combination means for selecting the video data produced from the video data expansion read means in respective of the coordinate contained in the display rectangular area on the display screen held in the display area register and having the same color as the one designated in the color-designating register in the corresponding area on the graphic memory and selecting the graphic data in the graphic memory in respect of the other coordinates, display means for D/A converting and displaying the video data graphic data produced from the video/graphic combination means, a special effect description memory for describing the special effect information assuming the presence of the first and second video memories, said memory being available for each assumed first video memory, a video cut-out area register for holding the coordinate of a video cut-out rectangular area on the second video memory assuming the presence of the second video memory, said register being available for each assumed first video memory, a video write area register for holding the coordinate of a video write rectangular area on the third video memory assuming the presence of the third video memory, said register being available for each assumed first video memory, a window cut-out area register for holding the coordinate of a window cut-out rectangular area on the third video memory assuming the presence of the third video memory, said register being available for each assumed first video memory, a window write area register for holding the coordinate of a window write rectangular area on the fourth video memory assuming the presence of the fourth video memory, said register being available for each assumed first video memory, means for retrieving the time address information under reproduction, time address search and reproduction means for searching for a screen coinciding with a given time address information and starting reproduction of the video data from the particular screen, and hardware mapping means in which the expansion/contraction rate of the video data expansion/contraction write means, the value of the video data write start coordinate register, the expansion rate of the video data expansion read means, the value of the video data read start coordinate register, the value of the display area register, the value of the sampling area register and the value of the time address storage register are computed on the basis of the selection information of the assumed first video memory selection means, the value of the time address storage register, the special effect information in the special effect description memory, the video cut-out area held in the video cut-out area register, the video write area held in the video write area register, the window cut-out area held in the window cut-out area register and the window write area held in the window write area register, and the color set in the color-designating register on the graphic memory is applied to the display rectangular area corresponding to the value of the display area register.

20. In a video-data processor according to claim 19, a method of video data processing wherein the hardware mapping means comprises the step of computing the video offset information by subtracting the coordinate at the upper left corner of the video cut-out area in the video cut-out area register corresponding to the assumed first video memory in each of horizontal and vertical directions from the coordinate value at the upper left corner of the video write area in the video write area register corresponding to the assumed first video memory selected by the assumed first video memory selection means, on the basis of the expansion/contraction designation and the related expansion/contraction rate described in the special effect description memory, the step of computing a relative/absolute coordinate conversion information by subtracting the coordinate at the upper left corner of the window cut-out area in the window cut-out area register corresponding to the assumed first video memory in each of horizontal and vertical directions from the coordinate at the upper left corner of the window write area in the window write area register corresponding to the assumed first video memory, the step of computing a relative video display rectangle which is a maximum rectangle contained in both the video write area and the window cut-out area, the step of setting a video data write start coordinate by adding the relative/absolute coordinate conversion information to the coordinate at the upper left corner of the relative video display rectangle in each of horizontal and vertical directions and setting the coordinate at the upper left corner of the resulting absolute video display rectangle into the video data write start coordinate register, the step of setting the expansion/contraction rate stored in the special effect description memory as an expansion/contraction rate of the video data expansion/contraction write means, the step of setting a sampling area by subtracting the video offset information from the coordinates of the upper left and lower right corners of the relative video display rectangle, dividing the difference by the expansion/contraction rate and setting the quotient in the sampling area register, the step of setting the expansion rate of the video data expansion read means to an equimultiple, the step of setting a video data expansion read start coordinate at a reference point of the video memory means, the step of setting a display area register for setting the area corresponding to the whole screen of the display means into the display area register, the step of applying the color designated in the color-designating register to the whole pixels in the graphic memory corresponding to the absolute video display rectangle, the step of setting a time address by retrieving the time address information of the screen under reproduction from the reproduction time address retrieval means and setting the particular information in the time address storage register corresponding to the assumed first video memory thus far selected when the assumed first video memory selected by the assumed first video memory selection means is changed, and the step of reproduction restart by reading the time address information in the time address storage register corresponding to the assumed first video memory newly selected and controlling the time address search and reproduction means in such a manner as to start reproduction from the particular time address.

21. A method of video data processing according to claim 20, further comprising the step of redrawing decision for deciding whether necessity arises to redraw the absolute video display area corresponding to unselected another assumed first video memory, when the absolute video display area corresponding to the selected assumed first video memory is relocated, the step of reproducing a redrawn screen by reproducing only a screen of the video data recording medium having the time address information in the time address storage register corresponding to the assumed first video memory which has been decided to require the redrawing at the redrawing decision step, the step of selecting the assumed first video memory temporarily by the assumed first video memory selection means, and the step of writing the single redrawn screen in the video memory.

22. A video-data processor according to claim 5, 6, 11, 13, 15, 17 or 19, wherein the special effect description means is replaced by special effect description means, the video cut-out area register by video cut-out area holding means, the video write area register by video write area holding means, the window cut-out area register by window cut-out area holding means, and the window write area register by window write area holding means, said processor further comprising an operating system configured therein of the special effect description means, the video cut-out area holding means, the video write area holding means, the window cut-out area holding means, the window write area holding means and the hardware mapping means.

* * * * *